US005396873A

United States Patent [19]

Yamanaka et al.

[11] Patent Number: 5,396,873

[45] Date of Patent: Mar. 14, 1995

[54] EVAPORATIVE FUEL-PROCESSING SYSTEM FOR INTERNAL COMBUSTION ENGINES

[75] Inventors: Masayoshi Yamanaka; Hiroshi Maruyama; Masataka Chikamatsu; Yasunari Seki; Kenichi Maeda; Kazutomo Sawamura, all of Wako, Japan

[73] Assignee: Honda Giken Kogyo Kabushiki Kaisha, Tokyo, Japan

[21] Appl. No.: 168,383

[22] Filed: Dec. 17, 1993

[30] Foreign Application Priority Data

| | | | |
|---|---|---|---|
| Dec. 18, 1992 | [JP] | Japan | 4-339253 |
| Feb. 4, 1993 | [JP] | Japan | 5-040526 |
| Aug. 27, 1993 | [JP] | Japan | 5-235720 |

[51] Int. Cl.[6] ..... F02M 33/02

[52] U.S. Cl. ..... 123/520

[58] Field of Search ..... 123/198 D, 516, 518, 123/519, 520

[56] References Cited

U.S. PATENT DOCUMENTS

| | | | |
|---|---|---|---|
| 5,158,054 | 10/1992 | Otsuka | 123/198 D |
| 5,191,870 | 3/1993 | Cook | 123/520 |
| 5,193,512 | 3/1993 | Steinbrenner et al. | 123/520 |
| 5,197,442 | 3/1993 | Blumenstock et al. | 123/198 D |
| 5,259,355 | 11/1993 | Nakashima et al. | 123/520 |
| 5,261,379 | 11/1993 | Lipinski et al. | 123/198 D |
| 5,295,472 | 3/1994 | Otsuka et al. | 123/520 |
| 5,299,545 | 4/1994 | Kuroda et al. | 123/198 D |
| 5,305,724 | 4/1994 | Chikamatsu et al. | 123/520 |

FOREIGN PATENT DOCUMENTS 4-362264 12/1992 Japan .

WO91/12426 8/1991 WIPO .

*Primary Examiner*—Raymond A. Nelli
*Assistant Examiner*—Thomas N. Moulis
*Attorney, Agent, or Firm*—Nikaido, Marmelstein, Murray & Oram

[57] ABSTRACT

An evaporative fuel-processing system includes a first control valve arranged in a charging passage connecting between a fuel tank and a canister for adsorbing evaporative fuel generated from the fuel tank, a second control valve arranged in a purging passage connecting between the canister and an intake passage of the engine, a third control valve arranged in an air inlet port of the canister, and a system internal pressure sensor for detecting pressure within the system. The system is checked for a leak by monitoring a value of the pressure detected by the sensor after the system is negatively pressurized by closing the third control valve and opening the second control valve. The sensor is provided at a location upstream of the first control valve, and the first control valve is closed to detect a value of the pressure or a change thereof. Abnormality determination is carried out based on the detected value of the pressure. Alternatively, all of the above valves are closed in the negatively-pressurized state of the system to detect a first amount of change in the pressure, and then the first control valve alone is opened to detect a second amount of change in the pressure. Abnormality determination can be carried out based on the first and second amounts of change in the pressure, or by comparing a value of the pressure detected when the first and second valves are closed after negative pressurization with a value of the pressure detected after the first control valve is opened.

20 Claims, 37 Drawing Sheets

MAIN ROUTINE

S1
PRECONDITION SATISFIED?
NO
YES
S5
tATMOP=0?
NO
S6
SET tTP
S7
OPEN-TO-ATMOSPHERE PROCESSING
S8
YES
MEASURE PTNK
PATM←PTNK
S9
tTP=0?
NO
YES
S12
FPLVL=1?
NO
YES
S18
FPMIN=1?
NO
YES
S19
tOS=0?
YES
NO
S20
SET tLEAK
S21
OVERSHOOT CHECK
S10
SET tPRG
S11
PRELIMINARY CHECK FOR POSITIVE PRESSURE
S2
NORMAL PURGING
S3
SET tATMOP
S4
FPMIN←0
A
B
C
D

B
C
S22
NO
tLEAK=0?
YES
S25
NO
tLEAK2=0?
YES
S29
tLEAK2←0
S30
tCANCEL=0?
NO
YES
S33
tTP2=0?
NO
YES
S23
SET tLEAK2
S24
1ST LEAK CHECK
S27
SET tCANCEL
S28
2ND LEAK CHECK
S35
ABNORMALITY DETERMINATION
S31
SET tTP2
S32
PRESSURE CANCELLATION
S34
CHECK OF POSITIVE PRESSURE FOR CORRECTION
S13
INITIALIZE PMIN
S14
SET tOS
S15
YES
tPRG=0?
NO
S16
SET tCANCEL
S17
NEGATIVE PRESSU-RIZATION
A
D
EXIT

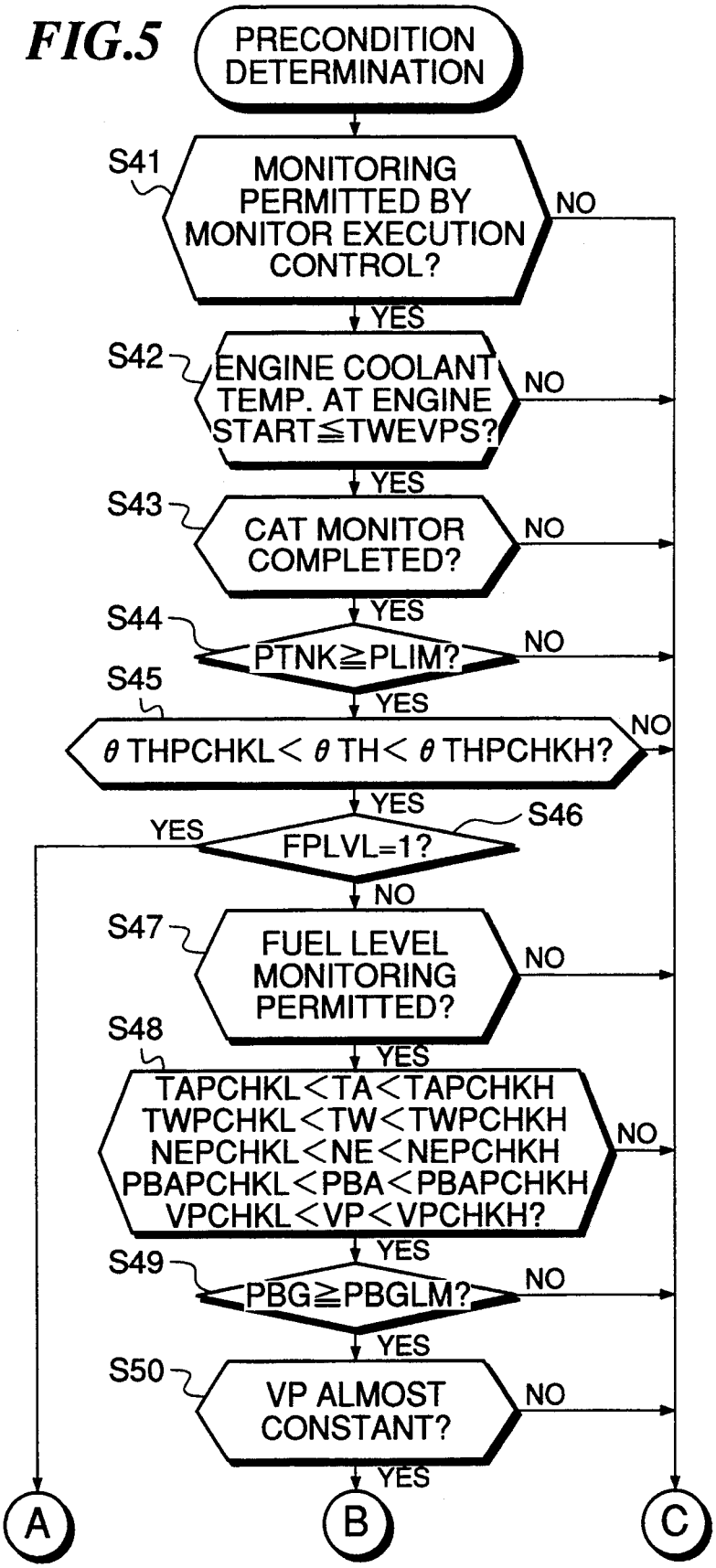
FIG.5
PRECONDITION DETERMINATION
S41
MONITORING PERMITTED BY MONITOR EXECUTION CONTROL?
NO
YES
S42
ENGINE COOLANT TEMP. AT ENGINE START≦TWEVPS?
NO
YES
S43
CAT MONITOR COMPLETED?
NO
YES
S44
PTNK≧PLIM?
NO
YES
S45
θ THPCHKL< θ TH< θ THPCHKH?
NO
YES
S46
FPLVL=1?
YES
NO
S47
FUEL LEVEL MONITORING PERMITTED?
NO
YES
S48
TAPCHKL<TA<TAPCHKH
TWPCHKL<TW<TWPCHKH
NEPCHKL<NE<NEPCHKH
PBAPCHKL<PBA<PBAPCHKH
VPCHKL<VP<VPCHKH?
NO
YES
S49
PBG≧PBGLM?
NO
YES
S50
VP ALMOST CONSTANT?
NO
YES
A
B
C

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, and more particularly to an evaporative fuel-processing system which is capable of detecting abnormality of the system itself.

2. Prior Art

Conventionally, an evaporative fuel-processing system for an internal combustion engine having a fuel tank and an intake passage has been widely used, which comprises a canister for temporarily storing evaporative fuel generated from the fuel tank, a purging passage communicating between the canister and the intake passage, and a purge control valve arranged in the purging passage for allowing evaporative fuel to be properly purged into the intake passage.

To check for a leak of evaporative fuel from the fuel tank, the canister, a passage connecting them, the above-mentioned purging passage, and other parts of the system, the following techniques have been proposed:

International Publication No. W091/12426 of PCT/DE/91/00010 proposes to provide pressure-detecting means for detecting pressure within the evaporative fuel-processing system, and an air admission control valve in an air inlet passage of the canister for control of admission of air into the canister, and determine that the system is normal if negative pressure can be created within the evaporative fuel-processing system by opening the purge control valve while closing the air admission control valve.

Further, Japanese Provisional Patent Publication (Kokai) No. 4-362264 proposes to detect abnormality of the evaporative fuel-processing system by negatively pressurizing the system, and then closing the purge control valve so as to monitor a change in pressure within the system over a predetermined time period.

However, in these evaporative fuel-processing systems for internal combustion engines, negative pressurization is performed of the whole system, and hence it is impossible to detect location of a faulty part.

Further, since operating conditions of the engine are not taken into account, it can be erroneously determined that there is leakage of evaporative fuel when there is no actual leakage thereof, or vice versa, depending on operating conditions thereof.

SUMMARY OF THE INVENTION

It is the object of the invention to provide an evaporative fuel-processing system which is capable of making a check for leakage of evaporative fuel in a short time period with improved accuracy, while permitting location of a faulty part of the system from which evaporative fuel leaks.

To achieve the above object, according to a first aspect of the invention, there is provided an evaporative fuel-processing system for an internal combustion engine having a fuel tank and an intake passage, the evaporative fuel-processing system including the fuel tank, a canister for adsorbing evaporative fuel generated from the fuel tank, the canister having an air inlet port communicating with the atmosphere, a charging passage connecting between the fuel tank and the canister, a first control valve arranged in the charging passage, a purging passage connecting between the canister and the intake passage of the engine, a second control valve arranged in the purging passage, a third control valve arranged in the air inlet port for opening and closing the air inlet port, and system internal pressure-detecting means arranged in the system at a location upstream of the first control valve for detecting pressure within the system.

The evaporative fuel-processing system according to the first aspect of the invention is characterized by comprising:

pressure-reducing means for effecting negative pressurization of the system until the pressure detected by the system internal pressure-detecting means reaches a predetermined negative value by opening the first control valve and the second control valve, and at the same time closing the third control valve; and abnormality-determining means for closing the first control valve and determining abnormality of the system based on a value of the pressure within the system detected in the state in which the first control valve is closed.

Preferably, the abnormality-detecting means determines the abnormality of the system based on an amount of change in the value of the pressure within the system detected by the system internal pressure-detecting means while the first control valve is closed.

More preferably, the abnormality-determining means determines that part of the system upstream of the first control valve is abnormal, when the pressure-reducing means was incapable of negatively pressurizing the system to the predetermined negative value within a predetermined time period, and at the same time an amount of change in the value of the pressure within the system detected when the first control valve is closed after the third control valve is opened is below a predetermined value.

Preferably, the evaporative fuel-processing system further includes inhibiting means for inhibiting operations of the pressure-reducing means and the abnormality-determining means when the pressure within the system detected by the system internal pressure-detecting means when the first control valve is closed before the start of the negative pressurization by the pressure-reducing means is above a predetermined upper limit value.

Preferably, the evaporative fuel-processing system further includes operating condition-detecting means for detecting operating conditions of the engine, and abnormality determination-permitting means for permitting the pressure-reducing means and the abnormality-determining means to perform their operations only when the operating condition-detecting means detects that the engine is a predetermined operating condition.

Preferably, the abnormality-determining means starts to operate upon termination of operation of the pressure-reducing means and compares the value of the pressure within the system with a predetermined reference value to determine the abnormality of the system.

More preferably, the evaporative fuel-processing system further includes a correction amount-detecting means for opening the third control valve, and then closing the first control valve to detect-an amount of change in the pressure within the system, and the predetermined reference value is corrected based on the amount of change in the pressure within the system.

According to a second aspect of the invention, there is provided an evaporative fuel-processing system for an internal combustion engine having a fuel tank and an intake passage, the evaporative fuel-processing system including the fuel tank, a canister for adsorbing evaporative fuel generated from the fuel tank, the canister having an air inlet port communicating with the atmosphere, a charging passage connecting between the fuel tank and the canister, a first control valve arranged in the charging passage, a purging passage connecting between the canister and the intake passage of the engine, a second control valve arranged in the purging passage, a third control valve arranged in the air inlet port for opening and closing the air inlet port, and system internal pressure-detecting means arranged in the system at a location upstream of the first control valve for detecting pressure within the system.

The evaporative fuel-processing system according to the second aspect of the invention is characterized by comprising:

pressure-reducing means for effecting negative pressurization of the system until the pressure detected by the system internal pressure-detecting means reaches a predetermined negative value by opening the first control valve and the second control valve, and at the same time closing the third control valve; and first pressure change-detecting means for closing the first control valve, the second control valve, and the third control valve, after the negative pressurization of the system, and detecting a first amount of change in the pressure within the system in the resulting state of the system in which the first control valve, the second control valve, and the third control valve are closed;

second pressure change-detecting means for opening the first control valve with the second control valve and the third control valve being kept closed after the first amount of change in the pressure within the system has been detected by the first pressure change-detecting means, and detecting a second amount of change in the pressure within the system having occurred after the first control valve has been opened; and abnormality-determining means for determining abnormality of the system based on the first amount of change and the second amount of change in the pressure within the system.

Preferably, the evaporative fuel-processing system further includes control means for keeping the first control valve open when the abnormality determining means determines that the system is abnormal based the first amount of change in the pressure within the system.

Preferably, the evaporative fuel-processing system further includes third pressure change-detecting means for opening the third control valve, and then closing the first control valve to detect an amount of change in the pressure within the system, and the abnormality determining means determines that part of the system upstream of the first control valve is abnormal when a difference obtained by subtracting the third amount of change in the pressure from the first amount of change in the pressure within the system is larger than a predetermined value.

Preferably, the evaporative fuel-processing system further includes control means for keeping the first control valve closed when the abnormality determining means has determined that the first amount of change in the pressure is normal, and has determined that the system is abnormal based on the second amount of change in the pressure.

Preferably, the evaporative fuel-processing system further includes control means for opening the third control valve when the pressure detected by the system internal pressure-detecting means becomes lower than a predetermined lower limit value.

Preferably, the evaporative fuel-processing system further includes inhibiting means for inhibiting operations of the pressure-reducing means, the first pressure change-detecting means, the second pressure change-detecting means, and the abnormality-determining means when the pressure within the system detected by the system internal pressure-detecting means when the first control valve is open before the start of the negative pressurization by the pressure-reducing means is above a predetermined upper limit value.

Preferably, the evaporative fuel-processing system further includes operating condition-detecting means for detecting operating conditions of the engine, and abnormality determination-permitting means for permitting the pressure-reducing means, the first pressure change-detecting means, the second pressure change-detecting means, and the abnormality-determining means to perform their operations only when the operating condition-detecting means detects that the engine is a predetermined operating condition.

According to a third aspect of the invention, there is provided an evaporative fuel-processing system for an internal combustion engine having a fuel tank and an intake passage, the evaporative fuel-processing system including the fuel tank, a canister for adsorbing evaporative fuel generated from the fuel tank, the canister having an air inlet port communicating with the atmosphere, a charging passage connecting between the fuel tank and the canister, a first control valve arranged in the charging passage, a purging passage connecting between the canister and the intake passage of the engine, a second control valve arranged in the purging passage, a third control valve arranged in the air inlet port for opening and closing the air inlet port, and system internal pressure-detecting means arranged in an intermediate portion of the system between the first control valve and the second control valve for detecting pressure within the system.

The evaporative fuel-processing system according to the third aspect of the invention is characterized by comprising:

pressure-reducing means for effecting negative pressurization of the system until the pressure detected by the system internal pressure-detecting means reaches a predetermined negative value by opening at least the second control valve of the first control valve and the second control valve, and at the same time closing the third control valve; and pressure change-detecting means for closing the first control valve, the second control valve, and the third control valve, and detecting an amount of change in the pressure within the system in the resulting state of the system in which the first control valve, the second control valve, and the third control valve are closed; and abnormality-determining means for determining abnormality of the system based on the amount of change in the pressure detected by the pressure change-detecting means.

Preferably, the evaporative fuel-processing system further includes operating condition-detecting means for detecting operating conditions of the engine, and abnormality determination-permitting means for permitting the pressure-reducing means, the pressure change-detecting means, and the abnormality-determining means to perform their operations only when the operating condition-detecting means detects that the engine is a predetermined operating condition.

According to a fourth aspect of the invention, there is provided an evaporative fuel-processing system for an internal combustion engine having a fuel tank and an intake passage, the evaporative fuel-processing system including the fuel tank, a canister for adsorbing evaporative fuel generated from the fuel tank, the canister having an air inlet port communicating with the atmosphere, a charging passage connecting between the fuel tank and the canister, a first control valve arranged in the charging passage, a purging passage connecting between the canister and the intake passage of the engine, a second control valve arranged in the purging passage, a third control valve arranged in the air inlet port for opening and closing the air inlet port, and system internal pressure-detecting means arranged in the system at a location upstream of the first control valve for detecting pressure within the system.

The evaporative fuel-processing system according to the fourth aspect of the invention is characterized by comprising:

pressure-reducing means for effecting negative pressurization of the system until the pressure detected by the system internal pressure-detecting means reaches a predetermined negative value by opening the first control valve and the second control valve, and at the same time closing the third control valve;

comparing means for comparing a first value of the pressure within the system detected by the system internal pressure-detecting means when the first control valve and the second control valve are closed with the third control valve being kept closed, and a second value of the pressure within the system detected by the system internal pressure-detecting means after detection of the first value of the pressure when the first control valve is opened with the second control valve and the third control valve being kept closed; and abnormality determining means for determining abnormality of the system based on results of comparison by the comparing means.

Preferably, the system internal pressure-detecting means is arranged in the charging passage at a location upstream of the first control valve in the vicinity thereof.

More preferably, the predetermined negative value of the pressure within the system is equal to a value of the pressure to be detected by the system internal pressure-detecting means when pressure prevalent within the canister is reduced to a desired level, but pressure prevalent within the fuel tank has not been substantially reduced yet.

Preferably, the evaporative fuel-processing system further includes integrated purged amount-calculating means for calculating an integrated purged amount of evaporative fuel by integrating amounts of purged evaporative fuel detected after the start of the engine, and inhibiting means for inhibiting operations of the pressure-reducing means, the comparing means, and the abnormality-determining means when the integrated purged amount of evaporative fuel is below a predetermined value.

The above and other objects, features and advantages of the invention will be more apparent from the following detailed description taken in conjunction with the accompanying drawings.

BRIEF DESCRIPTION OF THE DRAWINGS

FIG. 5 is a flowchart showing part of a routine carried out by the system of the first embodiment for determining whether or not a precondition is satisfied;

DETAILED DESCRIPTION

The invention will be described in detail with reference to the drawings showing embodiments thereof.

Figure 1:
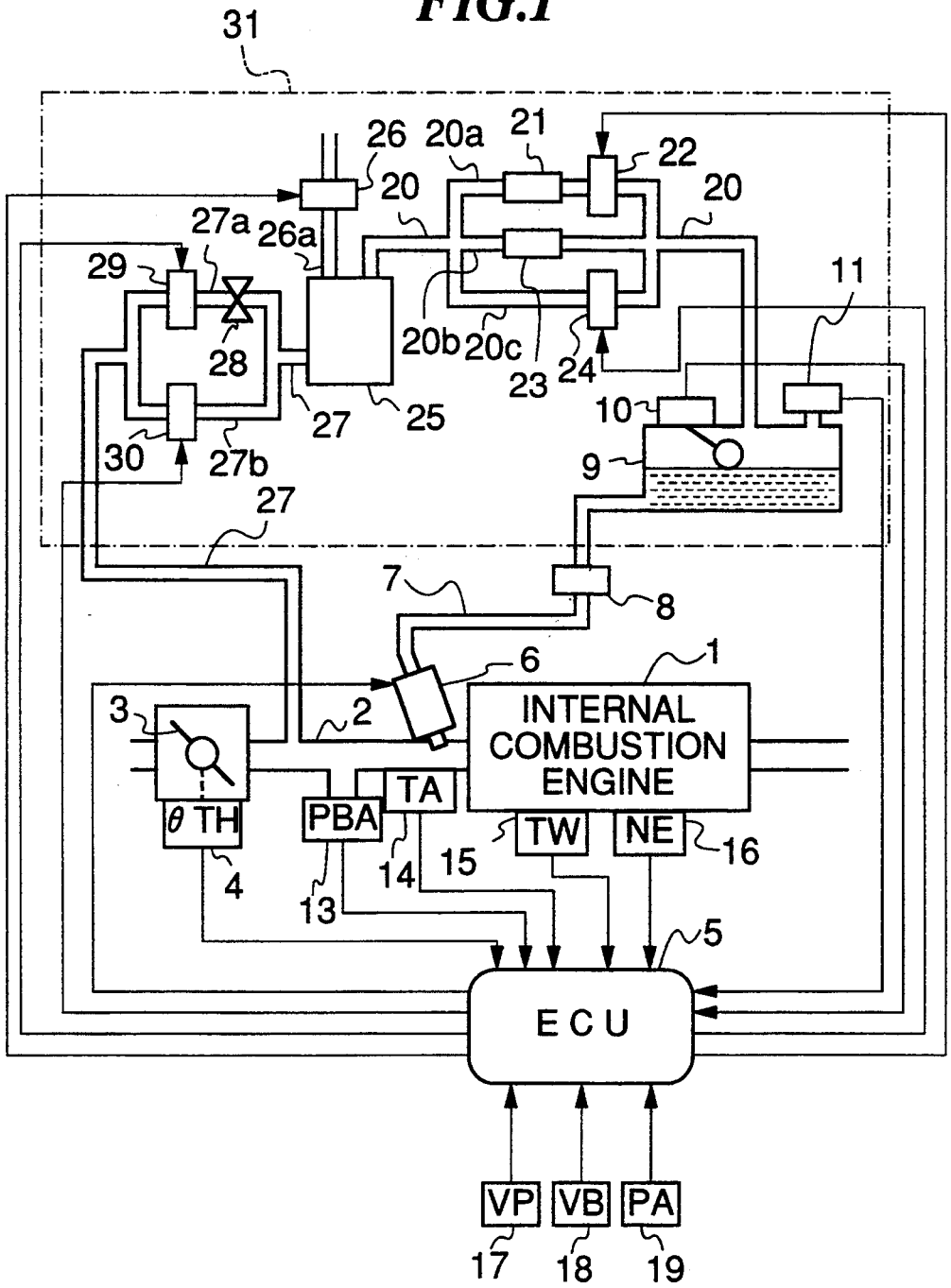
FIG. 1 is a block diagram showing the whole arrangement of an evaporative fuel-processing system according to a first embodiment of the invention.

FIG. 1 is a block diagram showing the whole arrangement of an evaporative fuel-processing system for an internal combustion engine according to a first embodiment of the invention.

In the figure, reference numeral 1 designates an internal engine (hereinafter simply referred to as "the engine") having four cylinders, for instance. Arranged across an intake pipe 2 of the engine 1 is a throttle valve 3. A throttle valve opening ($\theta$TH) sensor 4 is connected to the throttle valve 3 for generating an electric signal indicative of the sensed throttle valve opening and supplying the same to an electronic control unit (hereinafter referred to as "the ECU") 5.

Fuel injection valves 6 are inserted into the interior of the intake pipe 2 at locations intermediate between the cylinder block of the engine 1 and the throttle valve 3 and slightly upstream of respective intake valves, not shown. Each of the fuel injection valves 6 are connected to a fuel tank 9 via a fuel supply pipe 7, across which each of fuel pumps 8 is provided. The fuel injection valves 6 are electrically connected to the ECU 5 to have their valve opening period controlled by signals therefrom.

Mounted downstream of the throttle valve 3 of the intake pipe 2 are an intake pipe absolute pressure (PBA) sensor 13 for detecting absolute pressure PBA within the intake pipe and an intake temperature (TA) sensor 14 for detecting intake temperature TA. Signals indicative of the detected values therefrom are supplied to the ECU 5.

An engine coolant temperature (TW) sensor 15 formed of a thermistor or the like is inserted into a coolant passage filled with a coolant and formed in the cylinder block of the engine 1, so that an electric signal indicative of the sensed engine coolant temperature TW is supplied to the ECU 5.

An engine rotational speed (NE) sensor 16 is arranged in facing relation to a camshaft or a crankshaft of the engine 1, neither of which is shown.

The engine rotational speed sensor 16 generates a pulse as a TDC signal pulse at each of predetermined crank angles whenever the crankshaft rotates through 180 degrees, the pulse being supplied to the ECU 5.

Connected to the ECU 5 are a vehicle speed sensor 17 for detecting the traveling speed of a vehicle with the engine 1 mounted thereon, a battery voltage sensor 18 for detecting battery voltage VB, and an atmospheric pressure sensor 19 for detecting atmospheric pressure PA, the signals indicative of the detected values being supplied to the ECU 5.

Next, an evaporative fuel emission control system (hereinafter referred to as "the emission control system") will be described hereinbelow, which includes a fuel tank 9, a charging passage 20, a canister 25, a purging passage 27, etc.

The fuel tank 9 is provided with a fuel amount sensor 10 for detecting the volumetric amount of fuel within the tank, and a tank internal pressure sensor 11 for detecting the tank internal pressure PTNK, the signals indicative of the detected values being supplied to the ECU 5. An output signal VFUEL from the fuel amount sensor 10 has a voltage value which becomes smaller in accordance with an increase in the volumetric amount of fuel.

The fuel tank 9 is connected to the canister 25 via the charging passage 20 which has first to third branches 20*a* to 20*c*. Inserted into the first branch 20*a* are a one-way valve 21 and a puff loss valve 22. The one-way valve 21 is constructed so as to open when the tank internal pressure PTNK is about 12 to 13 mmHg higher than the atmospheric pressure. The puff loss valve 22 is an electromagnetic valve which is kept open during purging, as described hereinbelow, and is kept closed while the engine is stopped, the operation thereof being controlled by the ECU 5.

Inserted into the second branch 20*b* is a two-way valve 23, which is constructed so as to open when the tank internal pressure PTNK is about 20 mmHg higher than the atmospheric pressure and when the tank internal pressure PTNK is lower, by a predetermined value, than the pressure on one side of the two-way valve 23 close to the canister 25.

Inserted into the third branch 20*c* is a bypass valve 24, which is formed by an electromagnetic valve of normally closed type, while it is opened and closed during the execution of abnormality determination, as described hereinbelow. The operation thereof is controlled by the ECU 5.

The canister 25 accommodates active carbon for adsorbing evaporative fuel, and is provided with an intake port, not shown, to communicate with the atmosphere via a passage 26*a*. Inserted into the passage 26*a* is a drain shut valve 26, which is formed by a normally open electromagnetic valve, while it is temporarily closed during the execution of abnormality determination, described hereinbelow. The operation thereof is controlled by the ECU 5.

The canister 25 is connected to a portion of the intake pipe 2 downstream of the throttle valve 3 via the purging passage 27, which has first and second branches 27*a* and 27*b*. Inserted into the first branch 27*a* are a jet orifice (restriction) 28 and a jet purge control valve 29, and into the second branch 27*b* a purge control valve 30, respectively. The jet purge control valve 29 is formed by an electromagnetic valve and which controls an amount of a mixture of air and fuel to be purged, at such a small flow rate as cannot be precisely controlled by means of the purge control valve 30, and the purge control valve 30 is formed by an electromagnetic valve and continuously controls the flow rate of the mixture in response to a change in the on-off duty ratio of a control signal thereof. The operations of these electromagnetic valves 29 and 30 are controlled by the ECU 5.

The ECU comprises an input circuit having the functions of shaping the waveforms of input signals from the various sensors, shifting the voltage levels of sensor output signals to a predetermined level, converting analog signals to digital signals, and so forth, a central processing unit (hereinafter referred to "the CPU"), memory means storing programs executed by the CPU and for storing results of calculations therefrom, etc., and an output circuit supplying driving signals to the fuel injection valve 6, the puff loss valve 22, the bypass valve 24, the jet purge control valve 29 and the purge control valve 30.

Figures 2A, 2B, 2C, 2D, 2E, 2F:
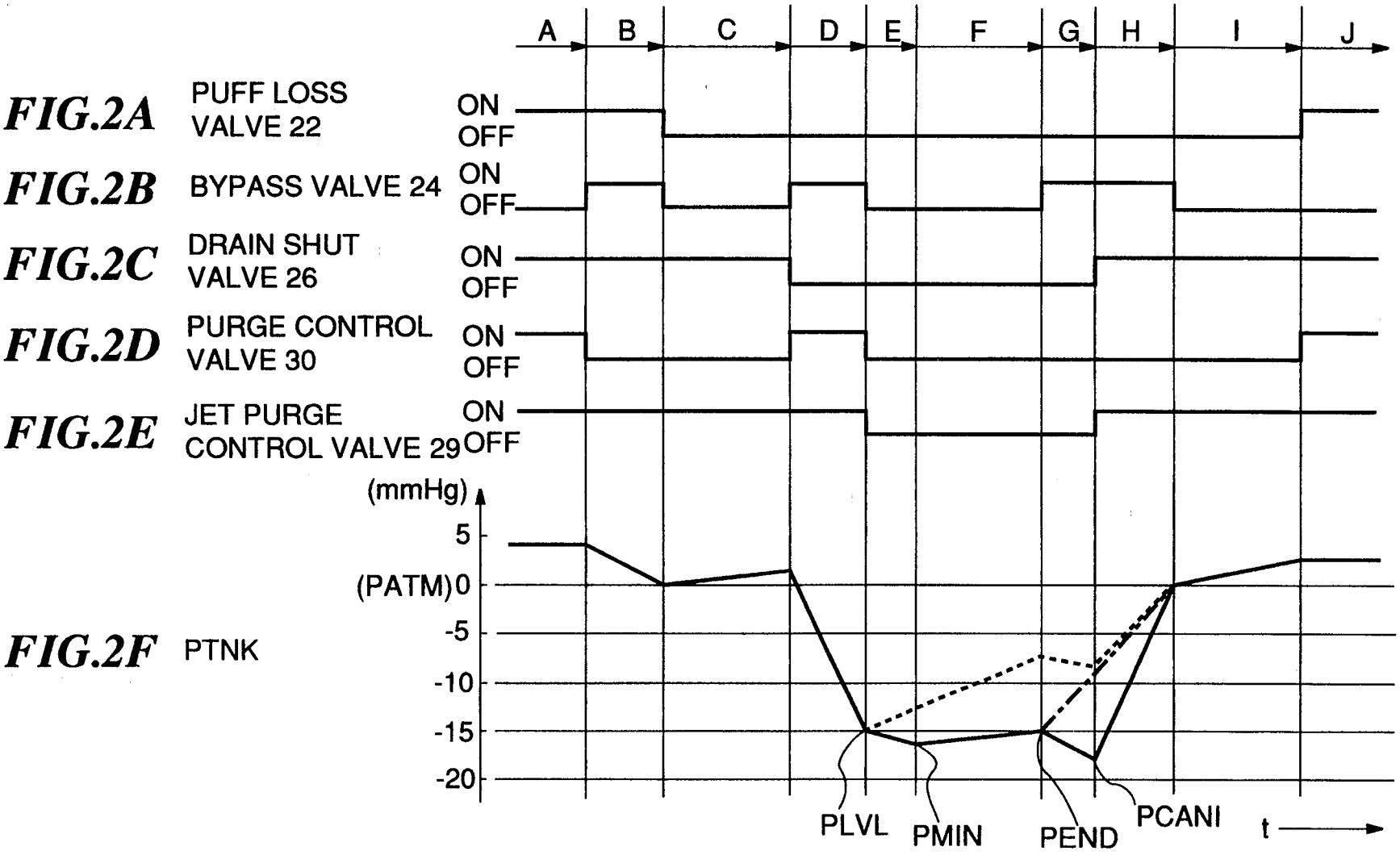
FIG. 2 is a timing chart showing operating states of valves arranged in the evaporative fuel-processing system and changes in the fuel tank internal pressure (PTNK)

FIG. 2 is a timing chart showing operating patterns of the puff loss valve 22, the bypass valve 24, the drain shut valve 26, the purge control valve 30, and the jet purge control valve 29, and a change in the tank internal pressure PTNK corresponding to operations of the valves. The outline of the abnormality determining method according to the present embodiment will be explained by referring to FIG. 2. The tank internal pressure PTNK is shown by the difference from the atmospheric pressure (PATM) in the figure.

In a normal purging mode in which purging is carried out in a normal operating condition of the engine (time period A in FIG. 2), the puff loss valve 22, the drain shut valve 26, the purge control valve 30, and the jet purge control valve 29 are opened, while the bypass valve 24 is closed. On this occasion, evaporative fuel generated within the fuel tank 9 flows into the canister 25 via the charging passage 20 to be temporarily stored in the canister 25. Further, air is introduced through the passage 26, and the evaporative fuel flowing into the canister 25 is supplied together with air into the intake pipe 2 via the purging passage 27.

When a precondition (abnormality determination-permitting condition), described hereinbelow, is satisfied, the electromagnetic valves are operated as shown at time periods B to I in FIG. 2, and abnormality determination of the emission control system 31 is carried out.

First, open-to-atmosphere processing for relieving the tank internal pressure to the atmosphere (time period B in FIG. 2) is carried out. Specifically, the puff loss valve 22, the drain shut valve 26, and the jet purge control valve 29 are kept open, while the bypass valve 24 is opened and the purge control valve 30 is closed, to relieve the inside of the fuel tank 9 to the atmosphere. Thus, for example, when the pressure PTNK=+4 mmHg is satisfied during the engine normal operating condition, a decrease to PTNK=0 mmHg (=PATM) takes place during the time period B.

Next, a preliminary check for positive pressure is made (time period C in FIG. 2). Specifically, the puff loss valve 22 and the bypass valve 24 are closed, while the other valves are kept in the present states. In this state, the tank internal pressure PTNK normally increases due to evaporative fuel generated within the fuel tank, for example, by about 2 mmHg. The rate of change in the tank internal pressure (PVARIA) is measured.

Then, negative pressurization is carried out (time period D in FIG. 2). Specifically, the bypass valve 24 and the purge control valve 30 are opened, while the drain shut valve 26 is closed and the other valves are kept in the present states. In this state, negative pressurization of the emission control system 31 takes place due to negative pressure developed in the intake pipe 2. This negative pressurization is continued until the tank internal pressure PTNK is decreased to a predetermined pressure value PLVL (e.g. −15 mmHg).

Next, an overshoot check is made (time period E in FIG. 2). Specifically, the bypass valve 24, the purge control valve 30 and the jet purge control valve 29 are closed, while the other valves are kept in the present states. In this state, the emission control system 31 is shut off from the intake pipe 2. However, if the emission control system 31 is in a normal state, the tank internal pressure PTNK is further decreased. This decrease is ascribed to the fact that the pressure within the charging passage 20 is lower than the tank internal pressure PTNK immediately after completion of the negative pressurization. If there is a leak in the emission control system 31, the tank internal pressure PTNK increases, as shown by the broken line.

Then, a first leak check is made (time period F in FIG. 2). Specifically, all the valves are kept in the present states, and pressure PMIN at a time point the tank internal pressure PTNK turns from a decrease to an increase is measured, followed by measuring pressure PEND after the lapse of a predetermined time period (tLEAK) from the above time point, to thereby calculate a rate of change PVARIB in the tank internal pressure. On this occasion, if there is a leak in part of the emission control system on the fuel tank side of the bypass valve 24 (hereinafter referred to as "the fuel side part of the system"), the second variation PVARIB becomes larger (see the broken line in the time period F in FIG. 2).

Then, a second leak check is made (time period G in FIG. 2). Specifically, the bypass valve 24 is opened, while the other valves are kept in the present states, and tank internal pressure (PCANI) after the lapse of a predetermined time period (tLEAK2) is measured. In this state, if there is no leak in part of the emission control system on the canister side of the bypass valve 24 (hereinafter referred to as "the canister side part of the system"), the tank internal pressure PTNK is decreased (see the solid line and the broken line in the time period G in FIG. 2). However, when there is a leak in the canister side part of the system, the tank internal pressure PTNK is increased (the one-dot-chain line in the same figure).

Then, pressure cancellation is carried out (time period H in FIG. 2). That is, the drain shut valve 26 and jet purge control valve 29 are opened, while the other valves are kept in the present states, thereby setting the pressure within the emission control system 31 approximately equal to the atmospheric pressure.

Then, a check for positive pressure for correction is made (time period I in FIG. 2). That is, the bypass valve 24 is closed, while the other valves are kept to the present states, and a rate of change PVARIC in the tank internal pressure ascribable to the evaporative fuel generated within the fuel tank is calculated.

Next, the puff loss valve 22 and the purge control valve 30 are opened, while the other valves are kept in the present states, and then the program proceeds to the normal purging mode (time period J in FIG. 2).

Figure 3:
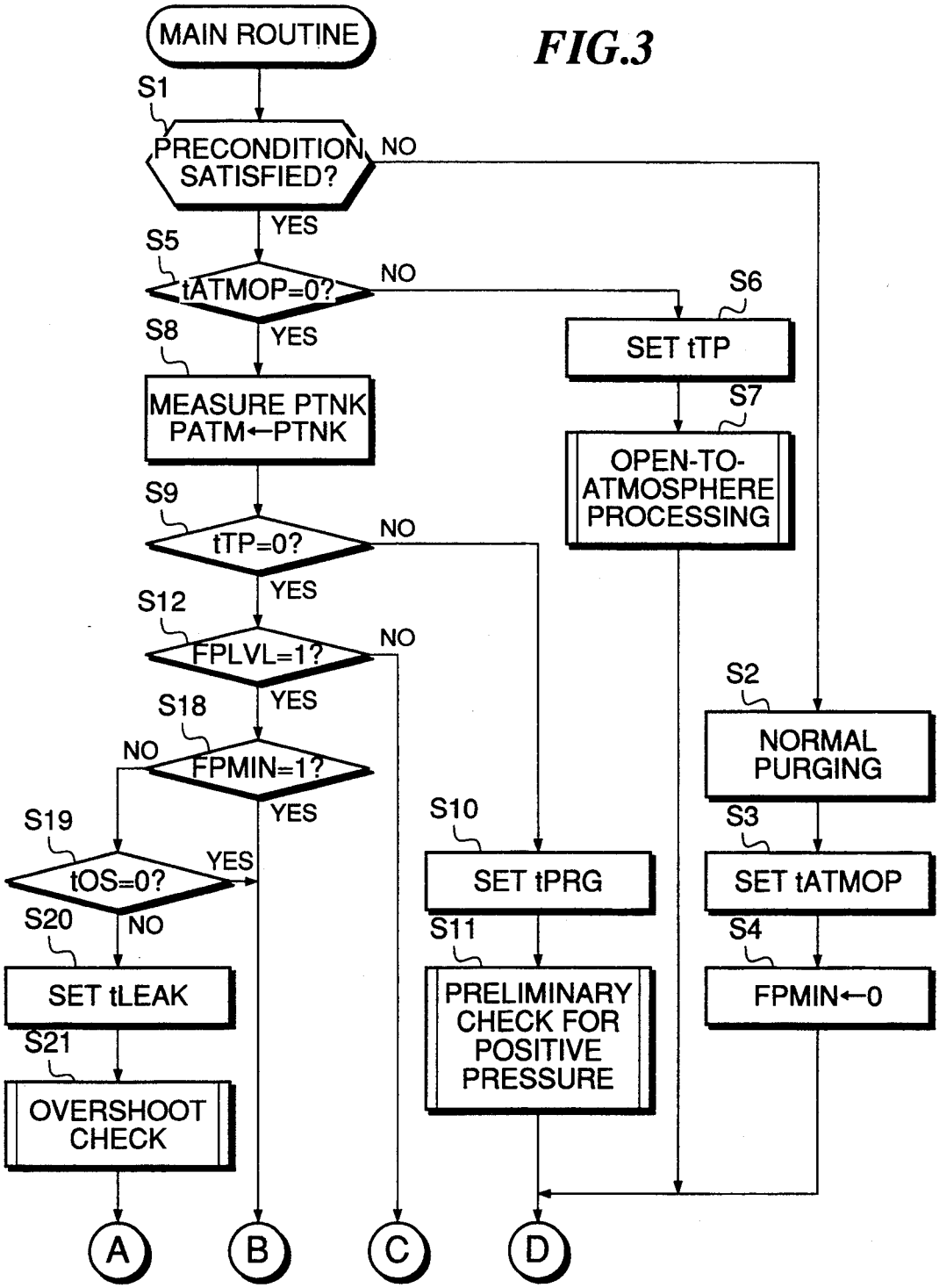
FIG. 3 is a flowchart showing part of a program (main routine) carried out by the system of the first embodiment for determining abnormality.
Figure 4:
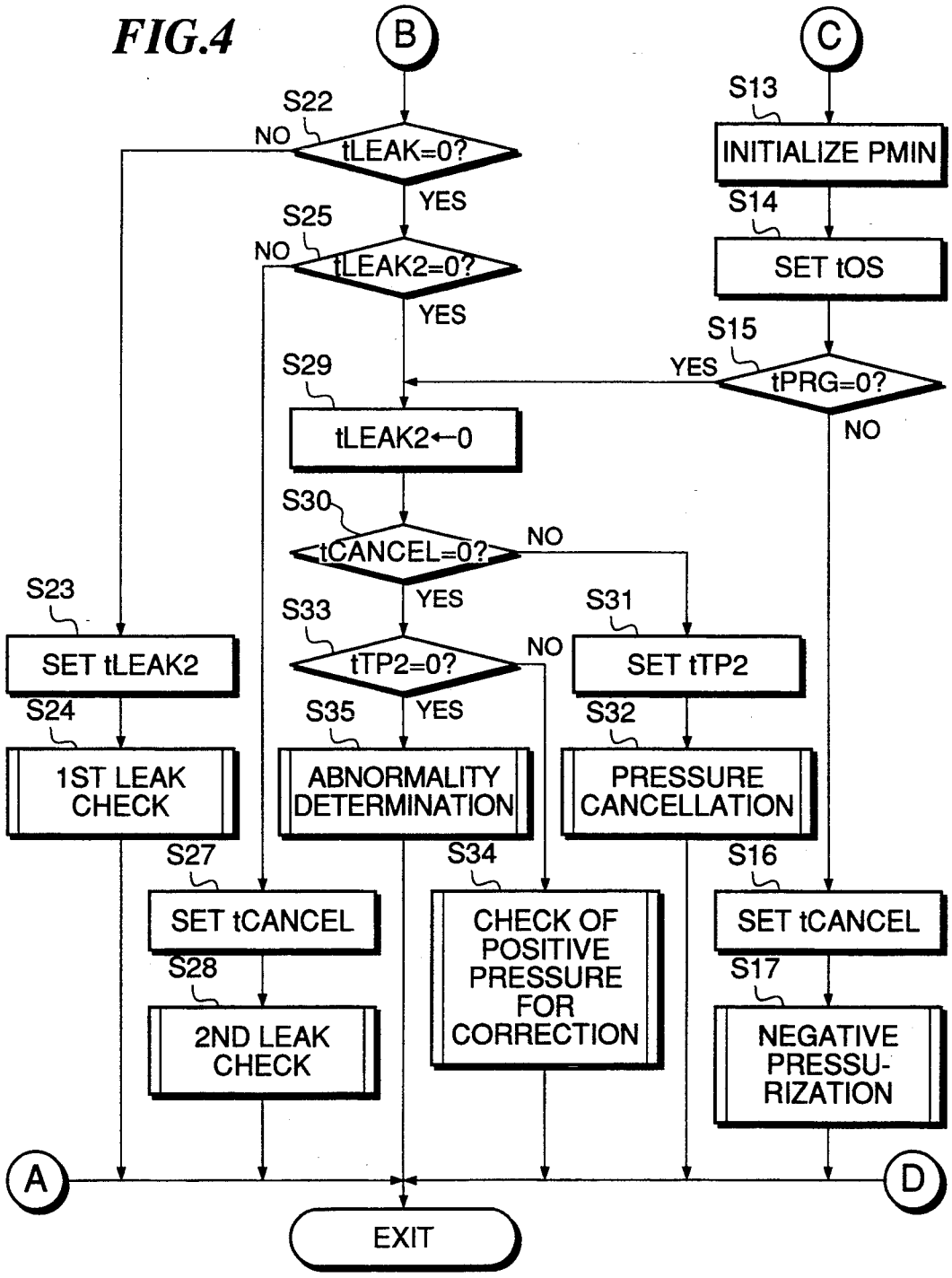
FIG. 4 is a flowchart showing the remaining part of the program (main routine) for determining abnormality.

FIGS. 3 and 4 are flowcharts showing routines (the main routine) for executing the above-mentioned abnormality determination. These programs are executed at predetermined time intervals (e.g. 80 msec).

At a step S1, it is determined whether or not the precondition for permitting the execution of abnormality determination (monitoring) is satisfied. When the precondition is not satisfied, the program proceeds to a step S2, where the normal purging mode is started (time period A in FIG. 2). That is, the puff loss valve 22, the drain shut valve 26, the purge control valve 30 and the jet purge control valve 29 are opened, while the bypass valve 24 is closed. At the same time, a tATMOP timer for measuring a time period during which the open-to-atmosphere processing is executed is set to a predetermined time period tATMOP (e.g. 12 sec) and started at a step S3. Further, a flag FPMIN, which is set to a value of 1 when the tank internal pressure PTNK has a minimum value, is set to a value of 0 at a step S4.

If the answer to the question of the step S1 is affirmative (YES), that is, when the precondition is satisfied, whether or not the count value of the tATMOP timer is equal to 0 is determined at a step S5. Since tATMOP>0 when this step is first carried out, a tTP timer for measuring a time period during which the preliminary check for positive pressure is executed is set to a predetermined time period tTP (e.g. 16 sec) and started at a step S6, followed by effecting the open-to-atmosphere processing (time period B in FIG. 2) at a step S7.

Thereafter, when tATMOP=0 is satisfied, the program proceeds to a step S8, wherein the tank internal pressure PTNK is measured to obtain tank pressure PATM after the open-to-atmosphere processing. Updating of the PATM value is executed only immediately after termination of the open-to-atmosphere processing. Then, whether or not the count value of the tTP timer is 0 is determined at a step S9. Since tTP>0 when the step is first carried out, a tPRG timer for measuring a time period during which negative pressurization is executed is set to a predetermined time period tPRG (e.g. 24 sec) and started at a step S10, subsequently making the preliminary check for the positive pressure (time period C in FIG. 2). The predetermined time period tPRG is set to a value sufficient for reducing the tank internal pressure PTNK to the predetermined value PLVL if the system is normally functioning.

Thereafter, when tTP=0 is satisfied, the program proceeds to a step S12, wherein it is determined whether or not a flag FPLVL is equal to a value of 1. The flag FPLVL is set to 1 when the tank internal pressure PTNK is decreased to a predetermined value (i.e. when the negative pressurization is completed). Since the flag FPLVL=0 when the step is first carried out, the program proceeds to a step S13 in FIG. 4, wherein a minimum tank internal pressure PMIN is initialized. Further, a tOS timer for measuring a time period during which a check for overshoot is made is set to a predetermined time period tOS (e.g. 0.3 sec) and started at a step S14. Then, whether or not the count value of the tPRG timer is equal to 0 is determined at a step S15. Since tPRG>0 when the step is first carried out, a tCANCEL timer for measuring a time period during which pressure cancellation is executed is set to a predetermined time period tCANCEL (e.g. 16 sec) and started at a step S16, followed by executing negative pressurization (time period D in FIG. 2) at a step S17.

When tPRG=0 during the negative pressurization, it means that the negative pressurization is not completed within the predetermined time period tPRG. Therefore, it is determined that there can be a leak in the emission control system, and then the program jumps over to a step S29 without making the first and second leak checks.

If the answer to the question of the step S12 is affirmative (YES), that is, when the negative pressurization has been completed (FPLVL=1 is satisfied), the program proceeds to a step S18, wherein it is determined whether or not a flag FPMIN is equal to a value of 1. Since FPMIN=0 when the step is first carried out, the program proceeds to a step S19, wherein it is determined whether or not the count value of the tOS timer is 0. Since tOS>0 when the step is first carried out, a tLEAK timer for measuring a time period during which the first leak check is made is set to a predetermined time period tLEAK (e.g. 16 sec) and started at a step S20, followed by checking overshoot (time period E in FIG. 2) at a step S21.

Thereafter, when the tank internal pressure PTNK has the minimum value (FPMIN=1 is satisfied ) or tOS=0 is satisfied, the program proceeds to a step S22 in FIG. 4, wherein it is determined whether or not the count value of the timer tLEAK is equal to 0. Since tLEAK>0 when the step is first carried out, a timer tLEAK2 for measuring a time period during which the second leak check is made is set to a predetermined time period tLEAK2 (e.g. 10 sec) and started at a step S23, followed by making the first leak check (period F in FIG. 2), at a step S24.

Thereafter, when tLEAK=0 is satisfied, the program proceeds to a step S25, wherein it is determined whether or not the count value of the timer tLEAK2 is equal to 0. Since tLEAK2>0 when the step is first carried out, the program proceeds to a step S27, wherein a tCANCEL timer is set to a predetermined time period tCANCEL as in the aforementioned step S16 and started, followed by making the second leak check at a step S28.

When tLEAK2=0 becomes satisfied during the second leak check, the tLEAK2 timer is reset to 0 at a step S29, followed by determining whether or not the count value of the tCANCEL timer is 0, at a step S30. Since tCANCEL>0 when the step is first carried out, a timer tPT2 for measuring a time period during which the check for positive pressure for correction is made is set to a predetermined time tTP2 (e.g. 16 sec) and started at a step S31, followed by carrying out pressure cancellation (time period H in FIG. 2) at a step S32.

Thereafter, when. tCANCEL=0 is satisfied, the program proceeds to a step S33, wherein it is determined whether or not the count value of the timer tTP2 is equal to 0. Since tPT2>0 when the step is first carried out, the check for positive pressure for correction (time period I in FIG. 2) is made, and thereafter, upon fulfillment of tPT2=0, a determination is carried out at a step S35, as described hereinbelow .

Figure 6:
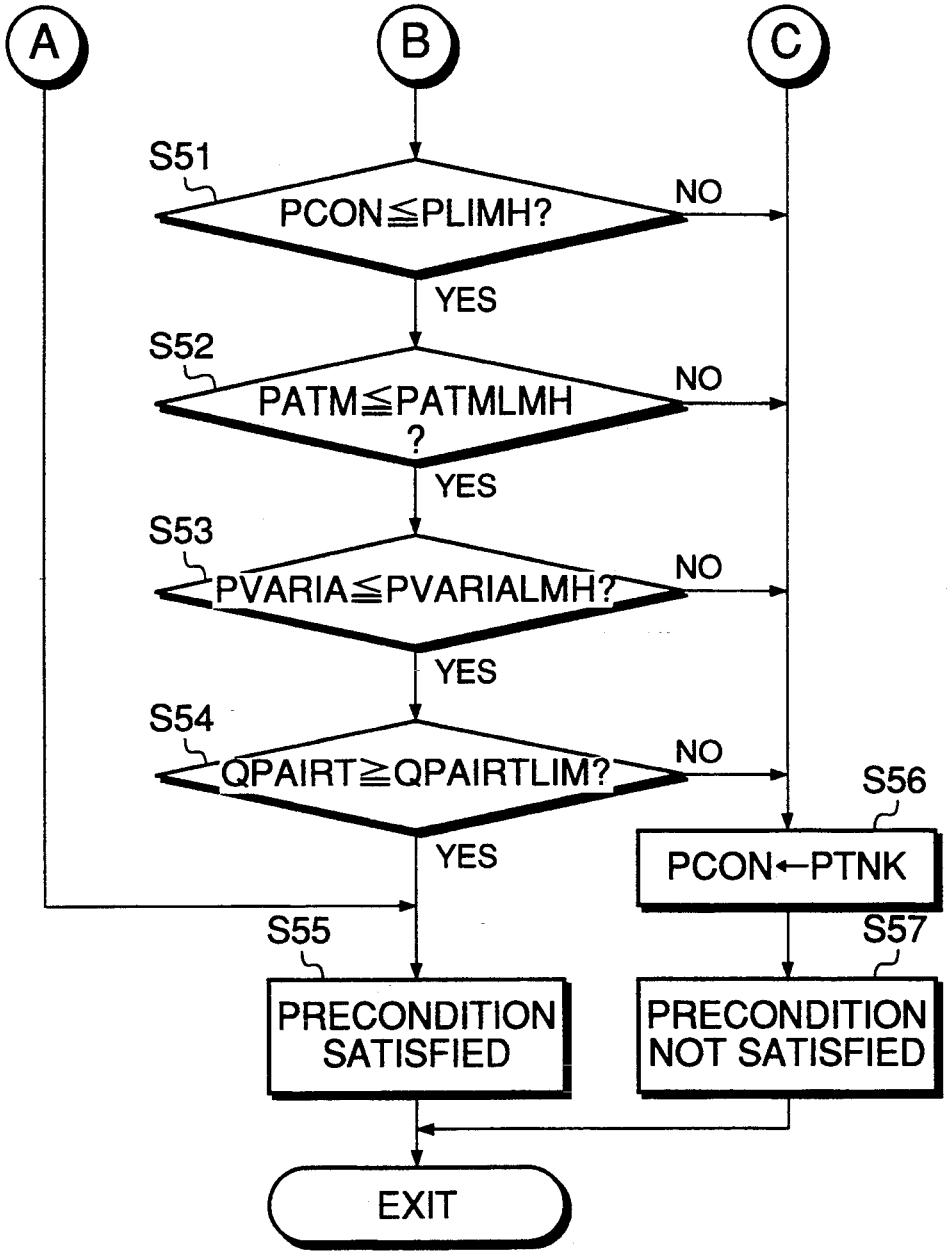
FIG. 6 is a flowchart showing the remaining part of the FIG. 5 routine.

FIGS. 5 and 6 show a subroutine for determining whether or not the precondition in the step S1 in FIG. 3 is satisfied.

At a step S41 in FIG. 5, it is determined whether or not the monitoring (execution of abnormality determination) is permitted, by a monitoring execution control routine. Specifically, it is determined whether or not failure of any of the sensors which provide output values thereof required for the determination of the precondition, the oxygen concentration sensor, not shown, and the like, has been detected, whether or not the engine is in an operating condition in which purging from the canister should be inhibited, and whether or not the abnormality determination executed by the program shown in FIGS. 3 and 4 has been completed. When failure of any of the sensors has been detected, when purging is inhibited, or when the abnormality determination has been completed, the monitoring is inhibited. If the monitoring is thus inhibited, the program proceeds to a step S56 in FIG. 6, wherein the tank internal pressure PTNK is set to an initial pressure value PCON, and then to a step S57, wherein it is determined that the precondition is not satisfied.

When the monitoring is permitted by the monitoring execution control routine, it is determined whether or not engine coolant temperature TWI at the start of the engine is equal to or below a predetermined coolant temperature value TWEVPST (e.g. 20° C.) at a step S42, whether or not a deterioration judgment on a catalyst converter, not shown, provided in the exhaust system of the engine has been completed at a step S43, whether or not the tank internal pressure PTNK is above the predetermined lower limit value PLIM at a step S44, and whether or not the throttle valve opening θTH falls within a range between predetermined upper and lower limit values θTHPCHKH and θTHPCHKL (e.g. between 10 to 5 degrees) at a step S45. When all the answers to the questions of the steps S42 to 45 are affirmative (YES), the program proceeds to a step S46. On the other hand, when TWI>TWEVPST is satisfied, when the deterioration judgment on the catalyst converter is not terminated, when PTNK≦PLIM is satisfied, or when the throttle valve opening θTH falls out of the range between the predetermined upper and lower limit values, the program proceeds to the above-mentioned step S56.

The precondition is not satisfied when the engine coolant temperature TWI at the start of the engine is above the predetermined engine coolant temperature value TWEVPST because it is suffices to execute the abnormality determination only when the engine has not been used for a long time period (e.g. once a day). Further, when the deterioration judgment on the catalyst converter has not been completed, the abnormality determination is inhibited, because the deterioration judgment has higher priority to the abnormality determination of the evaporative emission control system. Further, when the tank internal pressure PTNK is extremely low (PTNK≦PLIM), it is determined that the precondition is not satisfied in order to prevent the tank internal pressure from being negatively pressurized to an excessive degree. Still further, according to the step S45, when the throttle valve opening θTH is outside the predetermined range, the abnormality determination is interrupted even after the start of the first leak check, in order to avoid influences of disturbances caused by turning of the vehicle, the brake, etc.

At a step S46, whether or not the flag FPLVL has been set to a value of 1 is determined, and if FPLVL=1, the program jumps over to a step S55, resulting in that the precondition is determined to have been satisfied. FPLVL=1 means the completion of the negative pressurization, as described hereinabove, and then, execution of a determination routine at steps S47 to S54 is inhibited.

When FPLVL=0 is satisfied, it is first determined at a step S47 whether or not the monitoring is permitted based upon a fuel level (the amount of fuel within the fuel tank). This determination is carried out according to a program shown in FIG. 7.

Figure 7:
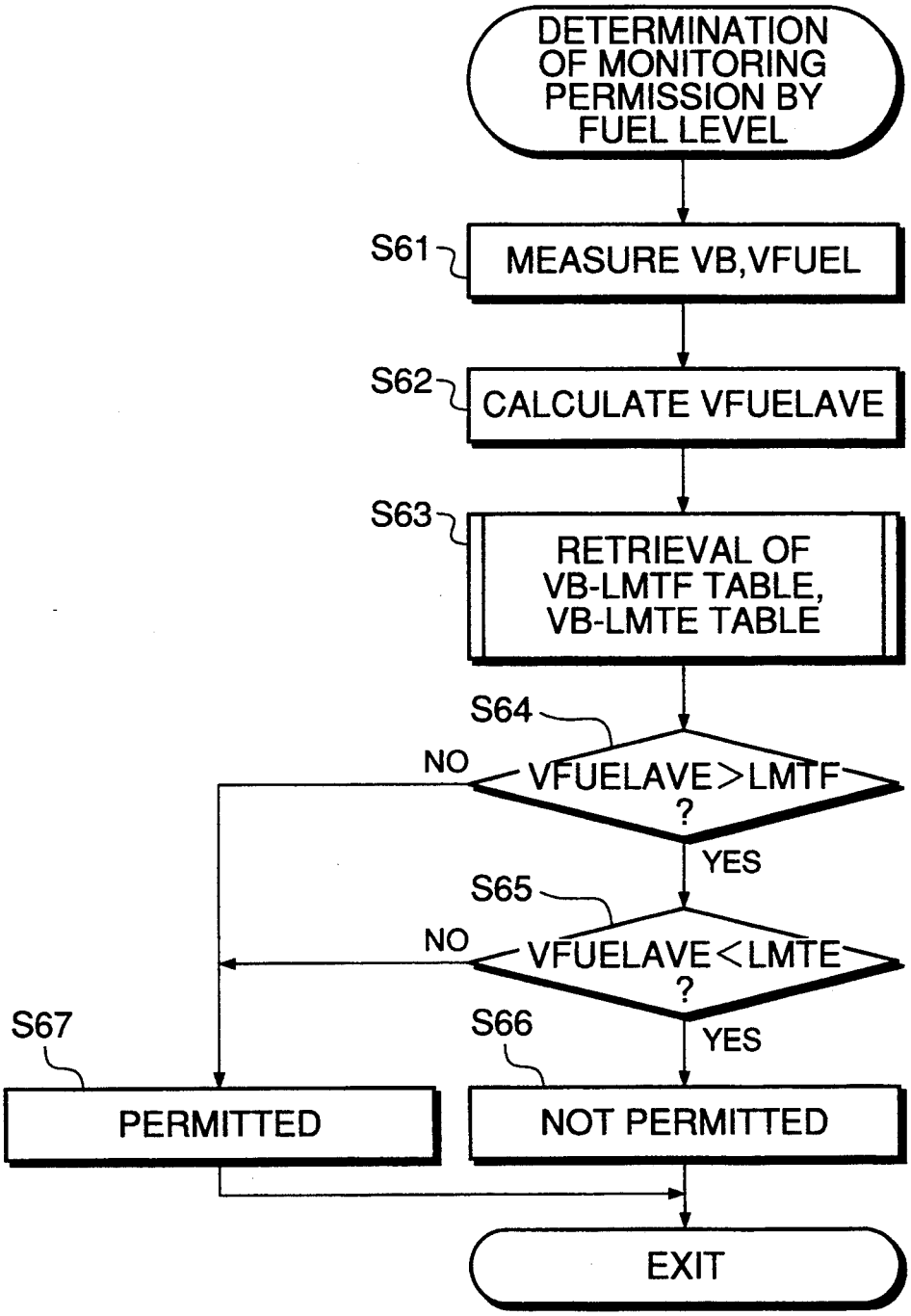
FIG. 7 is a flowchart showing a routine carried out by the system of the first embodiment for determining whether or not abnormality determination is permitted based upon a volumetric amount of fuel within a fuel tank.

At a step S61 in FIG. 7, the battery voltage VB and an output value VFUEL from the fuel amount sensor 10 are read in, and an average value VFUELAVE of the VFUEL value is calculated according to the following equation at a step 62:

$$VFUELAVE = CFUEL \times VFUEL/A1 + (A1 - CFUEL) \times VFUELAVE/A1$$

where VFUELAVE on the right side represents an average value calculated up to the immediately preceding loop, A1 a constant, and CFUEL an averaging coefficient which is set to a value between 1 and A1.

Figure 8:
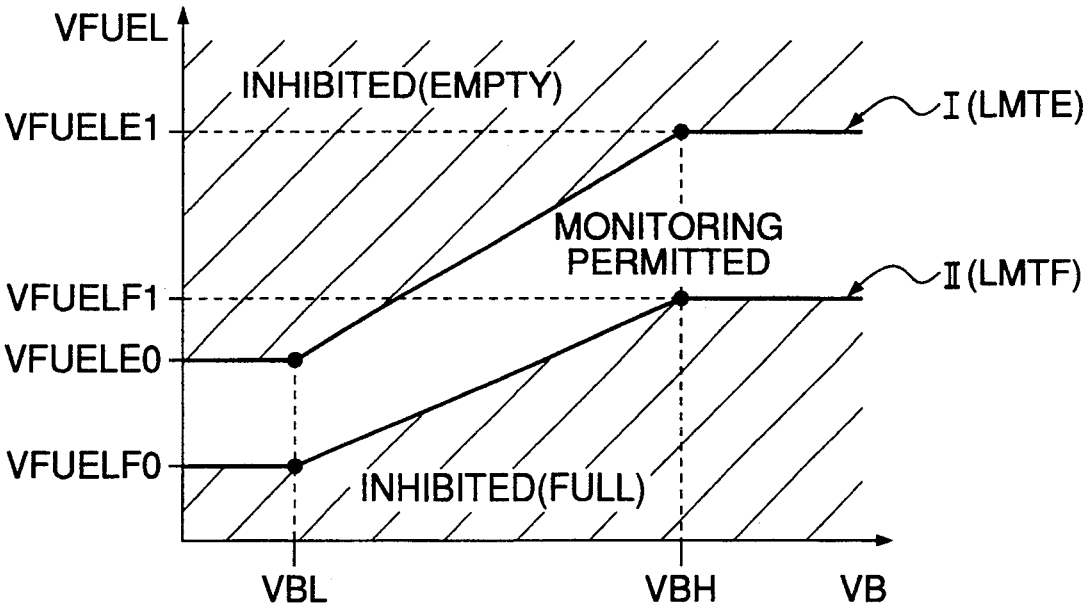
FIG. 8 is a diagram showing a table for determining predetermined values (LMTF and LMTE) for the determination of the FIG. 7 program in accordance with battery voltage (VB)

At the following step S63, a lower limit value LMTF and an upper limit value LMTE of the VFUELAVE value is determined in accordance with the battery voltage VB. Specifically, a VB-LMTE table and a VB-LMTF table, as shown in FIG. 8, in which predetermined upper and lower limit values VFUELE0 and VFUELF0, and VFUELE1 and VFUELF1 are set corresponding to predetermined voltage values VBL and VBH, respectively, are retrieved in accordance with the battery voltage VB, to read values of the LMTF and LMTE values, followed by an interpolation, thereby calculating the LMTE value and the LMTF value. In the tables of FIG. 8, the upper limit value LMTE is set as indicated by the solid line I and the lower limit value LMTF is set as indicated by the solid line II.

Referring again to FIG. 7, it is determined whether or not the VFUELAVE value is larger than the lower limit value LMTF, at a step S64, and whether or not the VFUELAVE value is smaller than the upper limit value LMTE, at a step S65. When LMTF<VFUELAVE<LMTE is satisfied, the monitoring is permitted at a step S66. However, when VFUELAVE≧LMTE or VFUELAVE≦LMTF is satisfied, the monitoring is not permitted, i.e. inhibited at a step S67. Therefore, the monitoring is inhibited when the VFVELAVE value falls in the shaded portions in FIG. 8.

Figure 9:
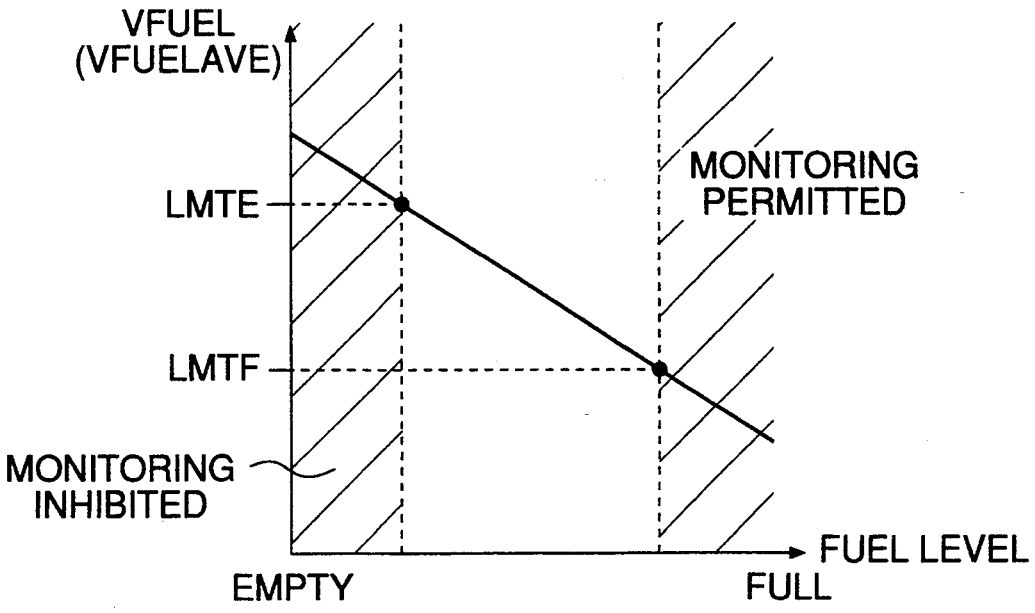
FIG. 9 is a diagram showing the relationship between the volumetric amount of fuel (fuel level) and an output from a fuel amount output sensor (VFUEL)

The VFUEL (VFUELAVE) value becomes larger with a decrease in the fuel amount (see FIG. 9), and therefore, when VFUELAVE≧LMTE is satisfied, it is presumed that the fuel tank is in almost an empty state (EMPTY), while when VFUELAVE≧LMTF is satisfied, it is presumed that the fuel tank is almost fully filled (FULL.). Therefore, the monitoring is inhibited when the fuel tank is almost empty or almost fully filled.

The reason why the upper and lower limit values LMTE and LMTF are set in accordance with the battery voltage VB is that the fuel sensor output VFUEL varies in dependence on the battery voltage VB.

Referring again to FIG. 5, it is determined at a step S48 whether or not the intake temperature TA falls within a range between predetermined upper and lower limit values TAPCHKH and TAPCHKL (e.g. 90° C. and 70° C., respectively), whether or not the engine coolant temperature TW falls within a range between predetermined upper and lower limit values TWPCHKH and TWPCHKL (e.g. 90° C. and 70° C., respectively), whether or not the engine rotational speed NE falls within a range between predetermined upper and lower limit values NEPCHKH and NEPCHKL (e.g. 4000 rpm and 2000 rpm, respectively), whether or not the intake pipe absolute pressure PBA falls within a range between predetermined upper and lower limit values PBAPCHKH and PBAPCHKL (e.g. 610 mmHg and 350 mmHg, respectively), and whether or not a vehicle speed VP falls within a range between upper and lower limit values VPCHKH and VPCHKL (e.g. 61 km/h and 53 km/h, respectively). When any one of the TA, TW, NE, PBA or VP value is outside the range between its respective predetermined upper and lower limit values, the program jumps over to the step S56. On the other hand, when all of the values are within the ranges between the respective predetermined upper and lower limit values, the program proceeds to a step S49.

At the following steps S49 to S54, it is determined whether or not the difference PBG (=PA−PBA) between the atmospheric pressure PA and the intake pipe absolute pressure PBA is not smaller than a predetermined pressure value PBGLM (e.g. +80 mmHg), whether or not the vehicle speed VP is almost constant (e.g. whether or not the variation of the vehicle speed within ±0.8 km/h has continued over 2 seconds), whether or not initial tank internal pressure PCON which is set at the step S56 is not larger than a predetermined pressure value PCLIMH (e.g. +10 mmHg), whether or not the tank internal pressure PATM at termination of the open-to-atmosphere processing is not larger than a predetermined pressure value PATMLMH (e.g. +5 mmHg), whether or not the first rate of change PVARIA is not larger than a predetermined value PVARIALMH (e.g. +0.125 mmHg/sec), and whether or not an integrated flow amount QPAIRT is not smaller than a predetermined value QPAIRTLIM (e.g. 30 to 401). When all the answers to the questions of the steps S49 to S54 are affirmative (YES), it is determined that the precondition is satisfied, at a step S55. On the other hand, when any one of the answers to the questions of the steps S49 to S54 is negative (NO), the program jumps over to the step S56.

Figure 10:
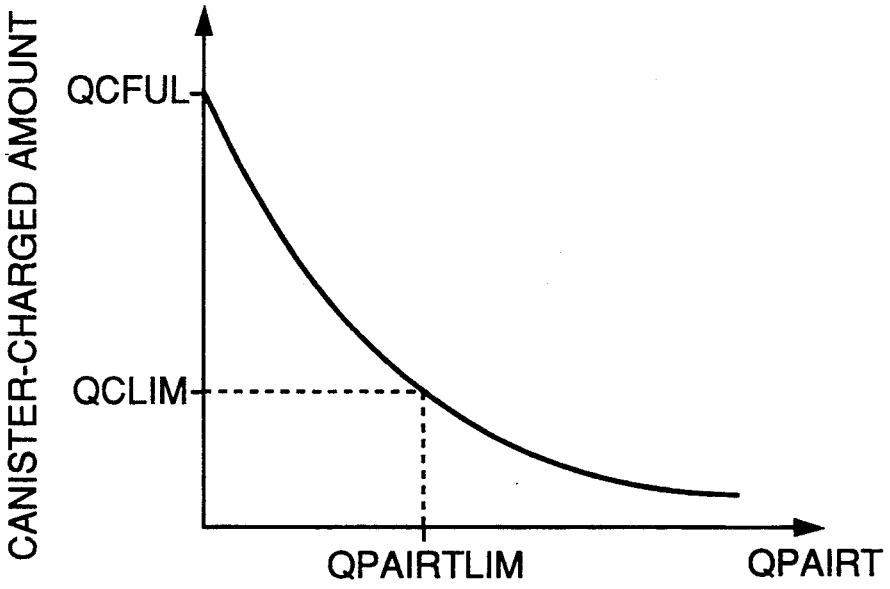
FIG. 10 is a diagram showing the relationship between an integrated flow rate (QPAIRT) and a canister-charged amount.

As mentioned above, it is determined that the precondition is not satisfied when the pressure difference PBG is smaller than the predetermined pressure value PBGLM. This is because the pressure difference PBG is so low at a high altitude that negative pressurization cannot be carried out. Further, when the initial pressure PCON is higher than the predetermined pressure PLIMH at the step S51, when the tank internal pressure PATM at termination of the open-to-atmosphere processing is higher than the predetermined value PATMLMH at the step S52, or when the first rate of change PVARIA is larger than the predetermined value PVARIALMH at the step S53, it is determined that the precondition is not satisfied. This is because evaporative fuel is generated in large amounts when any of these conditions is satisfied, whereby the accuracy of abnormality determination lowers and the variation of the air fuel ratio becomes larger. Further, the integrated flow amount QPAIRT at the step S54 is obtained by accumulating values of the purging flow amount calculated in accordance with the opening of the purge control valve 30 and the pressure difference PBG (=PA−PBA), from the start of the engine up to the immediately preceding loop. When the QPAIRT value is smaller than the predetermined value QPAIRTLIM, the evaporative fuel amount charged within the canister 25 (canister-charged amount) is so large as shown in FIG. 10 that the variation in the air fuel ratio is increased if the abnormality determination is then carried out. Therefore, it is determined that the precondition is not satisfied. FIG. 10 is depicted such that the canister-charged amount QCFUL at the time of QPAIRT=0 indicates a value of the changed amount assumed when the canister 25 is fully charged (the charged amount is the maximum possible), and therefore, the charged amount at the time of QPAIRT=QPAIRTLIM cannot become larger than a value QCLIM to be assumed after a drop from the maximum possible of the changed amount. Therefore, the abnormality determination is carried out only at the time of QPAIRT≧QPAIRTLIM is satisfied, whereby the accuracy of abnormality determination is improved and a large variation in the air fuel ratio is prevented.

Next, detailed explanations will be made of the open-to-atmosphere processing at the step S7, the preliminary check for positive pressure at the step S11, the negative pressurization at the step S17, the overshoot check at the step S27, the first leak check at the step S24, the second leak check at the step S28, the pressure cancellation at the step 32, the check for positive pressure for correction at the step S34, and the abnormality determination at the step S35, all appearing in the FIG. 4 and FIG. 5 main routine, with reference to FIGS. 11 to 19.

(1) Open-to-Atmosphere Processing (Time Period B in FIG. 2)

Figure 11:
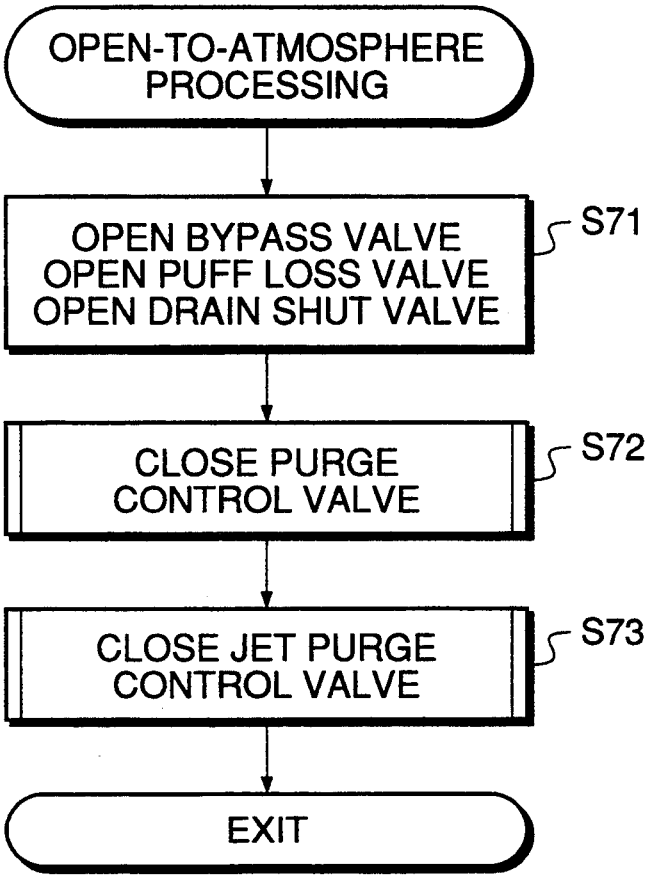
FIG. 11 is a flowchart showing a routine for carrying out open-to-atmosphere processing.

As shown in FIG. 11, the bypass valve 24, the puff loss valve 22, and the drain shut valve 26 are opened at a step S71, the purge control valve is closed at a step S72, and the jet purge control valve 29 is opened at a step S73, thereby carrying out the open-to-atmosphere processing. The reason why the jet purge control valve 29 is opened is that continuous purging in a small amount is desirable and the tank internal pressure PTNIC is hardly affected by opening the valve 29. The same reason can apply to the preliminary check for positive pressure, the pressure cancellation and the check for positive pressure for correction.

(2) Preliminary Check for Positive Pressure (C in FIG. 2)

Figure 12:
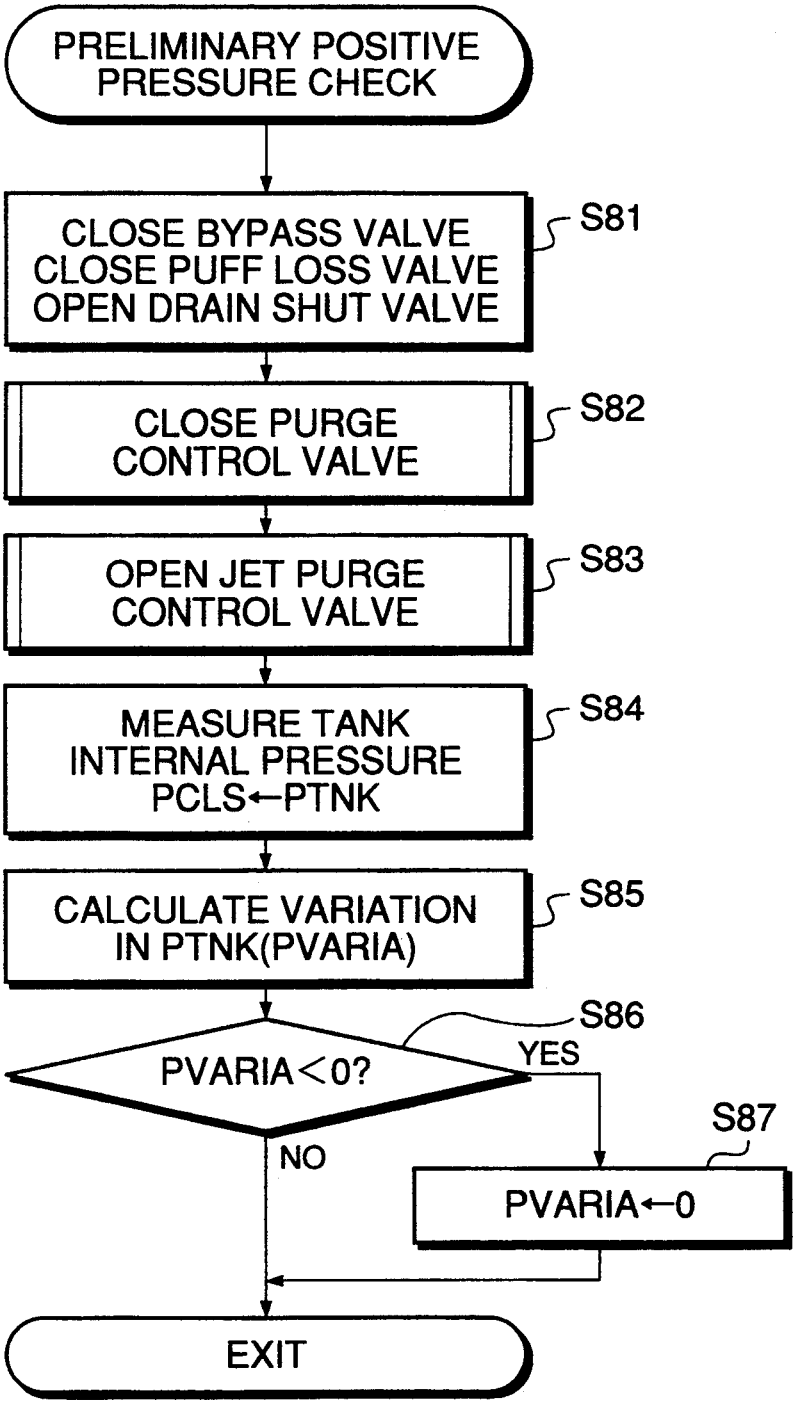
FIG. 12 is a flowchart showing a routine carried out by the system of the first embodiment for making a preliminary check for positive pressure.

As shown in FIG. 12, the bypass valve 24 and the puff loss valve 22 are closed, while the other valves are kept in the present states at steps S81 to S83, and then the tank internal pressure PTNK is measured to obtain a value PCLS at a step S84. The first rate of change PVARIA is calculated by the following equation at a step S85:

$$PVARIA=(PCLS-PATM)/tTP$$

At the following step S86, it is determined whether or not the rate of change PVARIA assumes a negative value, and when it assumes a negative value, PVARIA is set to 0 at a step S87.

Since the routine of FIG. 12 is carried out after execution of the steps S8 and S9 in FIG. 3, the initial calculated PVARIA value should be 0. However, the calculated PVARIA value obtained when the predetermined time period tTP has elapsed indicates a rate of change in the tank internal pressure PTNK per unit time during the preliminary check for positive pressure. The PVARIA value is normally positive due to the generation of evaporative fuel. However, when the value becomes negative, it is set to 0 at the steps S86 and S87.

(3) Negative Pressurization (D in FIG. 2)

Figure 13:
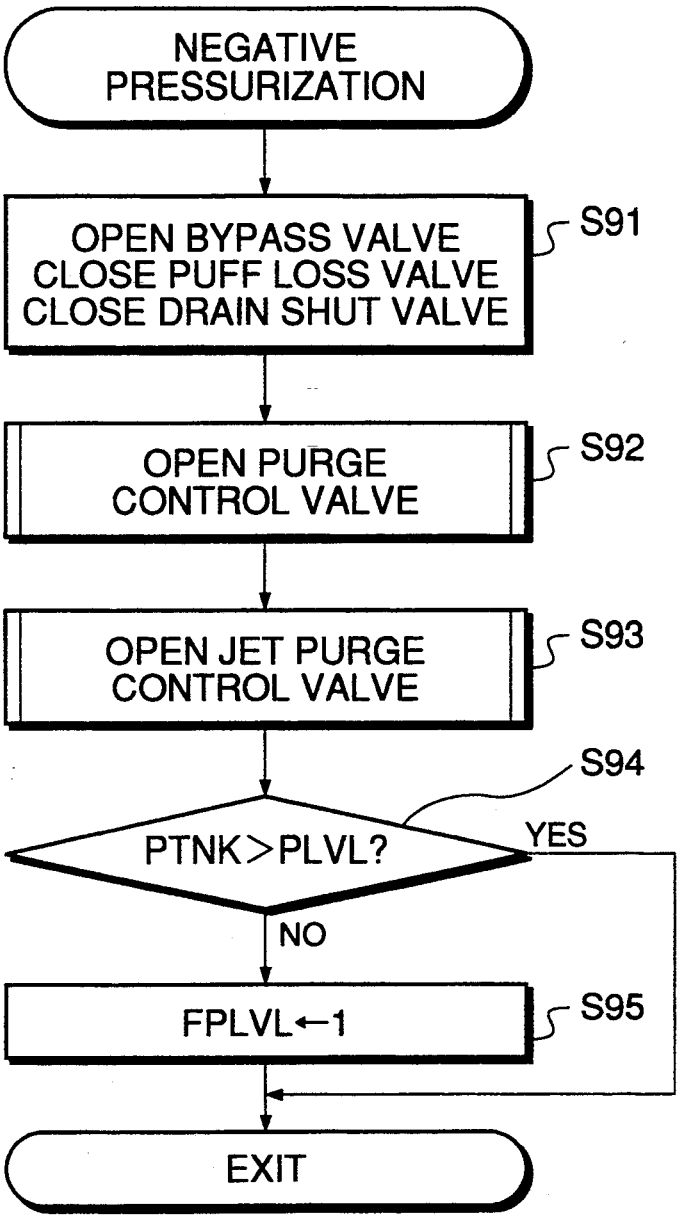
FIG. 13 is a flowchart showing a routine carried out by the system of the first embodiment for negative pressurization.

As shown in FIG. 13, at steps S91 to S93, the bypass valve 24 and the purge control valve 30 are opened, while the drain shut valve 26 is closed and the other valves are kept in the present states. Then, it is determined at a step S94 whether or not the tank internal pressure PTNK is higher than a predetermined pressure value PLVL (e.g. −15 mmHg). When the step S94 is first carried out, PTNK>PLVL is satisfied. When PTNK≦PLVL, the flag FPLVL is set to a value of 1 at a step S95, to indicate the completion of the negative pressurization.

(4) Overshoot Check (E in FIG. 2)

Figure 14:
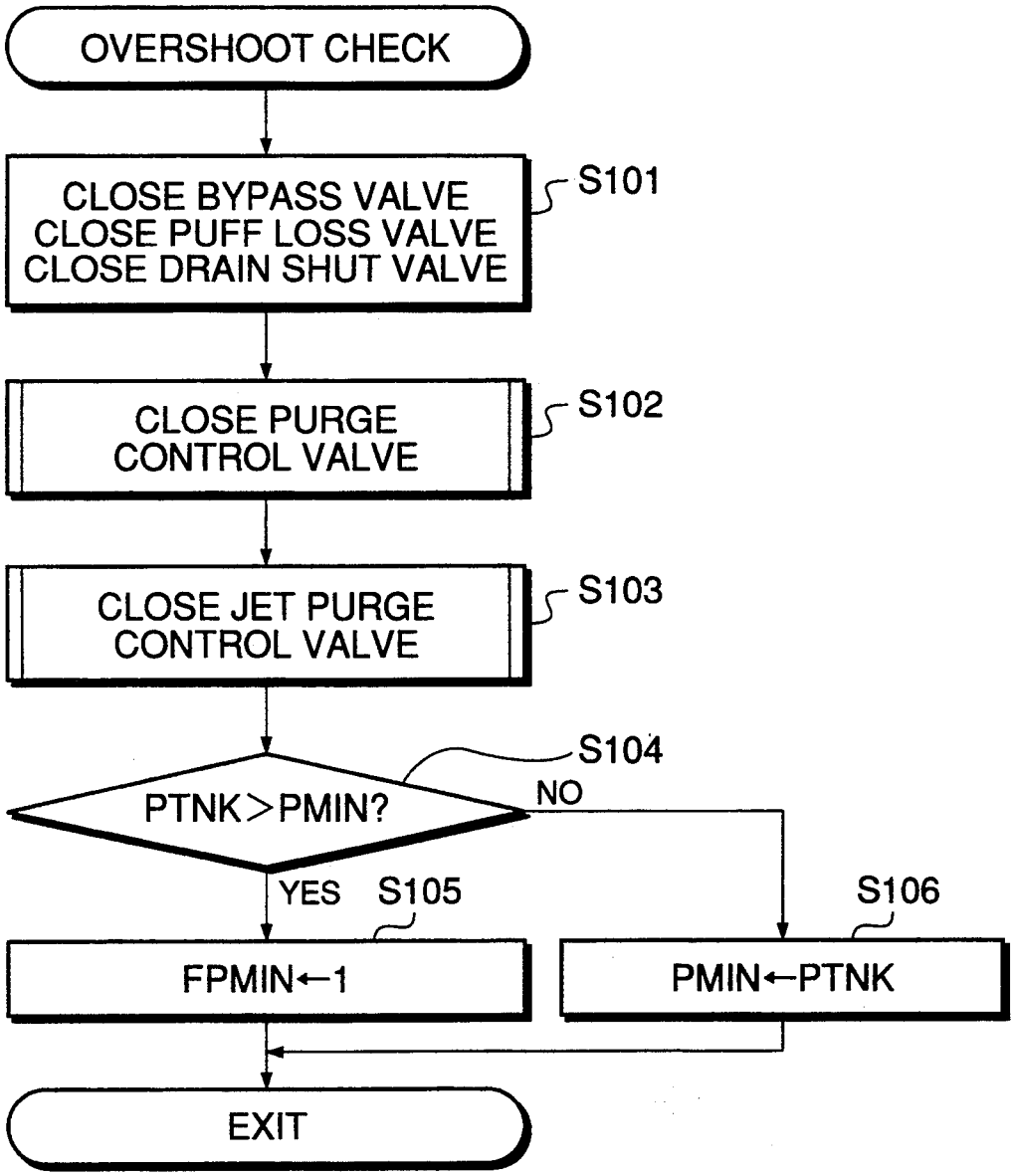
FIG. 14 is a flowchart showing a routine carried out by the system of the first embodiment for checking overshooting.

As shown in FIG. 14, at steps S101 to S103, the bypass valve 24, the purge control valve 30 and the jet purge control valve 29 are closed, while the other valves are kept in the present states. It is determined at a step S104 whether or not the tank internal pressure PTNK is higher than the minimum tank internal pressure value PMIN. Since the PMIN value is initially set to a sufficiently large value at the step S13 in FIG. 4, PTNK≦PMIN is satisfied when the step S104 is first carried out, and the PMIN value is updated to the PTNK value then assumed, at a step S106. While the tank internal pressure PTNK has lowered, the updating is executed, however, when the tank internal pressure turns to an increased side, PTNK>PMIN becomes satisfied, and then the flag FPMIN is set to a value of 1 at a step S105.

By the routine of the overshoot check described above, the PMIN value assumes the minimum tank internal value after the completion of the negative pressurization. When there is a leak in the evaporative emission control system 31 so that the PTNK value varies as indicated by the broken line in FIG. 2, PMIN is set to PLVL.

(5) First Leak Check (F in FIG. 2).

Figure 15:
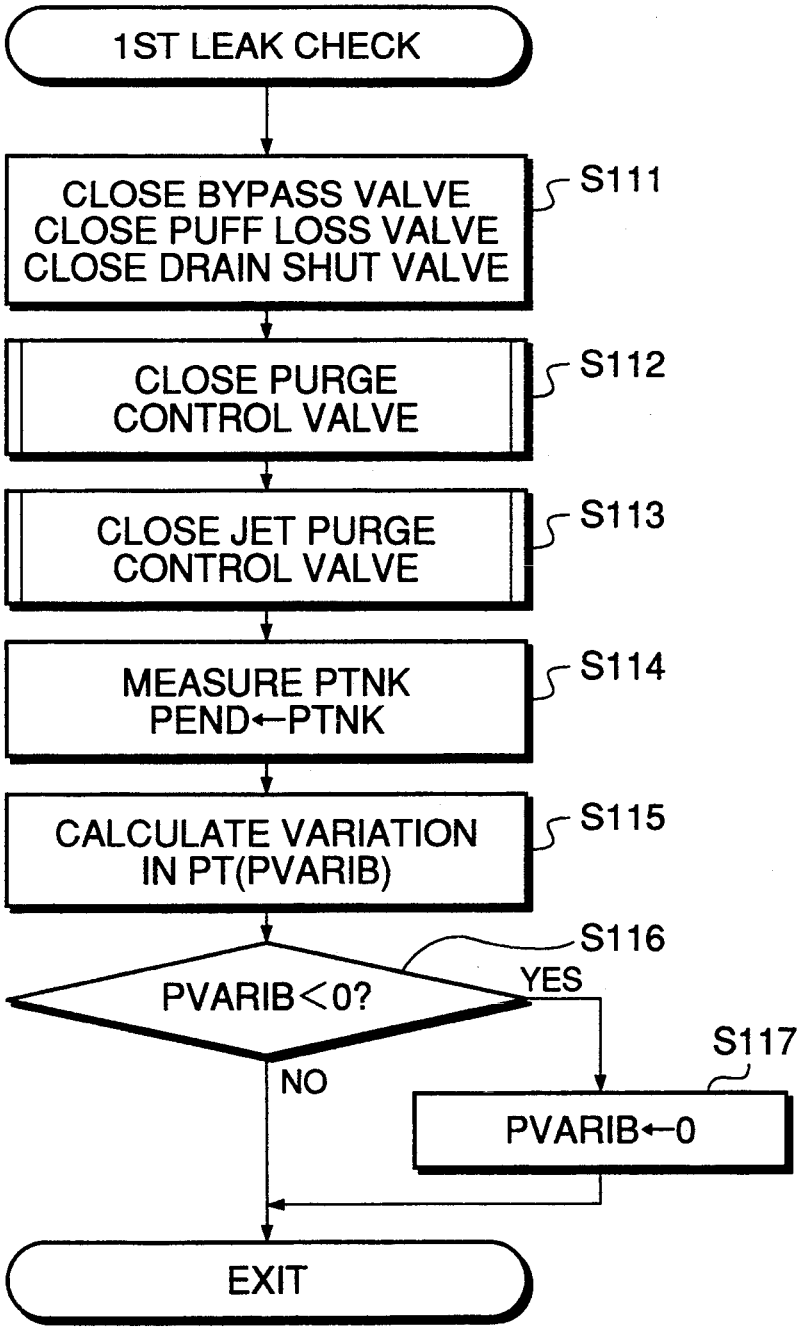
FIG. 15 is a flowchart showing a routine carried out by the system of the first embodiment for making a first leak check.

As shown in FIG. 15, all the valves are kept in the same states as assumed when the routine of overshoot check was executed at the steps S111 to S113, and then the tank internal pressure PTNK is measured to obtain a value PEND at a step S114. The second rate of change PVARIB is calculated according to the following equation at a step S115:

$$PVARIB=(PEND-PMIN)/tLEAK$$

The PVARIB value indicates a rate of change in the tank internal pressure PTNK per unit time during the first leak check and is finally determined upon the lapse of the predetermined time period tLEAK.

At the following step S116, whether or not the PVARIB value is negative is determined, and when it is negative, the PVARIB value is set to 0 at a step S117.

(6) Second Leak Check (G in FIG. 2)

Figure 16:
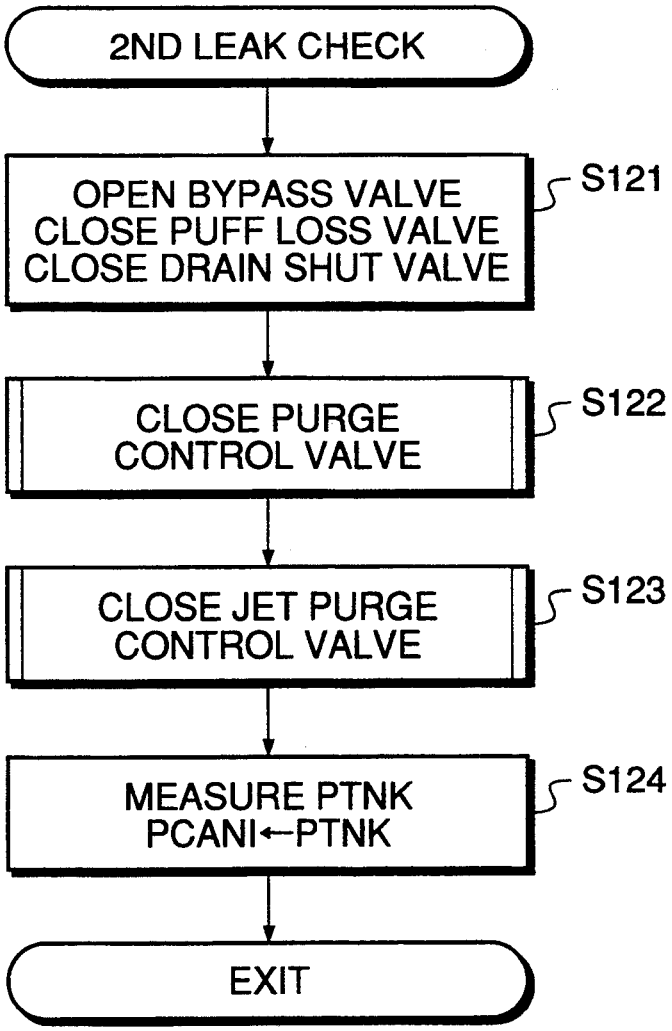
FIG. 16 is a flowchart showing a routine carried out by the system of the first embodiment for making a second leak check.

As shown in FIG. 16, the bypass valve 24 is opened, with the other valves being kept in the present states, at steps S121 to S123, and then the tank internal pressure PTNK is measured, thereby obtaining a value PCANI at a step S124.

Since the present routine is carried out for the predetermined time period tLEAK2, the PCANI value finally assumes a tank internal pressure value obtained upon the lapse of tLEAK2 from the completion of the first leak check.

(7) Pressure Cancellation (H in FIG. 2)

Figure 17:
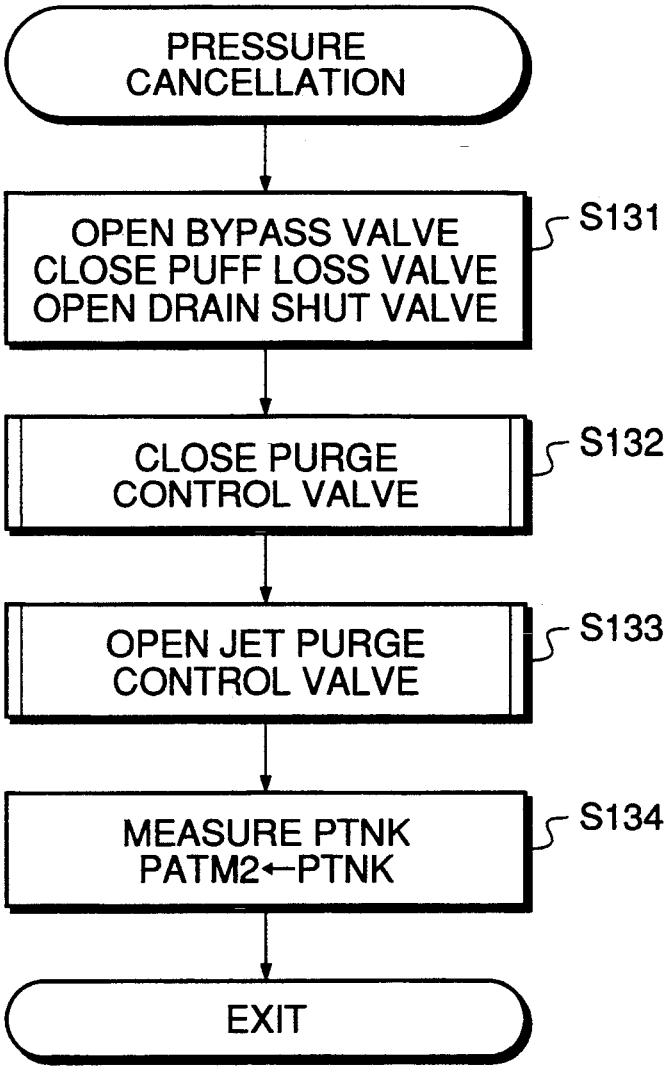
FIG. 17 is a flowchart showing a routine carried out by the system of the first embodiment for pressure cancellation.

As shown in FIG. 17, the drain shut valve 26 and the jet purge control valve 29 are opened, while the other valves are kept in the present states, at steps S131 to S133, followed by measuring the tank internal pressure PTNK to obtain a value PTAM2 at step S134.

Since the present routine is carried out for the predetermined time period tCANCEL, the PATM2 value finally assumes a tank internal pressure value obtained upon the lapse of tCANCEL from the completion of the second leak check. The tCANCEL value is set such that the PATM2 value becomes almost equal to the atmospheric pressure, and the PATM2 value thus obtained will be used for calculation of a third rate of change PVARIC, as described hereinbelow.

(8) Check for Positive Pressure for Correction (I in FIG. 2)

Figure 18:
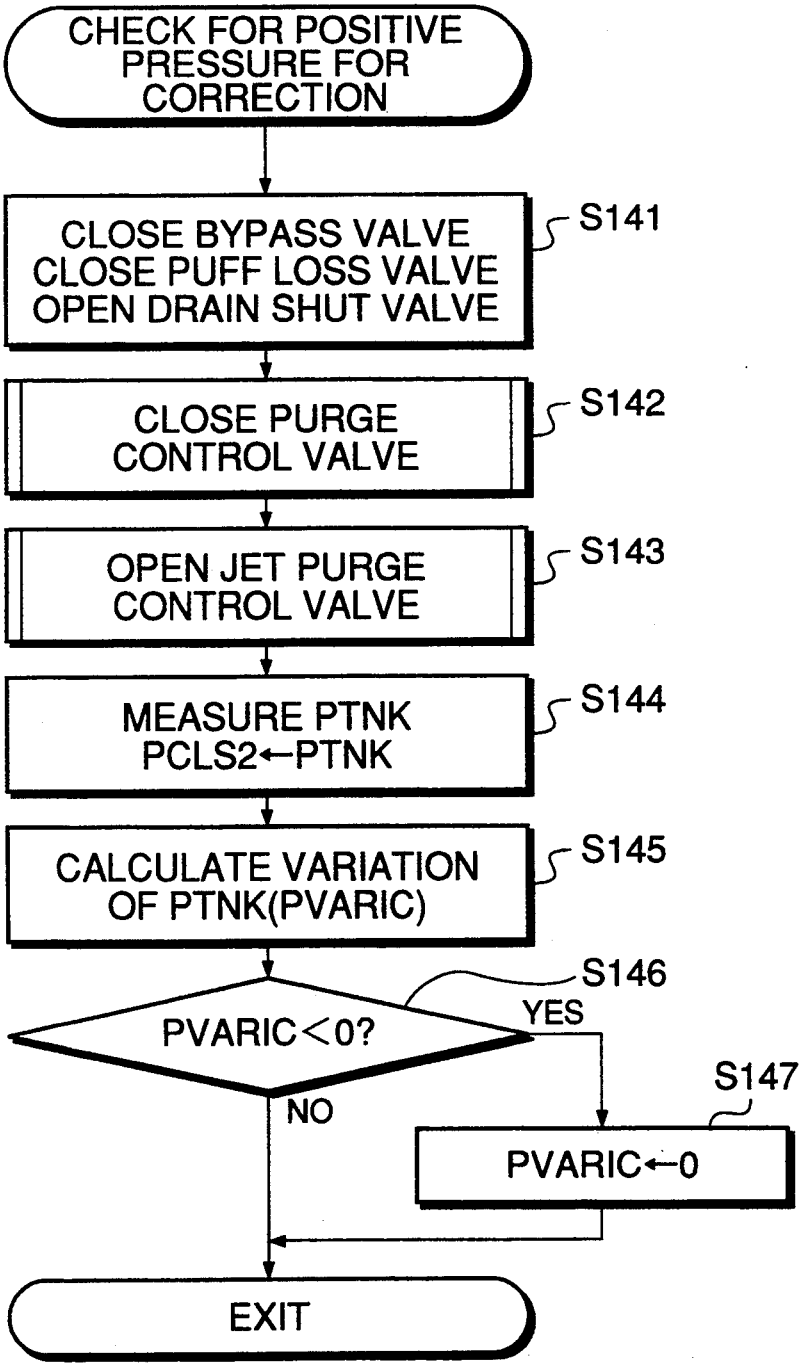
FIG. 18 is a flowchart showing a routine carried out by the system of the first embodiment for making a check for positive pressure for correction.

As shown in FIG. 18, the bypass valve 24 is closed, while the other valves are kept in the present states, at steps 141 to 143, and then the tank internal pressure PTNK is measured to thereby obtain a value PCLS2 at a step S144. The third rate of change PVARIC is calculated by the following equation at a step S145:

$$PVARIC=(PCLS2-PATM2)/tTP2$$

The PVARIC value indicates a rate of change in the tank internal pressure per unit time during the check for positive pressure for correction, and is finally determined upon the lapse of the predetermined time period tTP2.

At the following step S146, whether or not the PVARIC value is negative is determined, and when it is negative, the PVARIC value is set to 0 at a step 147.

(9) Abnormality Determination

Figure 19:
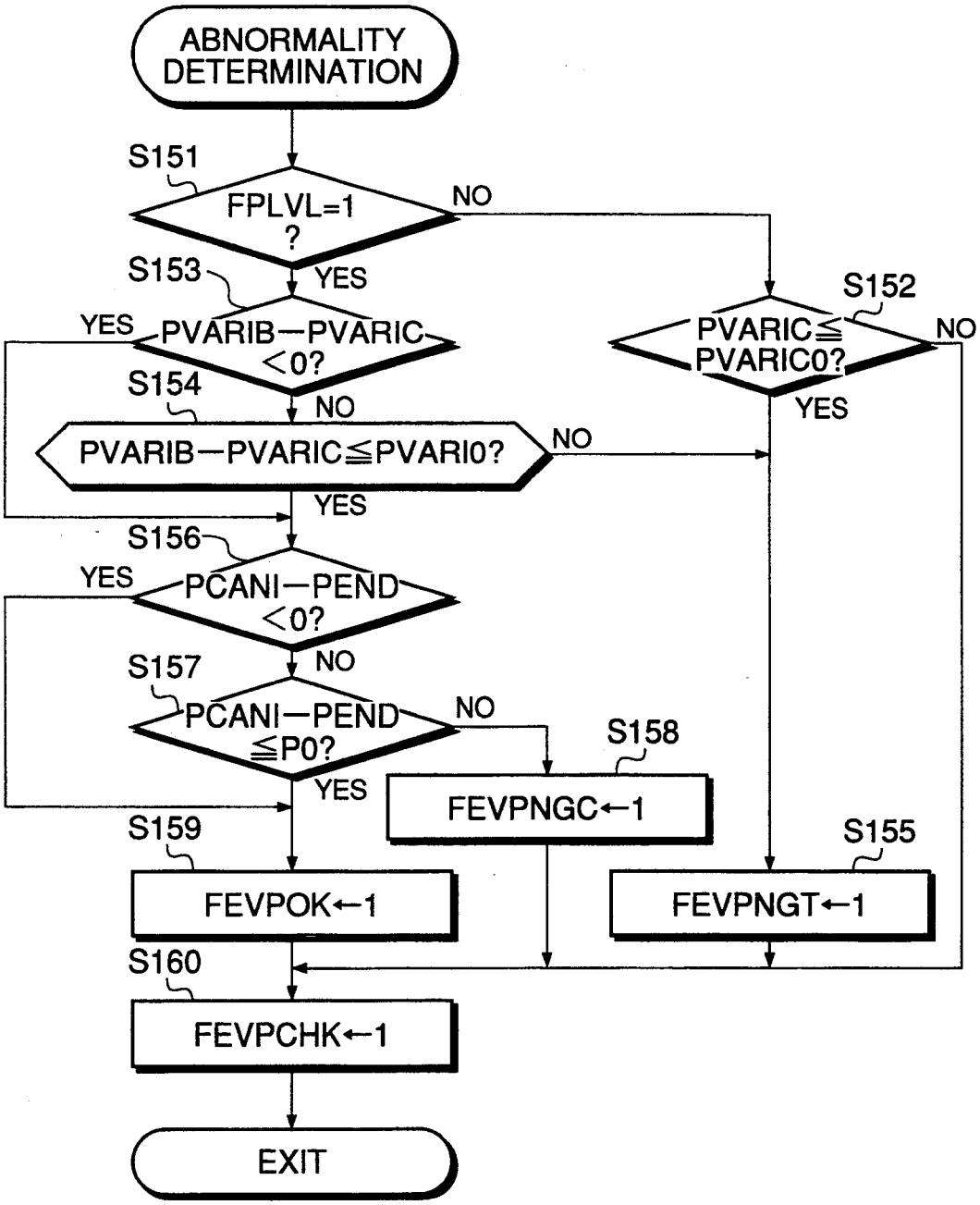
FIG. 19 is a flowchart showing a routine carried out by the system of the first embodiment for carrying out abnormality determination.

This routine is executed by a program shown in FIG. 19.

At a step S151, it is determined whether or not the flag FPLVL has been set to 1, that is, whether or not the negative pressurization has been completed within the predetermined time period tPRG. When FPLVL=0 is satisfied, that is, when negative pressurization has not been completed within the time period tPRG, it is determined at a step S152 whether or not the third rate of change PVARIC is equal to or below a predetermined value PVARIC0. When PVARIC>PVARIC0 is satisfied, the program jumps over to a step S160 without making a judgment on abnormality of the system, wherein a flag FEVPCHK is set to a value of 1 for indicating the termination of the abnormality determination. On the other hand, when PVARIC≦PVARIC0 is satisfied, it means that the tank internal pressure PTNK does not increase even if the bypass valve 24 is closed although the negative pressurization has not been completed within the predetermined time period tPRG. Therefore, it is determined that there is a leak in the fuel tank side part of the emission control system, and a flag FEVPNGT is set to a value of 1 at a step S155 for indicating the leak in this part of the system, and then program jumps over to the step S160.

When the answer to the step S151 is affirmative (YES), that is, when FPLVL=1 is satisfied to indicative that the negative pressurization has been completed within the predetermined time period tPRT, it is determined at a step S153 whether or not the difference ΔPVARI between the second rate of change PVARIB and the third rate of change PVARIC (=PVARIB−PVARIC) is negative. When the value of ΔPVARI is negative, the program immediately jumps over to a step S156, whereas when the value of ΔPVARI is zero or positive, it is determined at a step S154 whether or not the ΔPVARI value is below a predetermined value PVARI0. When ΔPVARI>PVARIO is satisfied, it means that the second rate of change PVARIB is larger than the third rate of change PVARIC by the predetermined value PVARI0 or more, and therefore, it is determined that the tank internal pressure varies as indicated by the broken line in FIG. 2. Then, the program proceeds to the step S155. Since the bypass valve 24 and the puff loss valve 22 are closed during the first leak check (time period F in FIG. 2), it is supposed in the present case that there is a leak in the fuel tank side part of the system.

When the answer to the question at the step S154 is affirmative (YES), that is, when ΔPVARI≦PVARIO is satisfied, the program proceeds to the step S156, wherein it is determined whether or not the difference ΔP2 (=PCANI−PEND) between the tank internal pressure PEND obtained at the start of the second leak check and the tank internal pressure PCANI at the termination thereof assumes a negative value. When the difference ΔP2 is negative, it is determined that the tank internal pressure is normal, and a flag FEVPOK is set to a value of 1 to indicate the normality of the system at a step S159, and then the program jumps over to the step S160.

When the answer to the question at the step S156 is negative (NO), that is, when the difference ΔP2 is 0 or positive, it is determined at a step S157 whether or not the difference ΔP2 is equal to or below a predetermined value P0. When it is equal to or below the predetermined value P0, it is determined that the tank internal pressure is within the normal range, and then the program proceeds to the step S159.

When the answer to the step S157 is negative (NO), that is, when ΔP2>0 is satisfied, it means that this change in the tank internal pressure corresponds to the case indicated by the one-dot chain line in FIG. 2, and accordingly, it is determined that there is a leak in the canister side part of the system, and a flag FEVPNGC is set to a value of 1 to indicate existence of the leak in this part of the system at a step S158. Then, the program proceeds to the step S160. This determination is based upon the following ground: During the first leak check, the bypass valve 24 is closed, so that the pressure in the canister side part of the system should be kept lower than the tank internal pressure detected by the tank internal pressure sensor 11 if there is no leak therein. Accordingly, when the second leak check is carried out by opening the bypass valve 24, the tank internal pressure should lower if the system is normal (as indicated by the solid line in FIG. 2). When the tank internal pressure increases as indicated by the one-dot chain line in FIG. 2, however, it is supposed that the pressure on the canister side of the valve 24 has increased due to a leak. Thus, the above determination at the step S158 is rendered.

As described above, according to the present embodiment, after the negative pressurization, the bypass valve 24 is first closed to make the first leak check, and then the bypass valve 24 is opened to make the second leak check, to thereby make it possible to determine whether there is a leak in the canister side part of the system, or in the fuel tank side part of the system. As a result, in the event of presence of a leak being detected, a part of the system to be repaired can be promptly found enabling prompt repairing.

Further, during the execution of the first leak check, the presence/absence of a leak is determined based upon variation of the pressure within the part of the system between the fuel tank 9 and the bypass valve 24 exclusive of the canister 25, and therefore, variation of the pressure can be accurately detected, thereby enabling further accurate determination.

Still further, when it is determined at the step S44 in FIG. 5 the tank internal pressure PTNK is lower than the predetermined pressure PLIM (e.g. −20 mmHg), the abnormality determination is terminated, and therefore, the pressure within the canister 25 and that within the fuel tank 9 can be prevented from being negatively pressurized to an excessive degree, to thereby improve the reliability of the system.

Furthermore, at the steps S51 to S54 in FIG. 6, the abnormality determination is inhibited when the amount of evaporative fuel within the fuel emission control system is large, and it is carried out only when the amount is small. Therefore, the accuracy of the abnormality determination can be ensured and variation of the air fuel ratio due to purging can be prevented.

When the tank internal pressure PTNK is lower than the predetermined pressure PLIM, not only the abnormality determination is terminated, but also the drain shut valve 26 may be opened. Thus, the tank internal pressure PTNK can be promptly restored to a normal value.

When a leak has been detected in the fuel tank side part of the system (when FEVPNGT=1 is satisfied), it is desirable to keep the bypass valve 24 open.

When a leak has been detected in the canister side part of the system (when FEVPNGT=0 and FEVPNGC=1 are satisfied), it is desirable to keep the bypass valve 24 closed. This can make the release of evaporative fuel to the atmosphere the minimum in the event of occurrence of leakage of evaporative fuel.

Further, in place of the tank internal pressure sensor 11, there may be provided a canister internal pressure sensor 11' for detecting the pressure within the canister 25, to execute abnormality determination (corresponding to the first leak check) based upon the output from the canister internal pressure sensor in the same manner as described above. For example, a check for a leak in the canister 25 may be performed by closing the drain shut valve 26 and opening the purge control valve 30 to thereby negatively pressurize the system until the canister interval pressure detected by the canister internal pressure sensor 11' reaches a predetermined negative valve, then closing the purge control valve 30, the jet purge control valve 29 and the bypass valve 24, measuring an amount of variation in the canister internal pressure, and determining whether or not the system or particularly the canister is normal, based on the measured amount of variation in the canister internal pressure. By such alternative means, the distance between the intake pipe 2 which is a negative pressure source and the pressure sensor can be shorter, and further the volumetric amount of the gas to be monitored can be smaller, whereby the abnormality determination can be carried out more promptly and accurately.

Figure 20:
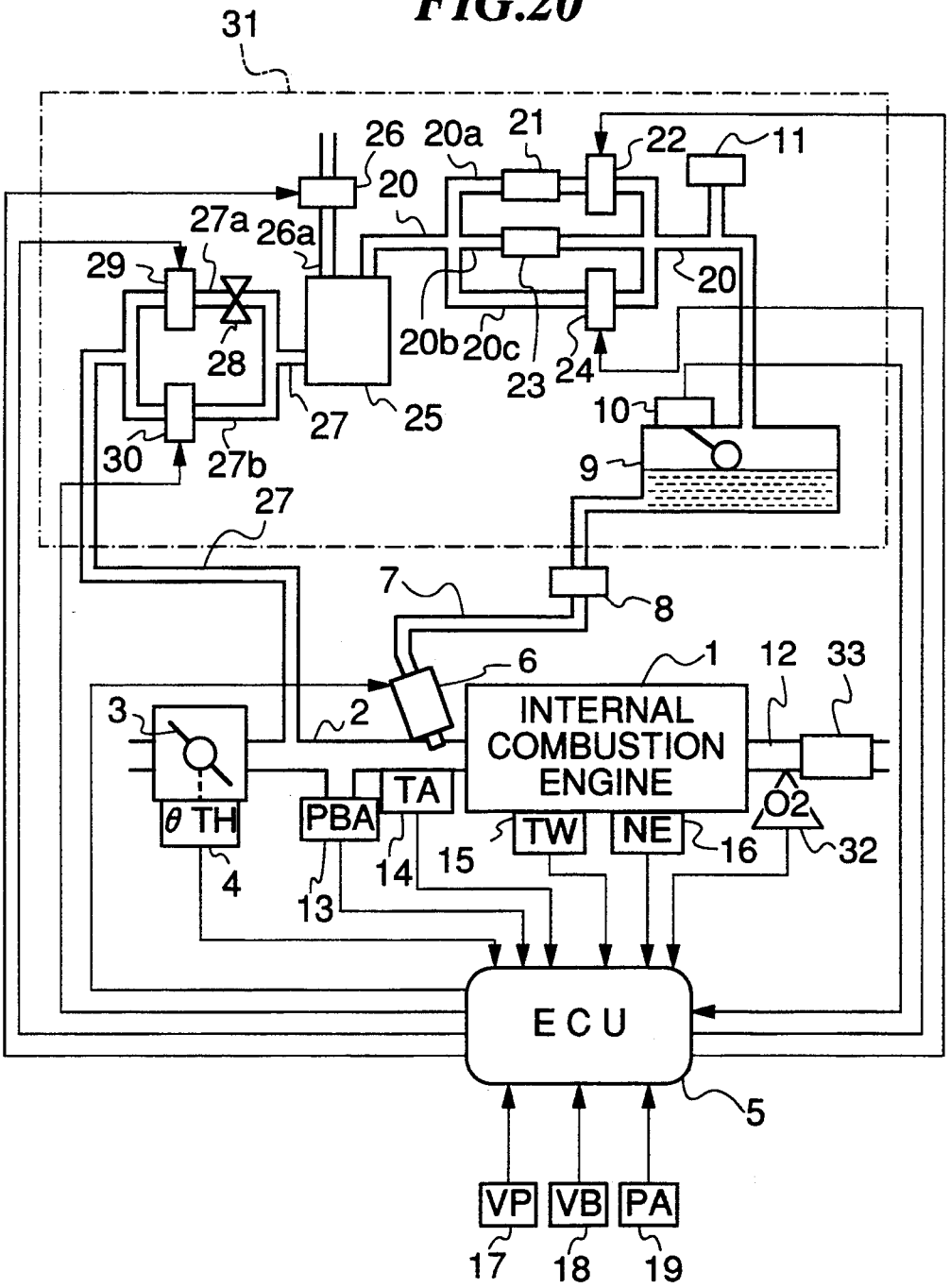
FIG. 20 is a block diagram showing the whole arrangement of an evaporative fuel-processing system according to a second embodiment of the invention.

FIG. 20 shows the whole arrangement of an evaporative fuel-processing system according to a second embodiment of the invention.

Although in the first embodiment described above, the tank internal pressure sensor 11 is arranged within the fuel tank 9, the tank internal pressure sensor 11 of the present embodiment is arranged in a portion of the charging passage 20 at a location within an engine room, the portion connecting between the branches 20*a* to 20*c* within the engine room and the fuel tank 9 outside the engine room. That is, the tank internal pressure sensor 11 is arranged in the portion of the charging passage close to the branches 20*a* to 20*b* but remote from the fuel tank 9. The other component parts and elements of the system are identical to those of the first embodiment. In addition, in the present embodiment, tank internal pressure (or system internal pressure), i.e. an output from the tank internal pressure sensor 11, is designated by a symbol PTANK to distinguish it from that from the sensor used in the first embodiment.

Further, the ECU 5 stores in its memory means a PTANK monitoring program described below with reference to FIG. 21 to FIG. 23, a fuel tank side negative pressure check program described below with reference to FIG. 21 to FIG. 23, and a canister side negative pressure check program described below with reference to FIG. 28 to FIG. 34. In the present embodiment, abnormality check is separately made on the fuel tank side part of the system and the canister side part of same according to these programs.

Figure 21:
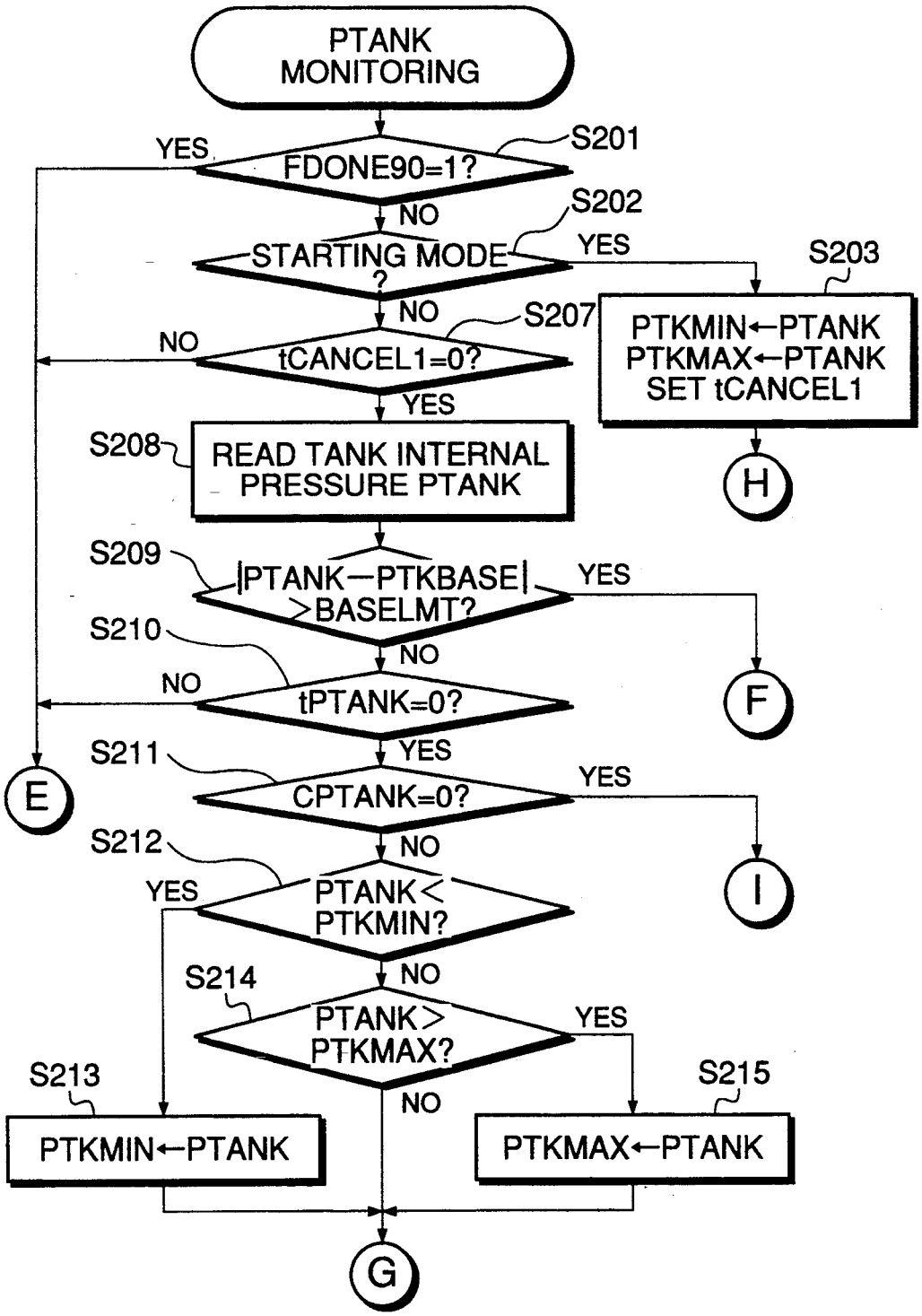
FIG. 21 is a flowchart showing part of a routine carried out by the second embodiment system for monitoring a pressure sensor output PTANK.
Figure 22:
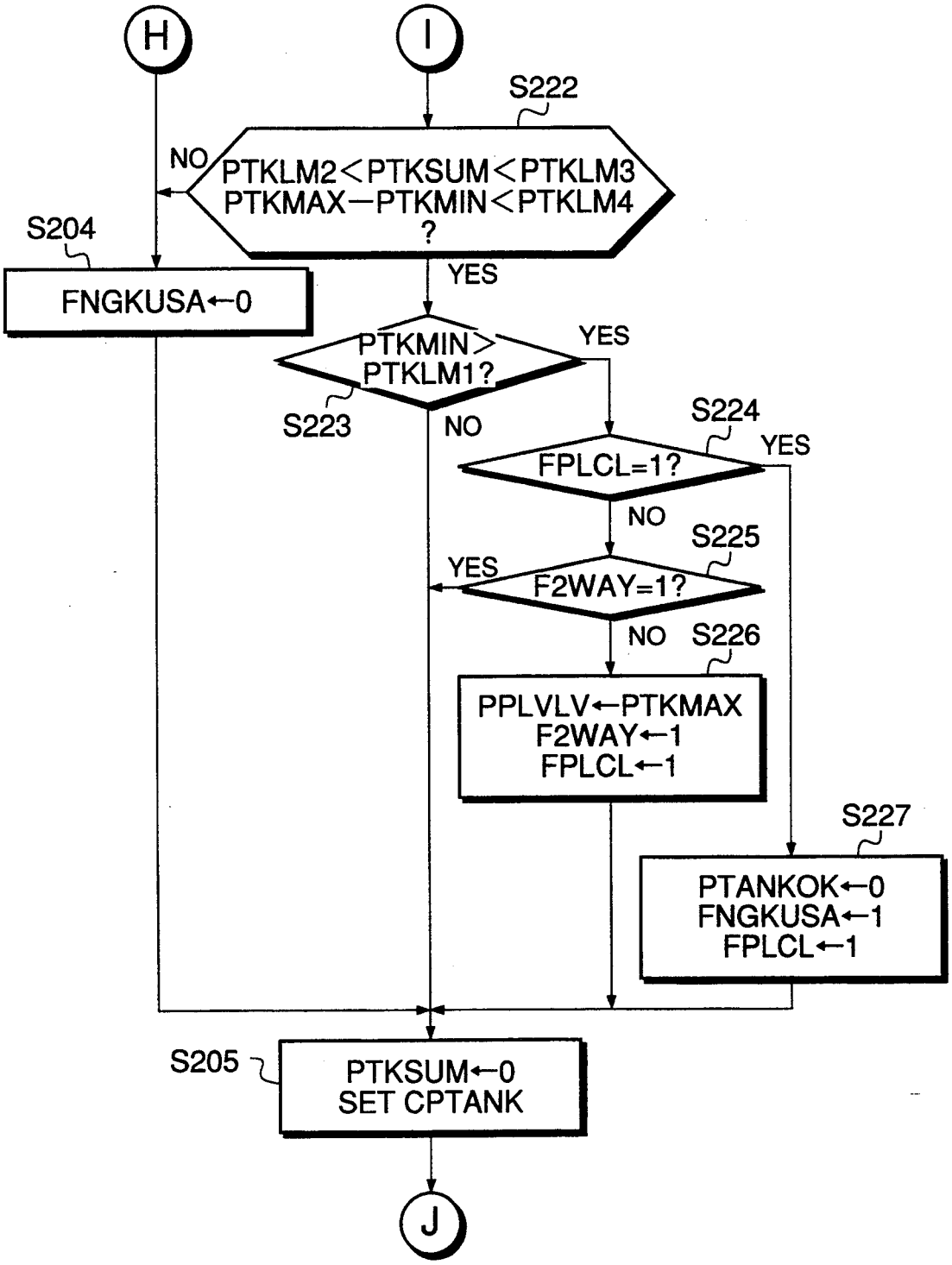
FIG. 22 is a flowchart showing a continuation of the FIG. 21 routine.
Figure 23:
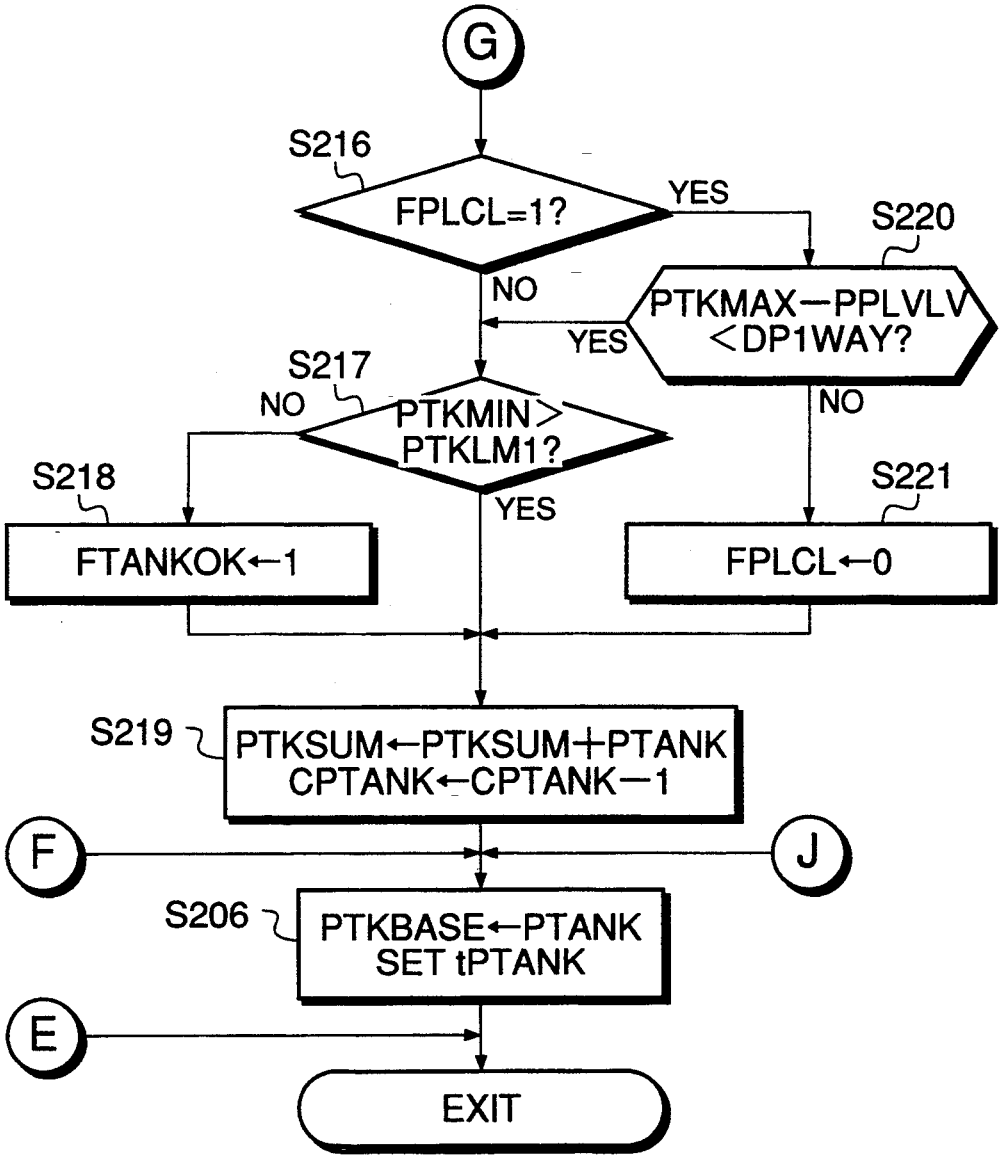
FIG. 23 is a flowchart showing the remaining part of the FIG. 21 and FIG. 22 routine.

FIG. 21 to FIG. 23 shows the PTANK monitoring program for monitoring the tank internal pressure PTANK to check for abnormality of the emission control system 31. This program is executed whenever a predetermined time period (e.g. 80 msec.) elapses.

First, at a step S201, it is determined whether or not a flag FDONE 90 which is set to a value of 1 when the negative pressure checks for the fuel tank side part of the system and the canister side part of same have been terminated. When this step is first carried out, the answer to this question is negative (NO), and it is determined at a step S202 whether or not the engine 1 is in the starting mode. If the answer to this question is affirmative (YES), i.e. if the engine is in the starting mode, the present value of the tank internal pressure PTANK is set to a minimum value PTKMIN and a maximum value PTKMAX thereof and at the same time a tCANCEL1 timer for pressure cancellation is set to a predetermined time period tCANCEL1 at a step S203.

Then, a flag FNGKUSA, which is set to a value of 1 when there is a high possibility of presence of a leak in the fuel tank side part of the system, is set to a value of 0 at a step S204, and a summed-up value PTKSUM of PTANK values, described hereinbelow, is set to a value of 0, while a counter CPTANK for counting the number of executions of the PTANK monitoring (the number of samplings) is set to a predetermine value (e.g. 255). Then, the tank-internal pressure PTANK assumed at this time point is set to a reference value PTKBASE for use in calculating variation in the tank internal pressure PTANK, and a tPTANK timer determining an interval for sampling the tank internal pressure PTANK is set to a predetermined time period tPTANK (e.g. 5 seconds), at a step S206, followed by terminating the program.

If the answer to the question of the step S202 is negative (NO), which means the engine has entered a normal mode, the program proceeds to a step S207, wherein it is determined whether the count value of the tCANCEL1 timer is equal to "0", which means that the predetermined time period tCANCEL1 has elapsed. If the answer to this question is negative (NO), the present routine is immediately terminated, whereas if it is affirmative (YES), the present value of the tank internal pressure PTANK is read in at a step S208. At the following step S209, it is determined whether or not the absolute value of a difference between the reference value PTKBASE and the present value of the tank internal pressure PTANK is larger than a predetermined threshold value BASELMT. If the answer to this question is affirmative (YES), it is determined that variation of the tank internal pressure PTANK is large, and hence the processing at the step S206 is executed again in order to read in only a stabilized value of the tank internal pressure PTANK. That is, the reference value PTKBASE is reset to the present value of the tank internal pressure PTANK and the tPTANK timer to the predetermine value tPTANK.

Further, if the answer to the question of the step S209 is negative (NO), it is judged that the variation in the tank internal pressure PTANK is not so large and suitable for execution of the PTANK monitoring, and it is determined at a step S210 whether or not the count value of the tPTANK timer is equal to "0". If the answer to this question is negative (NO), the present routine is immediately terminated, whereas if the answer is affirmative (YES), the program proceeds to a step S211.

Thus, a value of the tank internal pressure PTANK assumed when the output from the tank internal pressure sensor 11 is not largely changed is read in at intervals of the predetermined time period tPTANK.

At the step S211, it is determined whether or not the count value of the counter CPTANK is equal to "0". When this step is first carried out, the answer to this question is negative (NO), and the program proceeds to a step S212, wherein it is determined whether or not the present value of the tank internal pressure PTANK read in the present loop is smaller than the minimum value PTKMIN. If the answer to this question is affirmative (YES), the present value of the tank internal pressure PTANK is set to the minimum value PTMIN at a step S213. On the other hand, if the answer to the question of the step S212 is negative (NO), it is determined at a step S214 whether or not the present value of the tank internal pressure PTANK read in this loop is larger than the maximum value PTKMAX. If the answer to this question is affirmative (YES), the present value of the tank internal pressure PTANK is set to the maximum value PTKMAX at a step S215.

At the following step S216, it is determined whether or not a flag FPLCL, which is set to a value of 1 when the puff loss valve 22 is closed during execution of the PTANK monitoring, is equal to "1". When this step is first carried out, the answer to this question is negative (NO), i.e. the puff loss valve 22 is open (one-way control), and the program proceeds to a step s217, wherein it is determined whether or not the minimum value PTKMIN is larger than a predetermined value PTKLM1 (e.g. −5 mmHg). If the answer to this question is negative (NO), it is judged that there is no leak in the fuel tank 9 but it is in a normal state, and a flag FTANKOK is set to a value of "1" at a step S218, followed by the program proceeding to a step S219.

The judgment that there is no leak in the fuel tank side of the system when the minimum value PTKMIN of the tank internal pressure PTANK is smaller than a predetermined value PTKLM1 (e.g. −5 mmHg) is based on the experimental finding that if the pressure within the fuel tank side part of the system is controlled by the one-way valve 21 and the two-way valve 23 when there is no leak in the fuel tank side part of the system, evaporative fuel within the fuel tank is cooled and liquefied to negatively pressurize the fuel tank side part, whereas when there is a leak, the pressure within the fuel tank side part cannot become lower than the atmospheric pressure. In short, it can be judged that there is no leak in the fuel tank side part of the system when the minimum value PTKMIN of the tank internal pressure PTANK becomes lower than the predetermined value PTKLM1 which is lower than the atmospheric pressure, i.e. negative.

On the other hand, if the answer to the question of the step S217 is affirmative (YES), the program jumps over to a step S219 by skipping the step S218. At the step S219, the present value of the tank internal pressure PTANK is added to the sum of values of same sampled up to the present loop to update the summed-up value PTKSUM, while the count value of the counter CPTANK is decreased by a decremental value of 1. Then, the step S206 is carried out again, followed by terminating the routine.

When the processing described above is repeated carried out 255 times, the count value of the counter CPTANK becomes equal to "0", and accordingly the answer to the question of the step S211 becomes affirmative (YES). At this time point, the total number of values of the tank internal pressure sampled one by one at intervals of the predetermined time period tPTANK set by the tPTANK timer is 255.

At the following step S222, it is determined whether or not the summed-up value PTKSUM falls between a predetermined negative value PTKLM2 (e.g. −5 mmHg) and a predetermined positive value PTKLM3 (e.g. 5 mmHg) and at the same time the difference between the maximum value PTKMAX and the minimum value PTKMIN is smaller than a predetermined value PTKLM4 (e.g. 3 mmHg). If the answer to this question is negative (NO), it is judged that the tank internal pressure is changing, and the program proceeds to the step S204, wherein the flag FNGKUSA is set to a value of 0, followed by repeatedly carrying out the step S205 et seq.

On the other hand, if the answer to the question of the step S222 is affirmative (YES), it is judged that the tank internal pressure PTANK is fixed to the atmospheric pressure or its vicinity, and it is determined at a step S223 whether or not the minimum value PTKMIN is larger than the predetermined value PTKLM1. If the answer to this question is negative (NO), it is judged that the fuel tank side part of the system was in a negatively-pressurized state at least once during sampling, and the step S205 et seq. are carried out again. If the answer to the question of the step S223 is affirmative (YES), it is judged that the tank internal pressure PTANK has not been negative even once but fixed to the atmospheric pressure or its vicinity, and the program proceeds to a step S224 et seq.

The fact that the tank internal pressure PTANK has not been negative but fixed to the atmospheric pressure or its vicinity can be ascribed to four cases of the state of the system in which: (1) there is a large leak, (2) there is a small leak and at the same time evaporative fuel is generated at a small rate, (3) there is no leak and at the same time evaporative fuel is generated at a small rate, and (4) evaporative fuel is generated at a large rate and the tank internal pressure PTANK is controlled to the valve-opening pressure (5 mmHg) of the one-way valve 21.

As shown in (4) of the above cases, the tank internal pressure PTANK can be fixed to the atmospheric pressure or its vicinity when it is controlled to the valve-opening pressure of the one-way valve 21. This is because there is an output variation (zero-point variation) within a range of approximately ±5 mmHg inherent to an individual tank internal pressure sensor 11, and hence if the output from the tank internal pressure sensor 11 is lower than its proper value by 5 mmHg, the tank internal pressure PTANK can fixedly exhibit the atmospheric pressure (0 mmHg) even when the tank internal pressure PTANK is actually controlled to the valve-opening pressure (5 mmHg) of the one-way valve 21. Therefore, if the output from the tank internal pressure 11 is within a range of −5 mmHg to +5 mmHg, the tank internal pressure PTANK should be regarded as substantially equal to the atmospheric pressure.

(1) to (3) of the above cases correspond to a state of the fuel tank in which its internal pressure is actually equal to the atmospheric pressure or its vicinity, and hence there is a large possibility of leakage of evaporative fuel. In the case (4), however, it is presumed that evaporative fuel is generated to create the internal pressure up to the valve-opening pressure of the one-way valve 21, and hence there is a small possibility of leakage. Therefore, in the present embodiment, whether or not holding of the tank internal pressure PTANK at the atmospheric pressure or its vicinity can be ascribed to the case (4) is determined at the following step S224 et seq, whereby the case (4) is distinguished from the cases (1) to (3).

At the step S224, it is determined whether or not the flag FPLC1 is equal to "1". When this step is first carried out, the puff loss valve 22 is open (during one-way control), and hence the answer to this question is negative (NO), so that the program proceeds to a step S225, wherein it is determined whether or not a flag F2WAY, which is set to a value of 1 when two-way control by the two-way control valve 23 is executed, is equal to 1. When the one-way control is being executed, the flag F2WAY is equal to "0", and the program proceeds to a step S226, wherein reference pressure PPLVLV for determining whether or not the holding of the tank internal pressure should be ascribed to operation of the one-way valve 21 is set to the maximum value PTKMAX, the flag F2WAY is set to "1", and the flag FPLCL is set to "1" to close the puff loss valve 22, setting the system to the two-way control mode.

Thereafter, the step S205 et seq. are carried out again to check variation in the tank internal pressure PTANK. That is, one value thereof is read in at intervals of the predetermined time period tPTANK set by the tPTANK timer. On this occasion, the answer to the question of the step S216 becomes affirmative (YES), and accordingly it is determined at a step S220 whether or not a difference between the maximum value PTKMAX and the reference pressure PPLVLV for determining the fixed state of the one-way valve 21 obtained by subtracting the latter from the former is smaller than a predetermined value DP1WAY. If the answer to this question is affirmative (YES), it is judged that no increase in the tank internal pressure PTANK occurs during the two-way control, and the program proceeds to a step S217 et seq.

If the answer to the question of the step S220 is negative (NO), it is judged that the tank internal pressure PTANK has increased during the two-way control, and the program proceeds to a step S221, where the flag FPLCL is set to "0" to set the system to the one-way control mode, followed by the program proceeding to the step S219 et seq. When the number of values of the tank internal pressure PTANK read in becomes equal to 255, the count value of the counter CPTANK becomes equal to "0" and the answer to the question of the step S211 becomes affirmative (YES) again.

Then, if the tank internal pressure PTANK has increased in the meanwhile, the maximum value PTKMAX changes accordingly, and hence the answer to the question of the step S222 becomes negative (NO), and the flag FNGKUSA is set to "0" at the step S204. That is, under the two-way control in which the puff loss valve is open, if the tank internal pressure PTANK is controlled to the valve-opening pressure (5 mmHg) of the one-way valve 21 while evaporative fuel is generated at a large rate without leakage ((4) of the above cases), it is expected that the tank internal pressure PTANK should rise as time elapses. Therefore, in the event of the case (4), it is considered that there is a high possibility that the fuel tank 9 is normal, and hence the flag FNGKUSA is set to "0", followed by repeating the step S205 et seq.

On the other hand, results of check on variation of the tank internal pressure PTANK show that the tank internal pressure PTANK remains fixed to the atmospheric pressure or its vicinity, the answers to the questions of the steps S222 and S223 are affirmative (YES). Accordingly, the system is set to the two-way control mode at the step S226, and hence the answer to the question of the step S224 becomes affirmative (YES), and the program proceeds to a step S227, wherein judging that the present state of the tank internal pressure PTANK can be ascribed to one of the cases: (1) there is a large leak, (2) there is a small leak and at the same evaporative fuel is generated at a small rate, and (3) there is no leak and at the same time evaporative fuel is generated at a small rate, the flag PTANKOK is set to "0" and the flag NGKUSA is set to "1" as well as the flag FPLCL is set to "0", to actually make the negative pressure check on the fuel tank side part of the system, described hereinbelow. Thereafter, the steps S205 and S206 are carried out, followed by terminating the program.

Next, the method of the negative pressure diagnosis for the fuel tank side will be described in detail.

Figure 24:
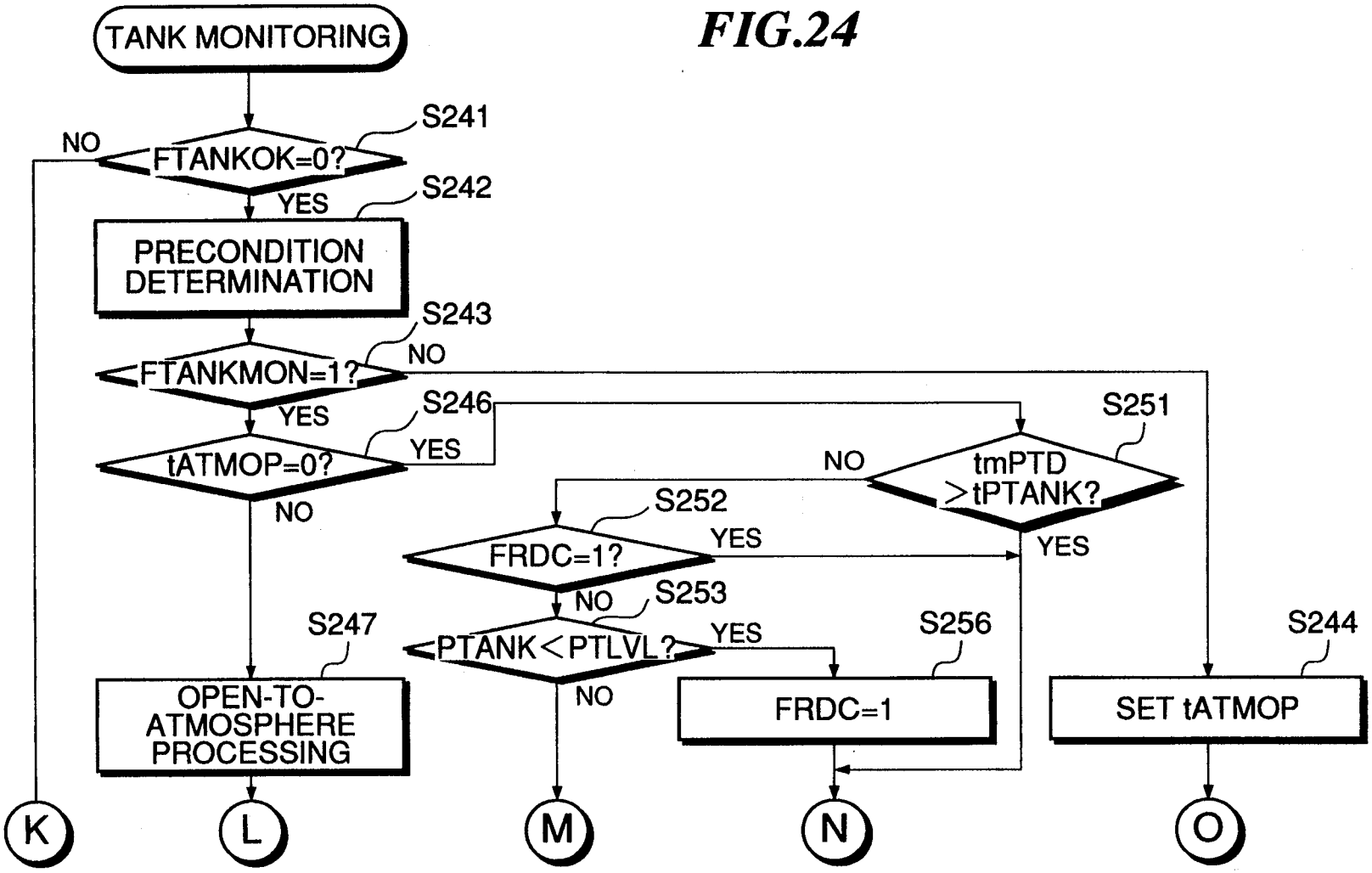
FIG. 24 is a flowchart showing part of a program carried out by the second embodiment system for making a negative pressure check on part of the system on a fuel tank side (tank monitoring)
Figure 25:
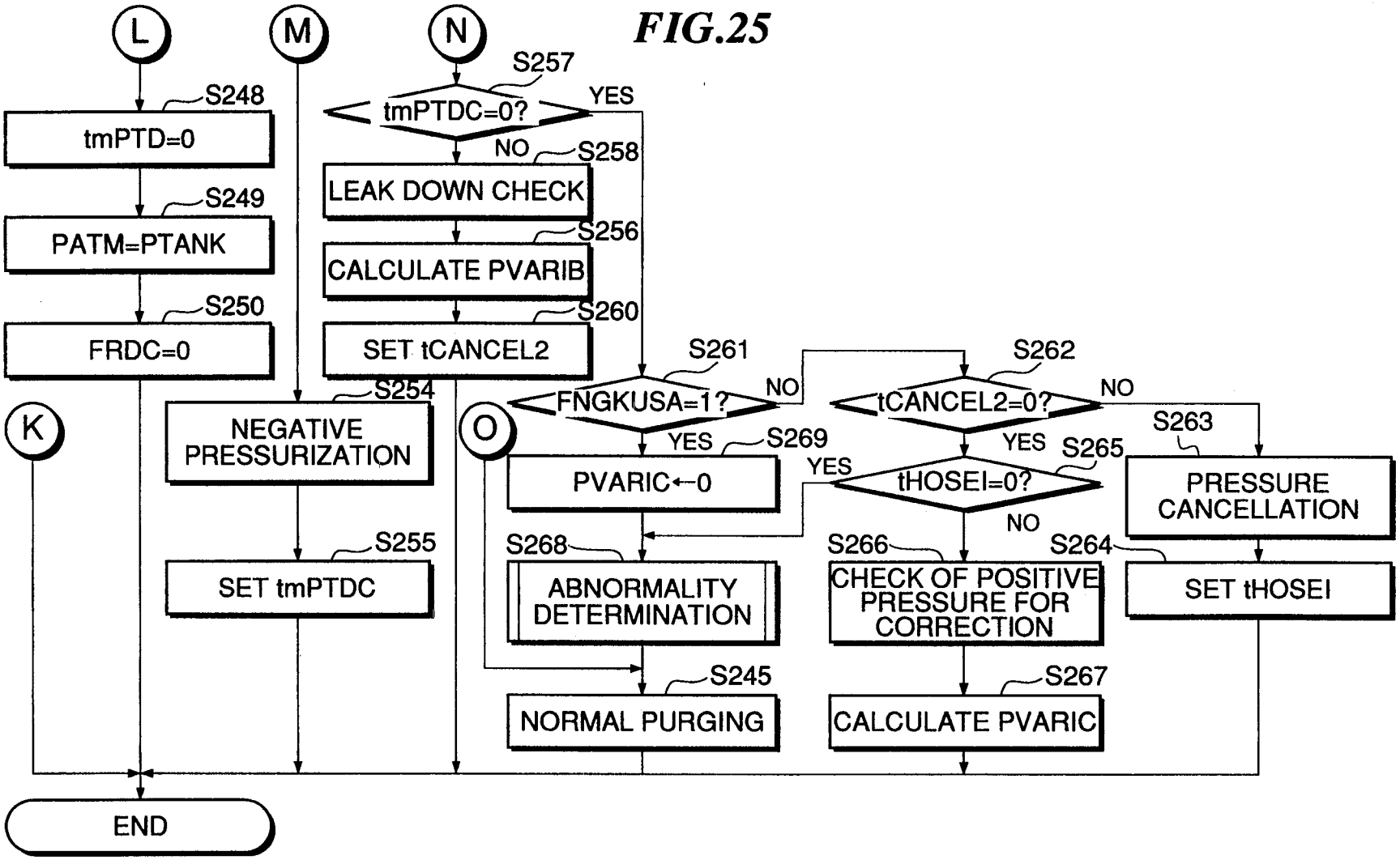
FIG. 25 is a flowchart showing the remaining part of the FIG. 24 program.

FIG. 24 and FIG. 25 shows a program for making the negative pressure check on the fuel tank side part of the system (tank-monitoring), which is executed by background processing whenever a predetermined time period (e.g. 80 msec.) elapses.

First, at a step S241, it is determined whether or not the flag FTANKOK, which is set in the PTANK-monitoring program described above, is equal to "0". If the answer to this question is negative (NO), the present program is immediately terminated, whereas if the answer is affirmative (YES), the program proceeds to a step S242. At the step S242, where the precondition determination for permitting the tank-monitoring is performed to determine whether the engine has been warmed up and is operating in a stable condition, from the engine coolant temperature TW, the intake temperature TA, the engine rotational speed NE, etc., setting a flag FTANKMON to "1" when the precondition is satisfied or setting same to "0" when it is not satisfied.

At the following step S243, it is determined whether or not the flag FTANKMON has been set to "1" by the precondition determination at the step S242. When the engine has just been started, the precondition is not satisfied and hence the answer to the question of the step S243 is negative (NO), and the program proceeds to a step S244, wherein the tATMOP timer is set to a predetermined time period tATMOP. The predetermined time period tATMOP in this embodiment is set e.g. to 30 seconds which is required to elapse before the tank internal pressure PTANK is stabilized after the system is made open to the atmosphere to relieve the tank internal pressure to the atmospheric pressure, and the tATMOP timer is started. Then, the program proceeds to a step S245, where the emission control system is set to the normal purging mode, followed by terminating the program. In other words, the purge control valve 30, the puff loss valve 22, the drain shut valve 26, and the jet purge valve 29 are opened while the bypass valve 24 is closed.

On the other hand, if the precondition is satisfied in the following loops, the flag FTANKMON is set to "1", and it is determined at a step S246 whether or not the count value of the tATMOP timer becomes equal to 0, i.e. whether or not the predetermined time period tATMOP has elapsed. When this step is first carried out, the answer to this question is negative (NO), and the program proceeds to a step S247, where the emission control system 31 is set to the open-to-atmosphere mode in which the bypass valve 24 is opened, and the purge control valve 30 is closed, with the puff loss valve 22, the drain shut valve 26 and the jet purge valve 29 being held to the respective open states.

Then, a tmPTD timer (upcounter) is set to "0" at a step S248. The tmPTD timer measures a time period required to elapse before negative pressurization of the system is completed, with an initially set value of tmPTD=0. The value PATM of the tank internal pressure PTANK in the open-to-atmosphere mode is set to the present value of the tank internal pressure PTANK at a step S249, and a flat FRDC, which is set to "1" when the negative pressurization of the system is completed, is set to "0" at a step S250, followed by terminating the program. That is, the value PATM of the tank internal pressure assumed when the system is open to the atmosphere is updated to the present value, and the flag FRDC is reset, followed by terminating the program.

Then, when the answer to the question of the step S246 is affirmative (YES) after the lapse of the predetermined time period tATMOP set by the tATMOP timer, it is determined at a step S251 whether the count value of the tmPTD timer is larger than the predetermined time period PTANK. When this step is first carried out, the answer to this question is negative (NO), and hence the program proceeds to a step S252, wherein it is determined whether or not the flag FRDC is equal to "1". When this step is first carried out, the answer to the question is negative (NO), and hence it is determined at a step S253 whether or not the tank internal pressure PTANK is not higher than a predetermined reference value PTLVL. When this step is first carried, the answer to the question is also negative (NO), and hence the negative pressurization is carried out at a step S254. That is, the puff loss valve 22 and the drain shut valve 26 are closed, and the purge control valve 30 is closed, with the jet purge valve 29 and the bypass valve 24 being kept open to negatively pressurize the emission control system 31.

Then, the program proceeds to a step S255, wherein a tmPTDC timer for the leak down check is set to a predetermined time period tmPTDC, followed by terminating the program. The predetermined time period tmPTDC is set e.g. to 5 seconds, which is required to elapse before the leak down check is finished.

If the negative pressurization is completed and the answer to the question of the step S253 becomes affirmative (YES) in the following loops, the flag FRDC is set to "1" at a step S256, and then it is determined at a step S257 whether or not the count value of the tmPTDC timer is equal to "0", i.e. whether or not the predetermined time period tmPTDC set for the leak down check has elapsed. When the answer to the question of the step S251 is affirmative (YES) as well, the program proceeds to the step S257. If the flag FRDC remains equal to "0" on this occasion, it means that the system can not be negatively pressurized to the set level with the predetermined time period tmPTD.

When the step S257 is first carried out, the answer to the question of this step is negative (NO), the program proceeds to a step S258, where the emission control system 31 is set to the leak down check mode. That is, the bypass valve 24, the jet purge valve 29 and the purge control valve 30 are closed, with the puff loss valve 22 and the drain shut valve being kept closed, to measure the tank internal pressure PTANK, storing a measured value of the tank internal pressure PTANK as a value PEND.

Then, based on the value PEND thus measured, the rate of change PVARIB in the tank internal pressure PTANK per unit time during the leak down check is calculated according to the following equation:

$$PVARIB=(PEND-PTLVL)/tmPTDC$$

Further, at a step S260, a tCANCEL2 timer is set to a predetermined time period tCANCEL2 required to elapse before the pressure cancellation is completed, followed by terminating the program.

On the other hand, when the answer to the question of the step S257 becomes affirmative (YES), the program proceeds to a step S261, wherein it is determined whether or not the flag FNGKUSA set in the PTANK monitoring described above is equal to "1". If the answer to this question is negative (NO), the program proceeds to a step S262, wherein it is determined whether or not the count value of the tCANCEL2 timer is equal to "0". When this step is first carried out, the answer to this question is negative (NO), the program proceeds to a step S263, wherein the pressure cancellation processing is carried out. That is, the puff loss valve 22 and the purge control valve 30 are kept closed, and the bypass valve 24, the drain shut valve 26 and the jet purge valve 29 are opened to relieve the pressure within the system to the atmospheric pressure, storing a value of the tank internal pressure PTANK obtained at this time as the value PTAM. Then, a tHOSEI timer is set to a predetermined time period tHOSEI required for completing the check for positive pressure for correction at a step S264, followed by terminating the program.

When the answer to the question of the step S262 becomes affirmative (YES), the program proceeds to a step S265, wherein it is determined whether or not the count value of the tHOSEI timer is equal to "0". When this step is first carried out, the answer to this question is negative (NO), and the program proceeds to a step S266, wherein the check for positive pressure for correction is made, followed by terminating the program. During the check for positive pressure for correction, the bypass valve 24 is closed, with the puff loss valve 22 and the purge control valve 30 being kept closed, and the drain shut valve 26 and the jet purge valve 29 being kept open, storing a value of the tank internal pressure PTANK obtained then as a value PENDB. Then, based on the value PEND thus obtained, a rate of change PVARIC in the tank internal pressure PTANK per unit time during the check for positive pressure for correction is calculated at a step S267 according to the following equation:

$$PVARIBC=(PENDB-PATM)/tmHOSEI$$

When the answer to the question of the step S265 becomes affirmative (YES), the program proceeds to a step S268, wherein the negative pressure check is made on the fuel tank side part of system.

Further, when the answer to the question of the step S261 is affirmative (YES), i.e. if the flag FNGKUSA is equal to "1", the pressure cancellation and the check for positive pressure for correction are omitted, and the rate of change PVARIC is set to "0" at a step S269, followed by making the negative pressure check on the fuel tank side part of the system at the step S268. That is, if the flag FNGKUSA is equal to "1", the tank internal pressure PTANK is fixed to the atmospheric pressure or its vicinity, and hence it is not required to perform the check for positive pressure for correction, so that the pressure cancellation and the check for positive pressure for correction are omitted. Thereafter, the puff loss valve 22 and the purge control valve 30 are opened, with the bypass valve 24 being kept closed and the drain shut valve 26 and the jet purge control valve 29 being kept open, following by setting the system to the normal purging mode at a step S245.

Figure 26:
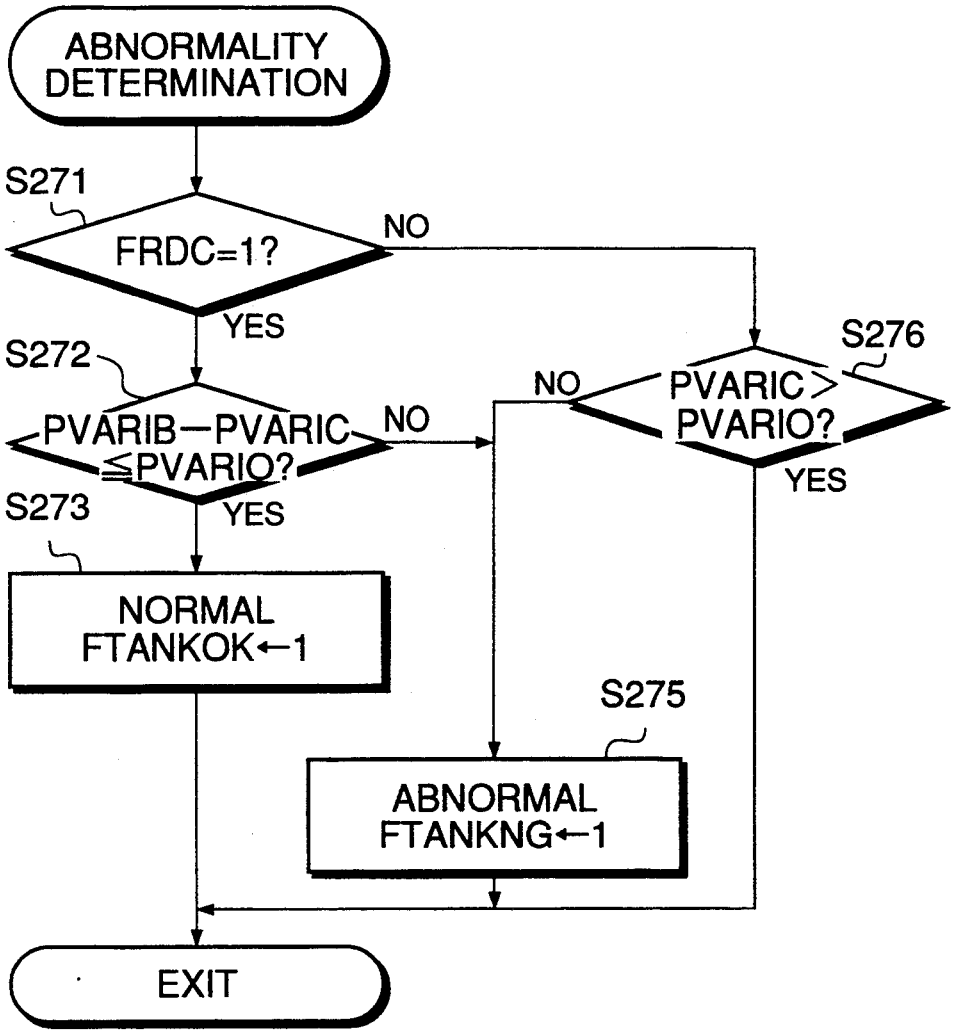
FIG. 26 is a flowchart showing a subroutine of the tank monitoring carried out by the second embodiment system for determining abnormality of the part of the system on the fuel tank side.

FIG. 26 shows a subroutine for determining abnormality of the fuel tank side part of the system executed at the step S268 in FIG. 25.

First, at a step S271, it is determined whether or not the flag FRDC which is set to "1" (at the step S256 in FIG. 24) when the negative pressurization has been completed within the predetermined time period tPTANK is equal to "1". If the answer to this question is affirmative (YES), the program proceeds to a step S272, wherein it is determined whether or not the difference between PVARIB and PVARIC obtained by subtracting the latter from the former is not larger than a predetermine value PVARIO. If the answer to this question is affirmative (YES), it is determined that the fuel tank side part of the system is normal, i.e. there is no leak and the flag FTANKOK is set to "1" at a step S273, followed by terminating the program, whereas if the answer is negative (NO), it is judged that there is a leak in the fuel tank side part of the system, and hence the flag FTANKNG is set to "1 " at a step S275, followed by terminating the program.

On the other hand, if the answer to the question of the step S271 is negative (NO), i.e if the flag FRDC is "0", it is determined at a step S276 whether or not the rate of change PVARIC is larger than the predetermined value PVARIO. If the answer to this question is negative (NO), the program process to the step S275, whereas if the answer is affirmative (YES), the program is immediately terminated.

Next, the method of the negative pressure check on the canister side part of the system will be described in detail.

Figure 27:
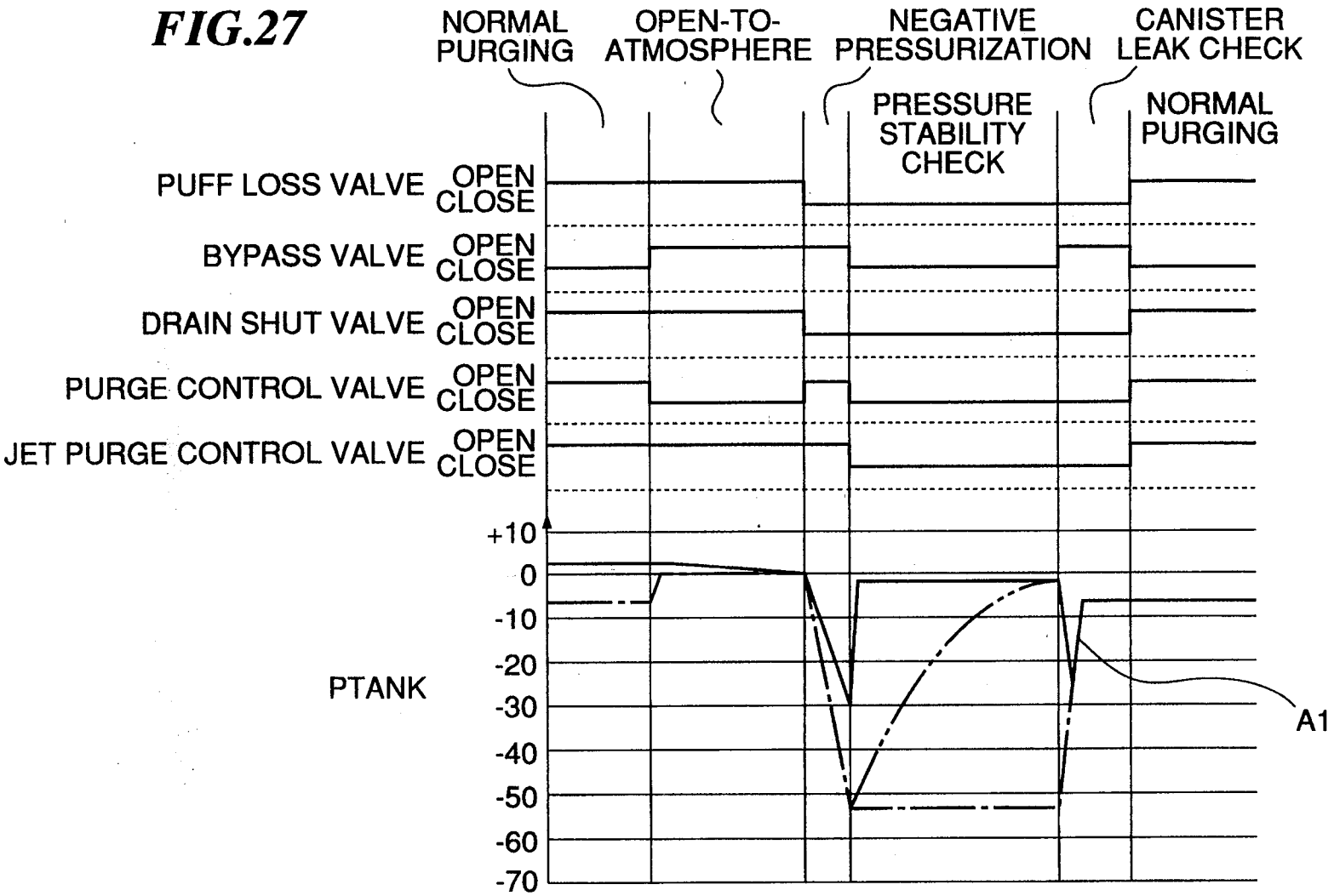
FIG. 27 is a timing chart showing operating states of valves arranged in the evaporative fuel-processing system and changes in the fuel tank internal pressure PTANK.
Figure 28:
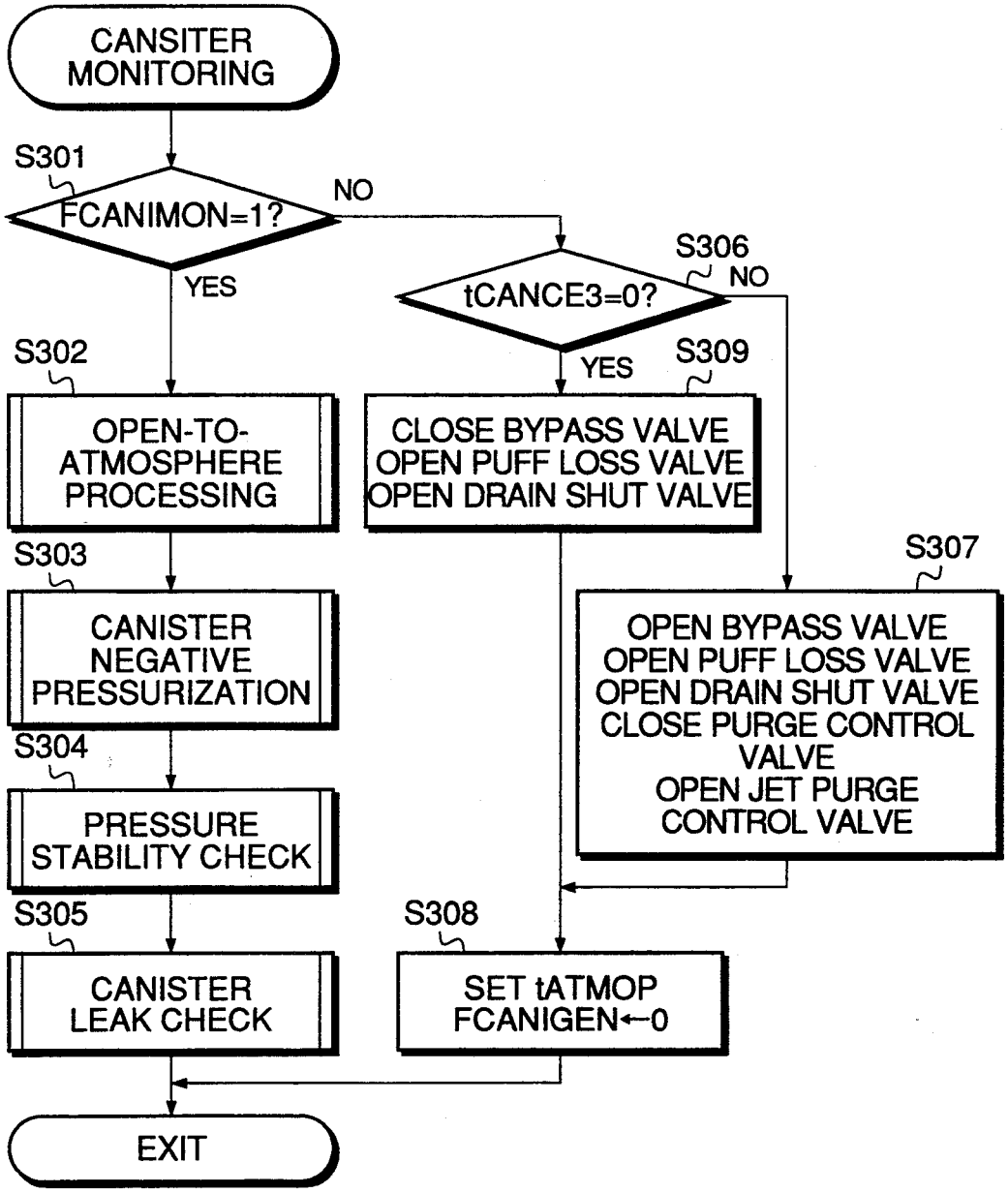
FIG. 28 is a flowchart showing a routine carried out by the second embodiment system for making a negative pressure check on part of the system on a canister side (canister monitoring)

FIG. 27 shows a timing chart showing the operating states of the puff loss valve 22, the bypass valve 24, the drain shut valve 26, the purge control valve 30 and the jet purge control valve 29, and changes in the tank internal pressure (indicated by the solid line) and the canister internal pressure (indicated by the one-dot chain line and two-dot chain line). FIG. 28 shows a program (main routine) for the negative pressure check on the canister side part of the system (canister monitoring). This program is executed by the ECU 5 whenever a predetermined time period (e.g. 80 msec.) elapses.

Figure 29:
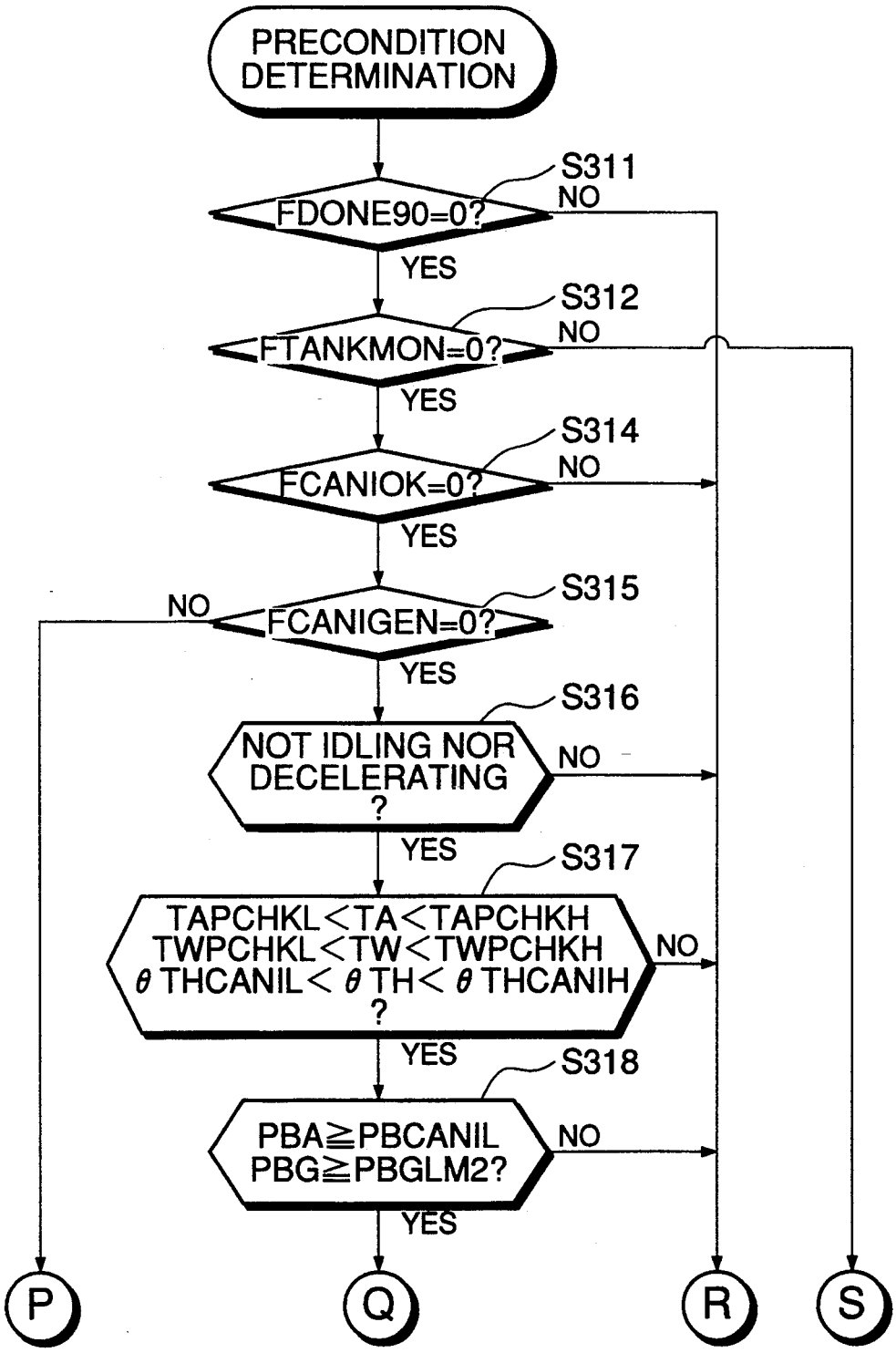
FIG. 29 is a flowchart showing part of a subroutine of the canister monitoring carried out by the second embodiment system for determining whether or not a precondition for the canister monitoring is satisfied.

Referring to FIG. 28, at a step S301, it is determined whether or not a flag FCANIMON which is set to "1" when the precondition is satisfied in a routine described hereinbelow with reference to FIG. 29, is equal to "1". If the answer to this question is affirmative (YES), according to subroutines, described hereinbelow, the negative pressurization of the canister side part of the system without significantly reducing pressure within the fuel tank (step S303), the canister internal pressure stability check in which the canister side part of the system is isolated or shut off from the other part of the system after the negative pressurization and held in the negatively pressurized state for a predetermined time period (step S304), and the canister leak check for making a check for a leak in the canister side part of the system alone (step S305), are sequentially executed, followed by terminating the program. The operating states of the valves and changes in the tank internal pressure PTANK are as shown in FIG. 27, and details thereof will be described when each subroutine is described below.

Referring back to FIG. 28, if the answer to the question of the step S301 is negative (NO), i.e. if the precondition is no longer satisfied, a tCANCEL3 timer, which is set to a predetermined time period tCANCEL3 whenever the precondition is satisfied, is started, and it is determined at a step S306, wherein it is determined whether or not the count value of the tCANCEL 3 timer is equal to "0". When this step is first carried out, the answer to the question is negative (NO), and hence the program proceeds to at a step S307.

At the step S307, the bypass valve 24, the puff loss valve 22, the drain shut valve 26, and the jet purge control valve 29 are opened, and the purge control valve 30 is opened, to thereby open the emission control system 31 to the atmosphere, canceling the negative pressure established within the system. The program then proceeds to a step S308, wherein the tATMOP timer is set to a predetermine time period tATMOP (e.g. 100 msec.) required to elapse before the open-to-air processing or the pressure cancellation is completed and at the same time a flag FCANIGEN for indicating the completion of the negative pressurization of the canister side part of the system is set to "0", followed by terminating the program.

Then, when the predetermine time period tCANCEL3 has elapsed, reducing the count value of the tCANCEL3 timer to "0", and accordingly the answer to the question of the step S306 becomes affirmative (YES), the program proceeds to a step S309, wherein the bypass valve 24 is closed with the puff loss valve 22 and the drain shut valve 26 being kept open, followed by executing the step S308 and then terminating the program.

The steps S306 to S309 are executed to prevent the state of the system resulting from the canister monitoring which is completed or discontinued due to lack of fulfillment of the precondition, from adversely affecting data read in when the PTANK monitoring is carried out again thereafter, by opening the system 31 to the atmosphere while inhibiting the monitoring for the predetermined time period tCANCEL3.

Figure 30:
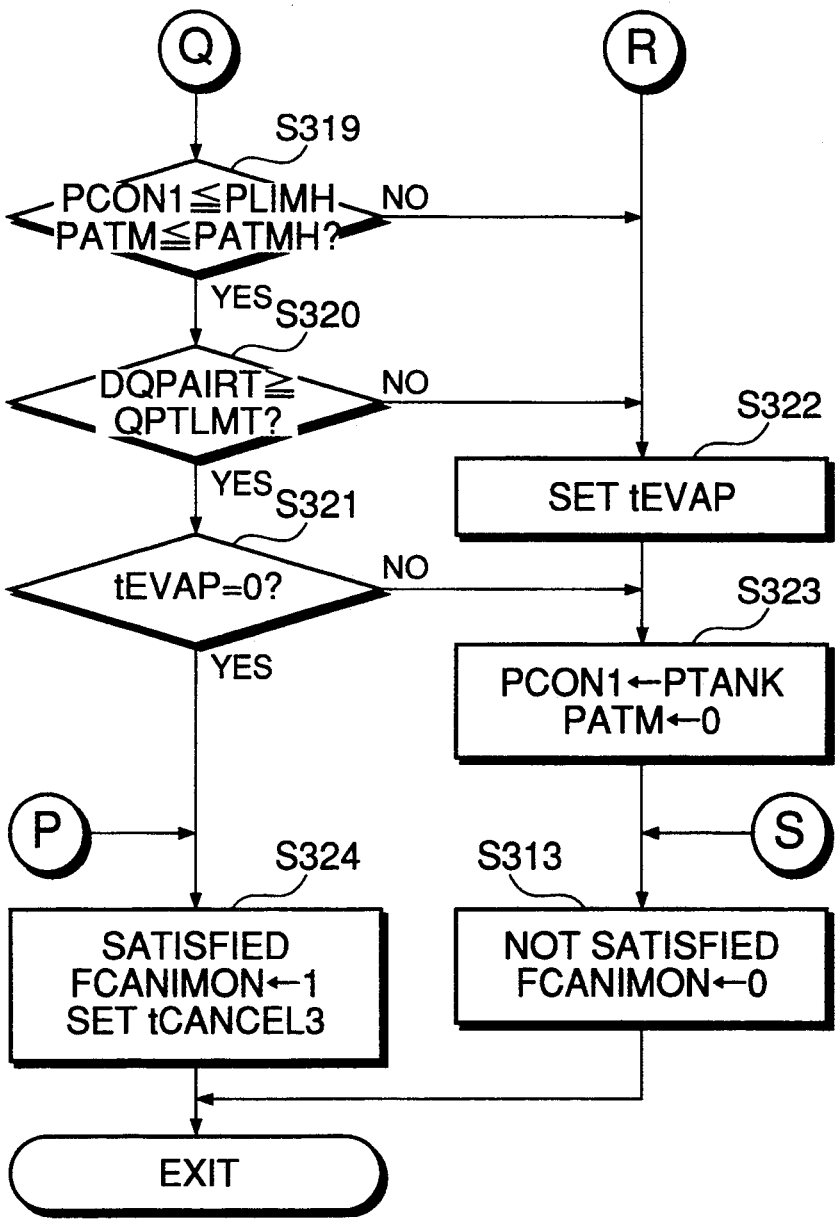
FIG. 30 is a flowchart showing the remaining part of the FIG. 29 routine.
Figure 38:
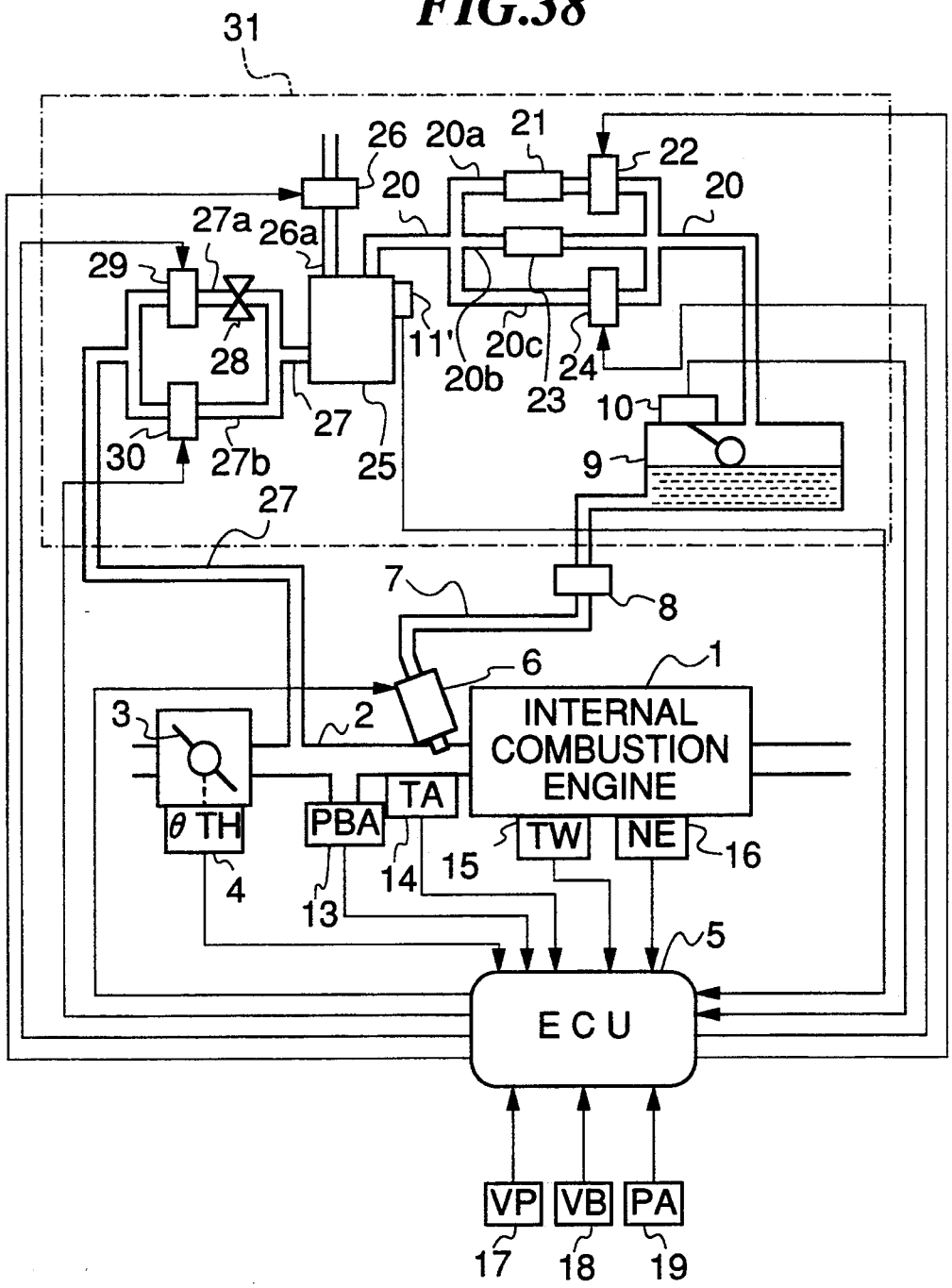
FIG. 38 is a bock diagram showing a variation to the first embodiment in which a canister internal pressure sensor is used for detecting pressure within the system.

FIG. 29 and FIG. 30 shows a subroutine executed for setting the flag FCANIMON used at the step S301 (in FIG. 38) for determining whether or not the precondition for the canister monitoring is satisfied.

Referring to FIG. 29, first at a step S311, it is determined whether or not a flag FDONME90, which is set to "1" when the negative pressure checks for a leak on the fuel tank side part of the system and the canister side part of the system are completed, is equal to "0". When this step is first carried out, the answer to this question is affirmative (YES), and the program proceeds to a step S312, wherein it is determined whether or not a flag FTANKMON which is set to "1" when the precondition for the tank monitoring is satisfied, is equal to "0". If the answer to this question is negative (NO), i.e. if the flag FTANKMON is equal to "1", it is judged that the canister monitoring cannot be performed properly since the tank monitoring is being carried out, and a flag FCANIMONK is set to "0" at a step S313 to indicate that the precondition for the canister monitoring is not satisfied, followed by terminating the program.

If the answer to the question of the step S312 is affirmative (YES), i.e. if the flag FTANKMON is equal to "0", it is determined at a step S314 whether or not a flag FCANIOK, which is set to "1" when it is determined that the canister side part of the system is normal without a leak, is equal to "0". When this step is first carried out, the answer to this question is affirmative (YES), and the program proceeds to a step S316, wherein it is determine whether or not the engine is neither idling nor decelerating.

If the answer to the question of the step S316 is affirmative (YES), the program proceeds to a step S317, wherein it is determined whether the intake air temperature TA falls between predetermined upper and lower limits TAPCHKH, TAPCHKL, whether the engine coolant temperature TW falls between predetermined upper and lower limits TWPCHKH, TWPCHKL, and further whether the throttle valve opening θTH falls between predetermined upper and lower limits θTHCANIH, θTHCANIH. If the answer to this question is affirmative (YES), the program proceeds to a step S318.

At the step S318, it is determined whether or not the intake pipe absolute pressure PBA is not lower than a predetermined value PBCANIL and at the same time the differential pressure PBG between the atmospheric pressure PA and the intake pipe absolute pressure PBA is not smaller than a predetermined value PBGLM2. If the answer to this question is affirmative (YES), the program proceeds to a step S319 in FIG. 30. At the step S319, it is determined whether or not a value (initial pressure) PCON1 of the tank internal pressure is not higher than a predetermine upper limit value PLIMH, and the value PATM of the tank internal pressure obtained when the system was opened to the atmosphere is not higher than a predetermined value PATMH. If the answer to the question of the step S319 is affirmative (YES), it is judged that evaporative fuel is not generated a large rate, and accordingly the program proceeds to a step S320 , wherein it is determined whether or not the integrated flow amount DQPAIRT of the purged gas is not lower than a predetermined value QPTLMT. If the answer to this question is affirmative (YES), it is judged that purging of evaporative fuel has been sufficiently performed to reduce the amount of evaporative stored in the canister 25 to a small value, and hence the canister monitoring can be carried out without significantly affecting the air-fuel ratio control. Therefore, the program proceeds to a step S321. In this connection, the integrated flow amount DQPAIRT of the purged gas is an amount of purged gas obtained by integrating values of the purging flow rate calculated based on a degree of the opening of the purge control valve 30 and the differential pressure PBG, from the start of the engine up to the present loop.

On the other hand, if any of the answers to the questions of the steps S311, S314, S316, S317, S318, S319, and S320 is negative (NO), it is judged that the precondition is not satisfied, and accordingly a tEVAP timer is set to a predetermined time period tEVAP at a step S322, and the initial pressure PCON1 is set to a value of the tank internal pressure PTANK obtained in the present loop, as well as the value PTATM of the tank internal pressure after the open-to-air processing is set to "0" at a step S323. Further, the flag FCANIMON is set to "0" at a step S313, followed by terminating the program.

At the step S321, it is determined whether or not the count value of the tEVAP timer set to the predetermined time period tEVAP is equal to "0". If the answer to this question is affirmative (YES), it is judged that the monitoring conditions described above have been satisfied for the predetermined time period tEVAP, and accordingly the flag FCANIMON is set to "1" and the tCANCEL3 timer referred to in the FIG. 28 main routine is set to the predetermined time period tCANCEL3 at a step S324, followed by terminating the program.

If the answer to the question of the step S321 is negative (NO), it is judged that the precondition is not satisfied since the above-mentioned individual conditions have not been satisfied for the predetermined time period, and the step S323 is executed, setting the flag FCANIMON to "0" at a step S313, followed by terminating the program.

If the answer to the question of the step S315 becomes negative (NO), i.e. if the flag CANIGEN becomes equal to "1", indicating the completion of the negative pressurization of the canister side part of the system, in the following loops, it is judged that the precondition is satisfied, and the program skips over the steps S316, S317, S318, S319, S320 and S321, to the step S324, followed by terminating the program.

Figure 31:
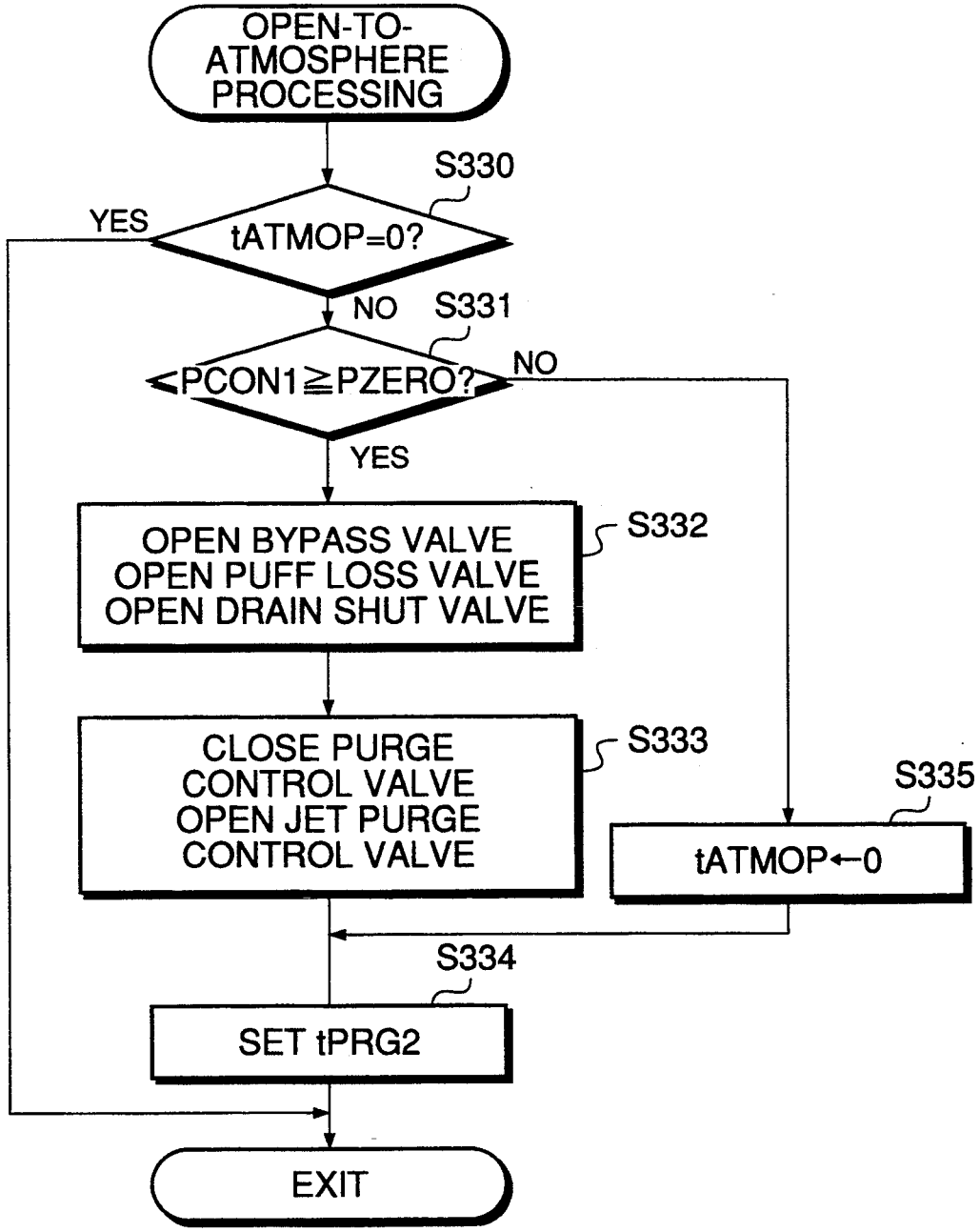
FIG. 31 is a flowchart showing a subroutine of the canister monitoring carried out by the second embodiment system for relieving the system to the atmospheric pressure.

FIG. 31 shows the open-to-atmosphere processing executed at the step S302 in FIG. 28.

First, at a step S330, it is determined whether or not the count value of the tATMOP timer set to the predetermined time period tATMOP is equal to "0". When this step is first carried out, the answer to this question is negative (NO), and accordingly the program proceeds to a step S331, wherein it is determined whether or not the aforementioned initial pressure PCON1 is not lower than a predetermined threshold value PZERO. If the answer to this question is affirmative (YES), the emission control system 31 is opened to the atmosphere by opening the bypass valve 24, which was closed in the normal purging mode, with the puff loss valve 22 and the drain shut valve 26 being kept open as in the normal purging mode, and closing the purge control valve 30, which was opened in the normal purging mode, with the jet purge control valve 29 being kept open as in the normal purging mode, as shown in FIG. 27, followed by the program proceeding to a step S334. In this sate of the emission control system 31, as time elapses, the canister internal pressure, which was negatively pressurized e.g. to a value approximately 6 mmHg lower than the atmospheric pressure in the normal purging mode becomes equal to the atmospheric pressure, as indicated by the one-dot chain line in FIG. 27. Further, as indicated by the solid line in FIG. 27, the tank internal pressure PTANK (the output from the tank internal pressure sensor 11) which was positive, e.g. approximately 2 mmHg higher than the atmospheric pressure in the normal purging mode also becomes equal to the atmospheric pressure.

On the other hand, if the answer to the question of the step S331 is negative (NO), it is judged that the pressure within the canister side part of the system has continued to be negative, i.e. it was lower than the atmospheric pressure before the start of the canister monitoring and has been negative thereafter, and the tATMOP timer is set to "0" to skip over the open-to-atmosphere processing, followed by the program proceeding to the step S334. At the step S334, a tPRG2 timer is set to a predetermined time period tPRG2 (e.g. 100 msec.) required for negative pressurization (S303) of the canister side part of the system, followed by terminating the program.

Figure 32:
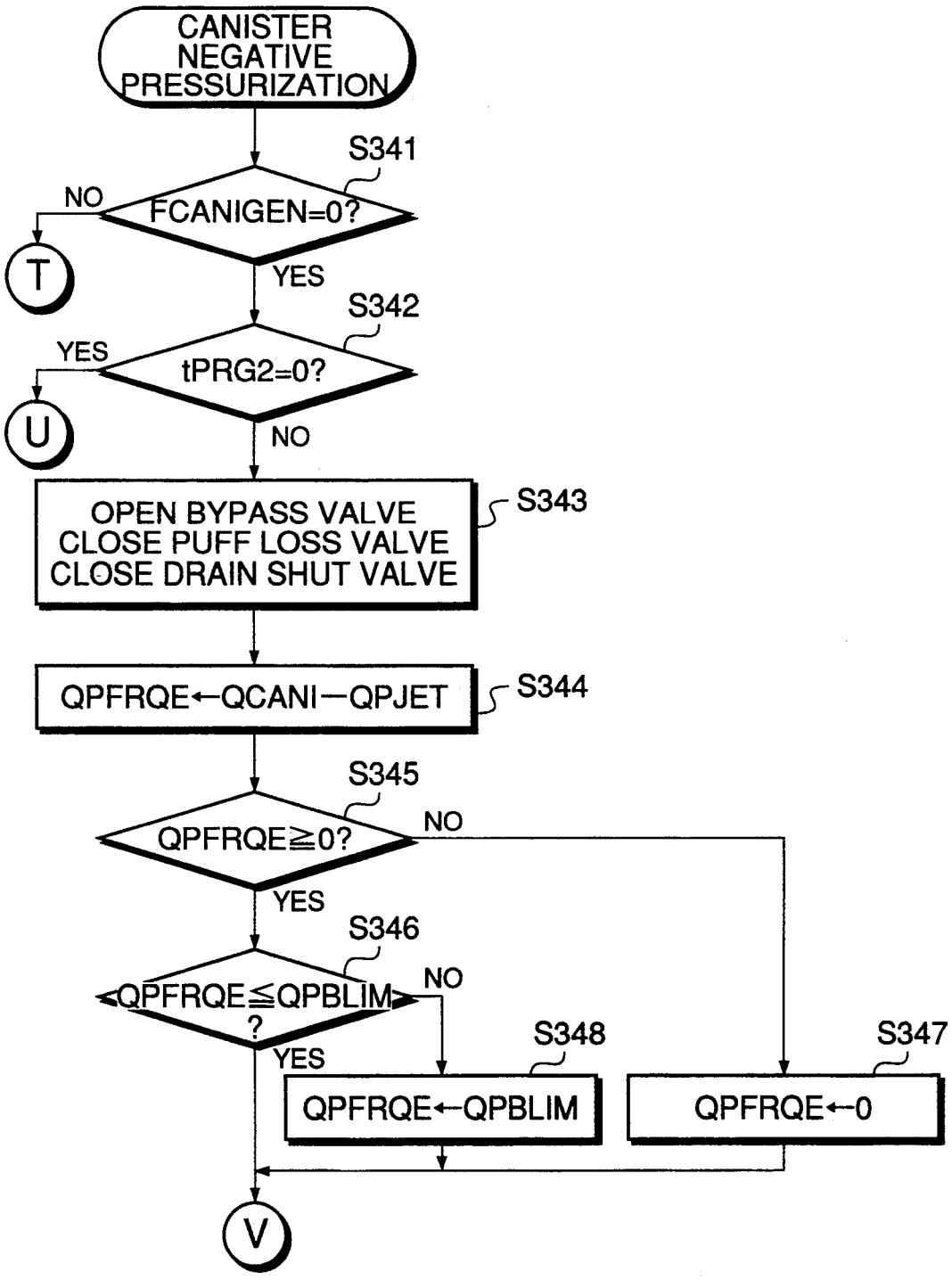
FIG. 32 is a flowchart showing a subroutine of the canister monitoring carried out by the second embodiment system for negative pressurization of the canister.
Figure 33:
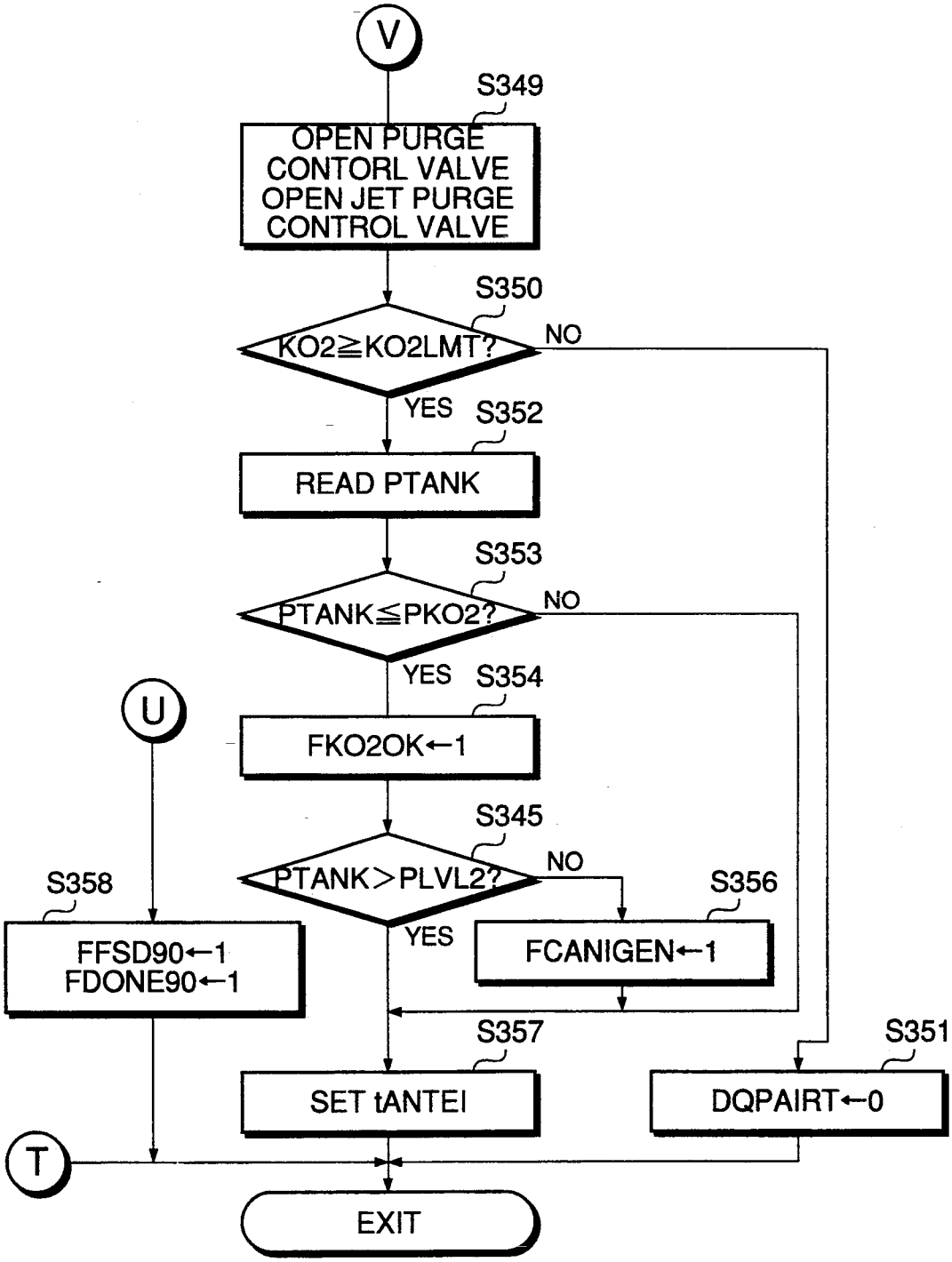
FIG. 33 is a flowchart showing the remaining part of the FIG. 32 subroutine.

FIG. 32 and FIG. 33 shows a subroutine for negatively pressurizing the canister side part of the system.

First, at a step S341 in FIG. 2, it is determined whether or not the flat FCANIGEN, which is set to "1" when the negative pressurization of the canister side part of the system is completed, is equal to "0". When this step is first carried out, the answer to this question is affirmative (YES), and accordingly the program proceeds to a step S342, wherein the count value of the tPRG2 timer which was set to the predetermined time period tPRG2 required for the negative pressurization of the canister side part of the system is equal to "0". When this step is first carried out, the answer to this question is negative (NO), and the program proceeds to a step S343, wherein the bypass valve 24 is kept open, and the puff loss valve 22 and the drain shut valve 26 are closed, as shown in FIG. 27, and at the following step S344, a flow rate value QPFRQE to which the flow rate of the purged gas should be controlled by the purge control valve 30 is calculated by subtracting a flow rate QPJET of purged gas flowing through the jet purge control valve 29 from a predetermined flow rate QCANI for negatively pressurizing the part of the system on the canister side.

Then, at a step S345, it is determined whether or not the flow rate value QPFRQE of the purged gas obtained at the step S344 is not smaller than "0". If the answer to this question is affirmative (YES), it is further determined at a step S346 whether or not the flow rate value QPFRQE of the purged gas is not larger than a predetermined upper limit value QPBLIM. If the answer to this question is affirmative (YES), the program jumps over to a step S349 in FIG. 33, whereas if the answers to these questions are negative (NO), the flow rate QPFRQE is set to a lower limit value "0" at a step S347, and set to a upper limit value QPBLIM at a step S348, respectively, to thereby set limits to the flow rate value QPFRQE, followed by the program proceeding to the step S349. At the step S349, the purge control valve 30 is opened to an extent determimed by the duty ratio, with the jet purge control valve 29 being kept open (see FIG. 27).

These steps S344 to S349 make it possible to calculate a duty ratio of the purge control valve 30 according to the negative pressure within the intake pipe. Furthermore, this duty ratio is controlled such that the flow rate value QPFQE of the purged gas constantly falls between the above-mentioned upper and lower limit values.

Then, the program proceeds to a step S350, wherein it is determined whether or not an air-fuel ratio correction coefficient K02 is not lower than a predetermined value KO2LMT. If the answer to this question is negative (NO), it is judged that a rather large amount of evaporative fuel is generated and the air-fuel ratio correction coefficient K02 may be largely changed toward a lean limit, and accordingly the program proceeds to a step S351, wherein the integrated flow amount DQPAIRT of the purged gas, referred to at the step S320 (FIG. 30), is set to "0", followed by terminating the program.

If the answer to the question of the step S350 is affirmative (YES), it is judged that a small amount of evaporative fuel is being generated and the Canister monitoring can be performed under a stable air-fuel ratio, and the program proceeds to a step S352. At the step S352, the present value of the tank internal pressure PTANK is read in, and it is determined at the following step S353 whether or not the present value of the tank internal pressure PTANK is not higher than a predetermined value PK02. If the answer to this question is affirmative (YES), it is judged that a mixture of evaporative fuel and air is supplied via the purge control valve 30 into the intake pipe 27 and hence the canister side part of the system is negatively pressurized, and a flag FKO20K is set to "1" to indicate that the mixture is supplied into the intake pipe.

Then, at the step S355, it is determined whether or not the tank internal pressure PTANK is higher than a target canister negative pressure PLVL2 (provided that PK02>PLVL2). If the answer to this question is negative (NO) (e.g. if the tank internal pressure PTANK is −30 mmHg, see FIG. 27), it is judged that the canister side part of the system has been negatively pressurized to a sufficient degree, and the flag CANIGEN is set to "1" at a step S356 to indicate that the negative pressurization of this part of the system is completed, and then a tANTEI timer is set to a predetermined time period tANTEI which is required to elapse before completing a check for stabilized tank internal pressure. In this connection, the internal pressure of the canister 25 should be e.g. −53 mmHg, which is even more negative than a pressure value indicated by the output from the tank internal pressure sensor 11 arranged in the changing passage 20 (see FIG. 27).

According to the present embodiment, the negative pressurization is terminated when the canister side part of the system is negatively pressurized before the fuel tank is negatively pressurized to a significant level, which makes it possible to effect negative pressurization of the canister side part of the system to the aforementioned target canister negative pressure in a short time period.

Further, if the answer to the question of the step S353 is negative (NO), i.e. if PTANK>PK02, or if the answer to the question of the step S355 is affirmative (YES), i.e. if PTANK>PLVL2, the step S357 is then carried out, followed by terminating the program.

If the answer to the question of the step S342 is affirmative (YES), i.e. if tPRG2=0, during the negative pressurization, it means that the canister side part of the system cannot be negatively pressurized to the target canister negative pressure PLVL2 within the predetermined time period tPRG2, and hence it is judged that there is a large leak in the canister side part of the system. Therefore, a flag FFSD90 is set to "1" to indicate the existence of the large leak in the canister side part of the system, and a flag FDONE90 is set to "1" to indicate termination of the negative pressure check, followed by terminating the program of the canister monitoring.

Figure 34:
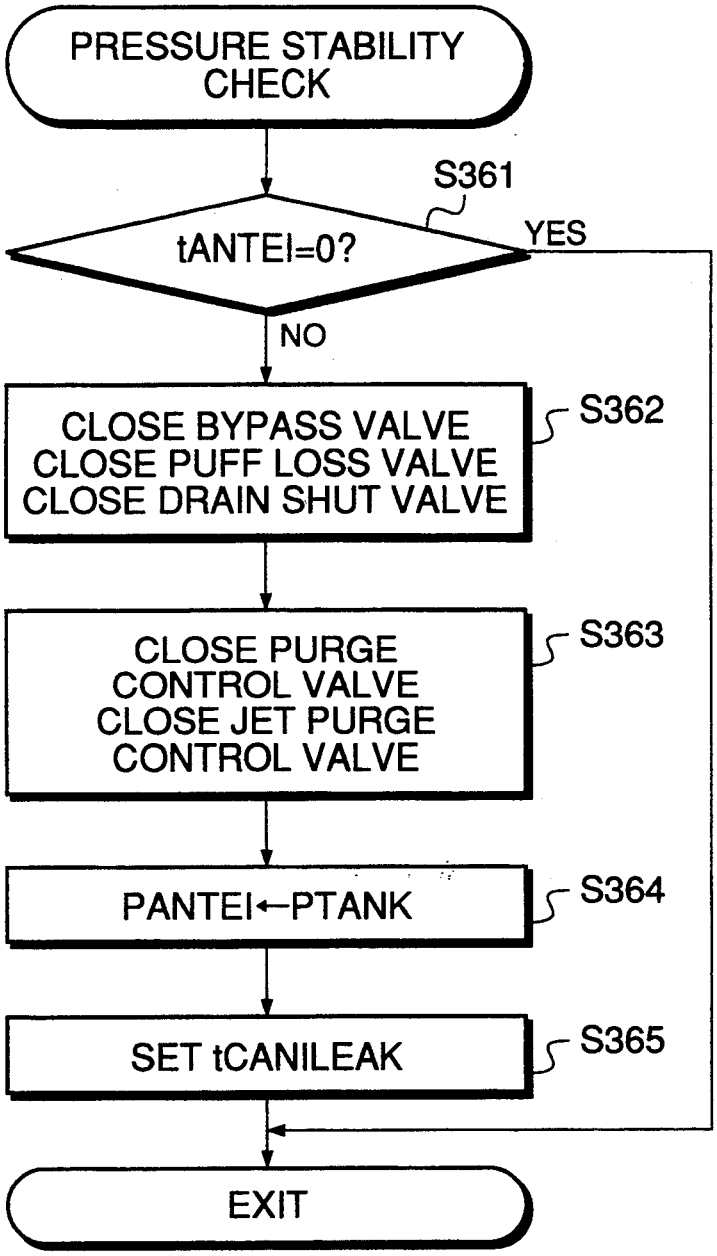
FIG. 34 is a flowchart showing a subroutine of the canister monitoring carried out by the second embodiment system for making a check for stability of pressure within the canister.

FIG. 34 shows a routine for making a check for the stabilized internal pressure, which is executed at the step S304 in FIG. 28.

First, at a step S361, it is determined whether or not the count value of the tANTEI timer which is set to the predetermined time period tANTEI at the step S357 (FIG. 33) is equal to "0". When this step is first carried out, the answer to this question is negative (NO), and hence the program proceeds to a step S362, wherein the bypass valve 24 is closed, with the puff loss valve 22 and the drain shut valve 26 being kept closed, and further at a step S363, the purge control valve 30 and the jet purge valve 29 are closed, whereby the canister side part of the system ranging from the purge control valve 30 and the jet purge valve 29 to the one-way valve 21, the two-way valve 23 and the bypass valve 24 is isolated or shut off from the other part of the system.

The tank internal pressure PTANK is read in at a step S364 as PANTEI with the system being held in the above state until completion of the check for stabilized internal pressure. In the meanwhile, the value of PANTEI which indicates the internal pressure of the fuel tank side part of the system ranging from the two-way valve 23 to the fuel tank becomes substantially equal to the atmospheric pressure, but whole the canister internal pressure is held to a negative pressure of approximately 53 mmHg (see FIG. 27). However, if there is a leak in the canister side part of the system, the canister internal pressure is substantially equal to the atmospheric pressure at termination of the check for the stabilized internal pressure, as indicated by the two-dot chain line in FIG. 27.

At the following step S365, a tCANILEAK timer is set to a predetermined time period tCANILEAK which is required to elapse before making the negative pressure check on the canister side part of the system. Thereafter, if the answer to the question of the step S361 is affirmative (YES), it is determined that the check for the stabilized internal pressure is completed, followed by terminating the program.

Figure 35:
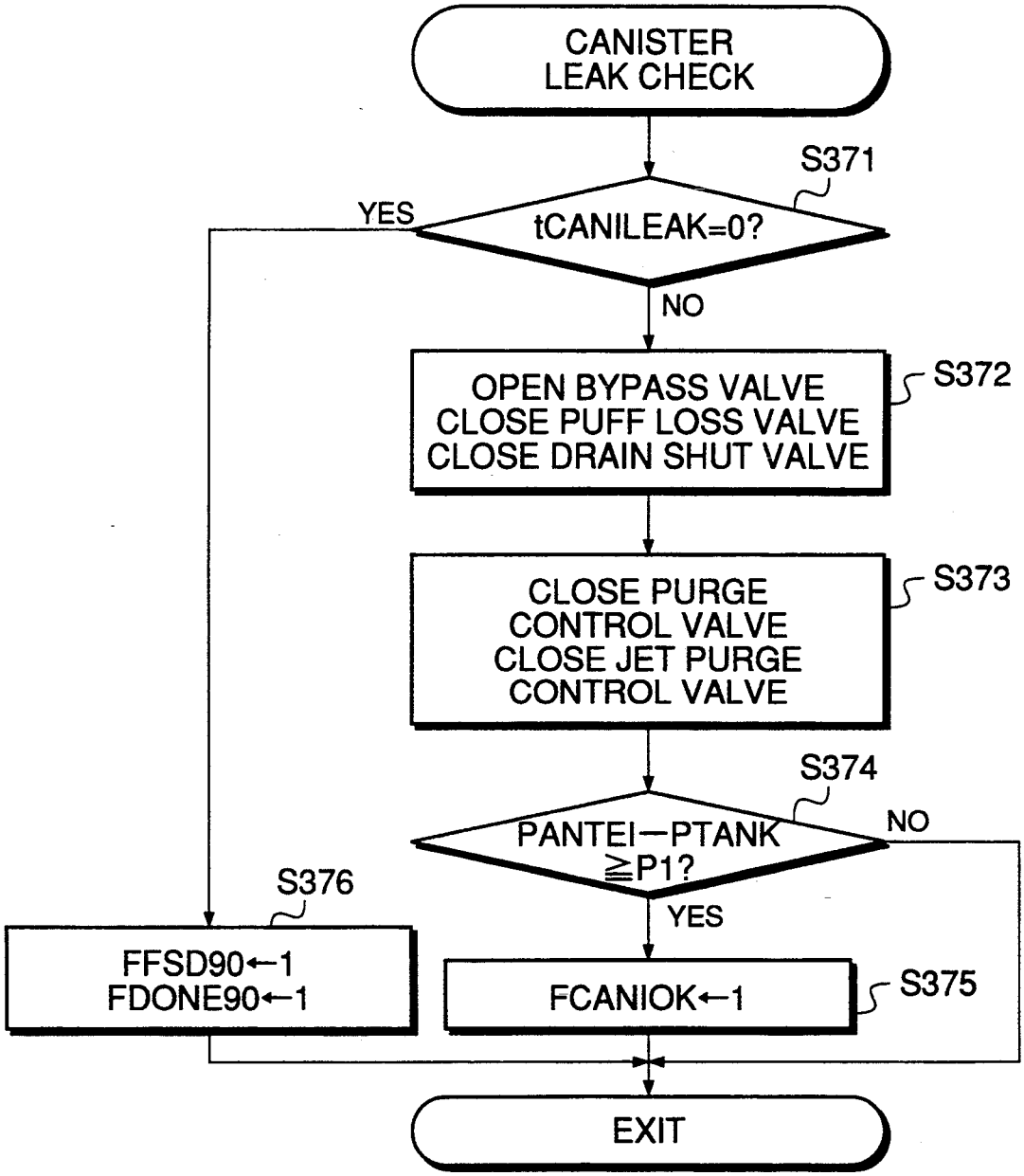
FIG. 35 is a flowchart showing a subroutine of the canister monitoring carried out by the second embodiment system for making a check for leakage from the canister.

FIG. 35 shows a routine for making the negative pressure check on the canister side part of the system, which is executed at the step S305 in FIG. 28.

First, at a step S371, it is determined whether or not the count value of the tCANILEAK timer which is set to the predetermined time period tCANILEAK at the step S365 in FIG. 34 is equal to "0". When this step is first carried out, the answer to this question is negative (NO), the program proceeds to the step S372 et seq. At the steps S372 and S373, the puff loss valve 22, the drain shut valve 26, the jet purge valve 29 and the purge control valve 30 are kept closed, and the bypass valve 24 alone is opened.

Then, it is determined at a step S374 whether or not a difference between the value of PANTEI read in during the check for the stabilized internal pressure PTANK and the present value of the tank internal pressure calculated by subtracting the latter from the former is larger than a predetermined value P1. If the answer to this question is affirmative (YES), it is judged that there is no leak in the canister side part of the system, i.e. this part of the system is normal, and the flag FCANIOK is set to "1" at a step S375, followed by terminating the program.

That is, if there is no leak in the canister side part of the system, the pressure prevalent within the canister side part of the system is held at the negative pressure of approximately 53 mmHg, while the value of PANTEI, which is the pressure prevalent within the fuel tank side part of the system, is substantially equal to the atmospheric pressure. When the bypass valve 24 alone is opened in this state of the system as at the step S372, a flow of gas occurs from the fuel tank side part of the system to the canister side part of the system due to a large differential pressure between the two parts of the system, causing pressure loss to create negative pressure (e.g. −25 mmHg; see A1 in FIG. 27) at the tank internal pressure sensor 11 and its vicinity. If this negative pressure is detected, the answer to the question of the step S374 becomes affirmative (YES). In the present embodiment, the negative pressure A1 can be accurately detected since the tank internal pressure sensor 11 is mounted in the charging passage 20 upstream of the bypass valve 24 at a location close to the branches **20*a* to 20*c* but remote from the fuel tank 9**.

On the other hand, if there is a leak in the canister side part of the system, the pressure within the canister at termination of the check for the stabilized internal pressure is substantially equal to the atmospheric pressure, and hence the negative pressure A1 due to pressure loss does not occur. Therefore, the answer to the question of the step S374 is negative (NO), since the difference between the value of PANTEI and the present value of the tank internal pressure PTANK calculated by subtracting the latter from the former is smaller larger than the predetermined value P1.

On the other hand, if the answer to the question of the step S371 is affirmative (YES), i.e. if tCANILEAK=0, the program proceeds to a step S376, wherein the flag FFSD90 is set to "1" to indicate the existence of a leak in the canister side part of the system, and the flag FDONE90 is set to "1" to indicate termination of the negative pressure check, followed by terminating the program.

When the above-described sequence of the canister monitoring routines is completed, the system is changed to the normal purging mode in which the bypass valve 24 is closed, and the puff loss valve 22, the drain shut valve 26, the purge control valve 30 and the jet purge control valve 29 are opened.

Thus, according to the present embodiment, the tank monitoring (check for leakage from the fuel tank side part of the system) and the canister monitoring (check for leakage from the canister side part of the system) are separately or individually carried out, which makes it possible to separately or individually detect abnormality of the fuel tank side part of the system and that of the canister side part of the system. Further, in performing the tank monitoring, the actual tank monitoring is carried out only when there is a large possibility of leakage judging from results of preliminary PTANK monitoring, which allows the frequency of the tank monitoring to be reduced, largely reducing the time used for the tank monitoring. Similarly, in the canister monitoring, the negative pressurization is terminated when the canister side part of the system is negatively pressurized to a sufficient degree before the fuel tank side part of the system is significantly negatively pressurized, which makes it possible to perform the canister monitoring promptly.

Further, according to the present invention, the pressure within the fuel tank and the pressure within the canister are detected by a single pressure sensor, which makes it possible to prevent an increase in the manufacturing cost. However, the pressure within the fuel tank and the pressure within the canister may be detected respective pressure sensors arranged therein to separately or individually perform abnormality diagnosis of these parts, thereby permitting location of a faulty part.

Figure 36:
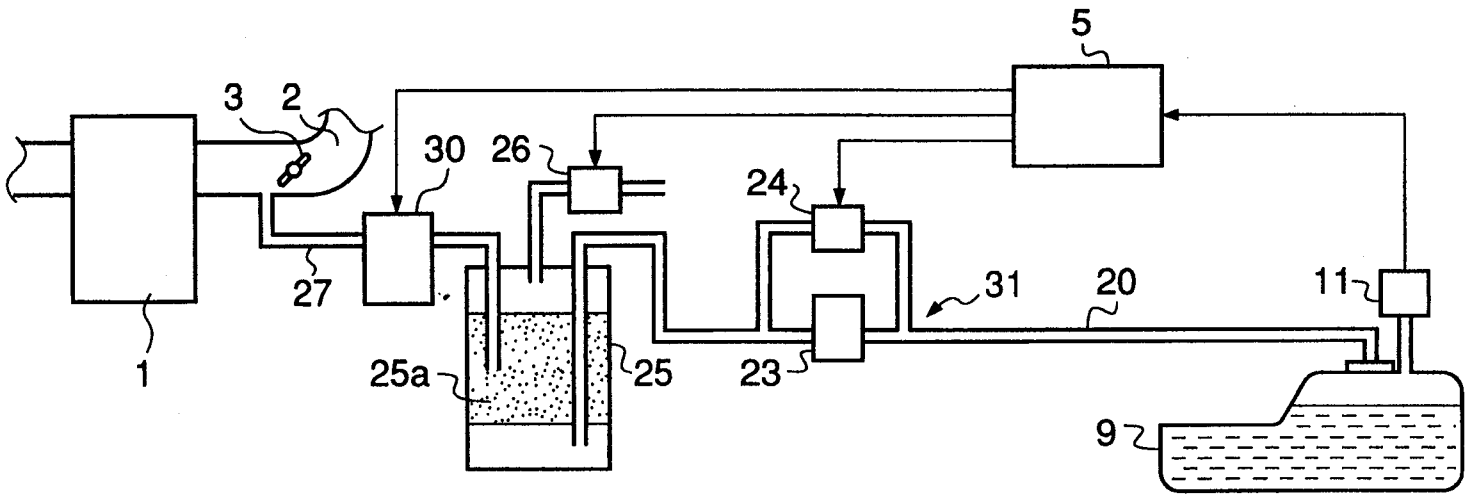
FIG. 36 is a bock diagram showing the whole arrangement of an evaporative fuel-processing system according to a third embodiment of the invention.

FIG. 36 shows the whole arrangement of an evaporative fuel-processing system according to a third embodiment of the invention. In FIG. 36, component parts and elements corresponding to those of the first and second embodiments described above are designated by identical reference numerals. The emission control system of this embodiment is rather simplified in construction compared with that of the first embodiment in that the one-way valve 21 and the puff loss valve 22 together with the branch **20*a* as well as the jet orifice 28 and the jet purge control valve 29 together with the first branch 27*a*** are omitted.

Figure 37:
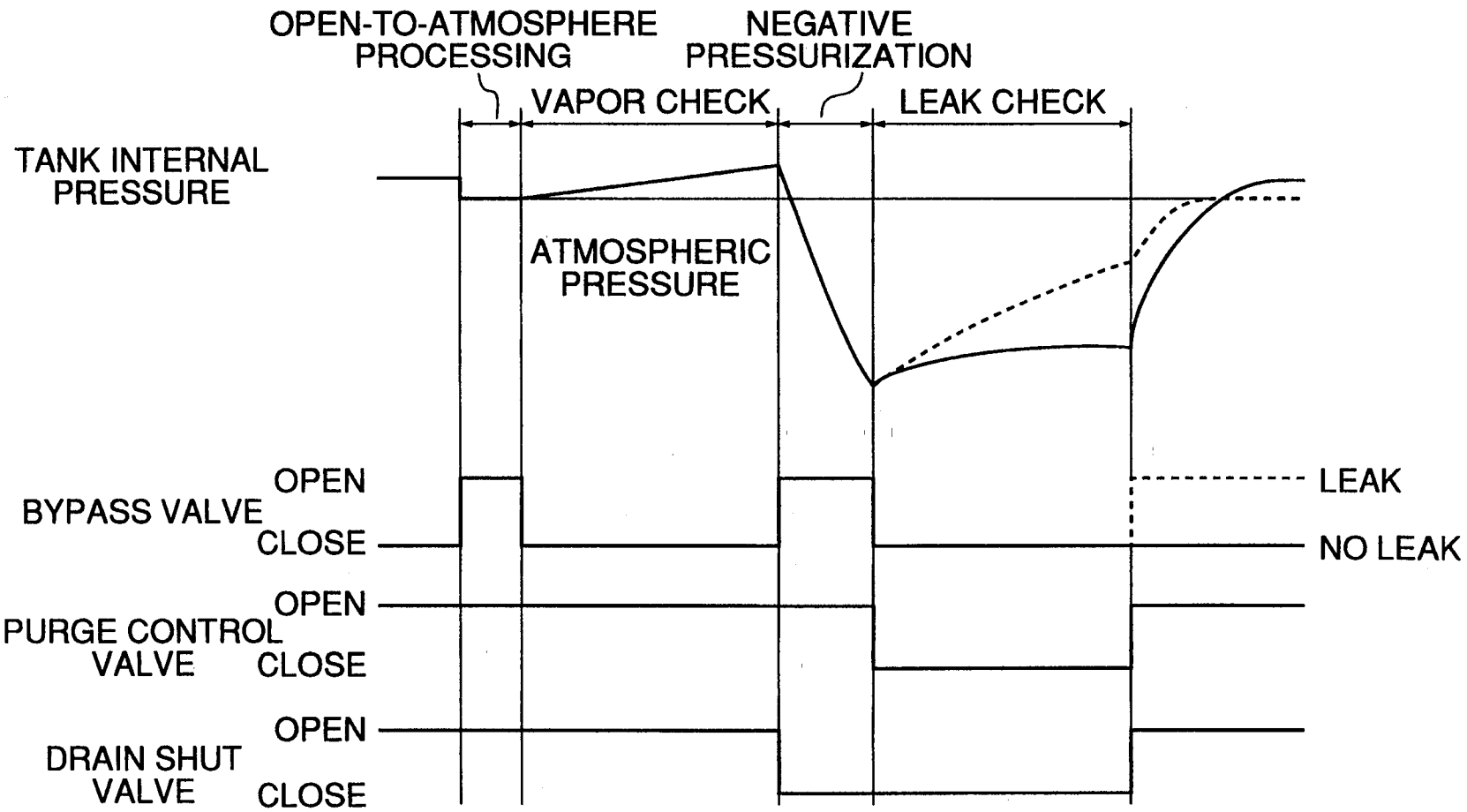
FIG. 37 is a timing chart showing operating states of valves arranged in the evaporative fuel-processing system and changes in the fuel tank internal pressure.

The abnormality check on the evaporative emission control system of the present embodiment is carried out in the following manner:

In making a check for leakage from the system, the fuel tank 9 is temporarily opened to the atmosphere by opening the bypass valve 24 with the purge control valve 30 and the drain shut valve 26 being kept open, and them the bypass valve 24 is closed to perform vapor check in which a rate of generation of evaporative fuel is detected by the use of a degree of increase in the tank internal pressure occurring thereafter. Then, the drain shut valve 26 is closed and the bypass valve 24 is opened with the purge control valve 30 being kept open, to thereby allow the negative pressure within the intake pipe to act on the fuel tank side part of the system until this part of the system is negatively pressurized to a predetermined negative pressure level. Then, the bypass valve 24 is closed over a predetermined time period to make a check for a leak in the system. If there is no leak, the tank internal pressure is maintained negative although it slightly rises due to generation of evaporative fuel, whereas if there is a leak, the tank internal pressure rises as indicated by the dotted line in FIG. 37. A predetermined reference value is corrected according to the rate of generation evaporative fuel detected by the vapor check, and the tank internal pressure detected by the tank internal pressure sensor 11 detected during the leak check is compared with the corrected predetermined reference value to determine whether there is a leak in the system.

If the tank internal pressure is lower than the corrected predetermined reference value and accordingly it is determined that there is no leakage, the purge control valve 30 and the drain shut valve 26 are opened with the bypass valve 24 being kept open to return to the normal purging mode, whereas if the tank internal pressure is higher than the corrected predetermined reference value and accordingly it is determined that there is a leak, the bypass valve is kept open. This causes the tank internal pressure to be lower than the atmospheric pressure, preventing evaporative fuel from being emitted into the atmosphere via the leak from which leakage occurs.

Although in the above embodiment, the pressure within the fuel tank 9 is detected by the pressure sensor 11, this is not limitative, but the pressure within the charging passage 20 at a location upstream of the bypass valve 24 may be detected instead. Further, although in this embodiment, the purge control valve 30 is closed in the leak check, this is not limitative, but the purge control valve 30 may be opened then.

What is claimed is:

1. In an evaporative fuel-processing system for an internal combustion engine having a fuel tank and an intake passage, said evaporative fuel-processing system including said fuel tank, a canister for adsorbing evaporative fuel generated from said fuel tank, said canister having an air inlet port communicating with the atmosphere, a charging passage connecting between said fuel tank and said canister, a first control valve arranged in said charging passage, a purging passage connecting between said canister and said intake passage of said engine, a second control valve arranged in said purging passage, a third control valve arranged in said air inlet port for opening and closing said air inlet port, and system internal pressure-detecting means arranged in said system at a location upstream of said first control valve for detecting pressure within said system, the improvement comprising:

pressure-reducing means for effecting negative pressurization of said system until said pressure detected by said system internal pressure-detecting means reaches a predetermined negative value by opening said first control valve and said second control valve, and at the same time closing said third control valve; and abnormality-determining means for closing said first control valve and determining abnormality of said system based on a value of said pressure within said system detected in the state in which said first control valve is closed.

2. An evaporative fuel-processing system according to claim 1, wherein said abnormality-detecting means determines said abnormality of said system based on an amount of change in said value of said pressure within said system detected by said system internal pressure-detecting means while said first control valve is closed.

3. An evaporative fuel-processing system according to claim 2, wherein said abnormality-determining means determines that part of said system upstream of said first control valve is abnormal, when two conditions are satisfied that said pressure-reducing means was incapable of negatively pressurizing said system to said predetermined negative value within a predetermined time period, and that an amount of change in said value of said pressure within said system detected when said first control valve is closed after said third control valve is opened is below a predetermined value.

4. An evaporative fuel-processing system according to claim 1, further including inhibiting means for inhibiting operations of said pressure-reducing means and said abnormality-determining means when said pressure within said system detected by said system internal pressure-detecting means when said first control valve is closed before the start of said negative pressurization by said pressure-reducing means is above a predetermined upper limit value.

5. An evaporative fuel-processing system according to claim 1, further including operating condition-detecting means for detecting operating conditions of said engine, and abnormality determination-permitting means for permitting said pressure-reducing means and said abnormality-determining means to perform their operations only when said operating condition-detecting means detects that said engine is a predetermined operating condition.

6. An evaporative fuel-processing system according to claim 1, wherein said abnormality-determining means starts to operate upon termination of operation of said pressure-reducing means and compares said value of said pressure within said system with a predetermined reference value to determine said abnormality of said system.

7. An evaporative fuel-processing system according to claim 6, further including a correction amount-detecting means for opening said third control valve, and then closing said first control valve to detect an amount of change in said pressure within said system, wherein said predetermined reference value is corrected based on said amount of change in said pressure within said system.

8. In an evaporative fuel-processing system for an internal combustion engine having a fuel tank and an intake passage, said evaporative fuel-processing system including said fuel tank, a canister for adsorbing evaporative fuel generated from said fuel tank, said canister having an air inlet port communicating with the atmosphere, a charging passage connecting between said fuel tank and said canister, a first control valve arranged in said charging passage, a purging passage connecting between said canister and said intake passage of said engine, a second control valve arranged in said purging passage, a third control valve arranged in said air inlet port for opening and closing said air inlet port, and system internal pressure-detecting means arranged in said system at a location upstream of said first control valve for detecting pressure within said system, the improvement comprising:

pressure-reducing means for effecting negative pressurization of said system until said pressure detected by said system internal pressure-detecting means reaches a predetermined negative value by opening said first control valve and said second control valve, and at the same time closing said third control valve; and first pressure change-detecting means for closing said first control valve, said second control valve, and said third control valve, after said negative pressurization of said system, and detecting a first amount of change in said pressure within said system in the resulting state of said system in which said first control valve, said second control valve, and said third control valve are closed;

second pressure change-detecting means for opening said first control valve with said second control valve and said third control valve being kept closed after said first amount of change in said pressure within said system has been detected by said first pressure change-detecting means, and detecting a second amount of change in said pressure within said system having occurred after said first control valve has been opened; and abnormality-determining means for determining abnormality of said system based on said first amount of change and said second amount of change in said pressure within said system.

9. An evaporative fuel-processing system according to claim 8, further including control means for keeping said first control valve open when said abnormality determining means determines that said system is abnormal based said first amount of change in said pressure within said system.

10. An evaporative fuel-processing system according to claim 8, further including third pressure change-detecting means for opening said third control valve, and then closing said first control valve to detect an amount of change in said pressure within said system, wherein said abnormality determining means determines that part of said system upstream of said first control valve is abnormal when a difference obtained by subtracting said third amount of change in said pressure from said first amount of change in said pressure within said system is larger than a predetermined value.

11. An evaporative fuel-processing system according to claim 8, further including control means for keeping said first control valve closed when said abnormality determining means has determined that said first amount of change in said pressure is normal, and has determined that said system is abnormal based on said second amount of change in said pressure.

12. An evaporative fuel-processing system according to claim 8, further including control means for opening said third control valve when said pressure detected by said system internal pressure-detecting means becomes lower than a predetermined lower limit value.

13. An evaporative fuel-processing system according to claim 8, further including inhibiting means for inhibiting operations of said pressure-reducing means, said first pressure change-detecting means, said second pressure change-detecting means, and said abnormality-determining means when said pressure within said system detected by said system internal pressure-detecting means when said first control valve is open before the start of said negative pressurization by said pressure-reducing means is above a predetermined upper limit value.

14. An evaporative fuel-processing system according to claim 8, further including operating condition-detecting means for detecting operating conditions of said engine, and abnormality determination-permitting means for permitting said pressure-reducing means, said first pressure change-detecting means, said second pressure change-detecting means, and said abnormality-determining means to perform their operations only when said operating condition-detecting means detects that said engine is a predetermined operating condition.

15. In an evaporative fuel-processing system for an internal combustion engine having a fuel tank and an intake passage, said evaporative fuel-processing system including said fuel tank, a canister for adsorbing evaporative fuel generated from said fuel tank, said canister having an air inlet port communicating with the atmosphere, a charging passage connecting between said fuel tank and said canister, a first control valve arranged in said charging passage, a purging passage connecting between said canister and said intake passage of said engine, a second control valve arranged in said purging passage, a third control valve arranged in said air inlet port for opening and closing said air inlet port, and system internal pressure-detecting means arranged in an intermediate portion of said system between said first control valve and said second control valve for detecting pressure within said system, the improvement comprising:

pressure-reducing means for effecting negative pressurization of said system until said pressure detected by said system internal pressure-detecting means reaches a predetermined negative value by opening at least said second control valve of said first control valve and said second control valve, and at the same time closing said third control valve; and pressure change-detecting means for closing said first control valve, said second control valve, and said third control valve, and detecting an amount of change in said pressure within said system in the resulting state of said system in which said first control valve, said second control valve, and said third control valve are closed; and abnormality-determining means for determining abnormality of said system based on said amount of change in said pressure detected by said pressure change-detecting means.

16. An evaporative fuel-processing system according to claim 15, further including operating condition-detecting means for detecting operating conditions of said engine, and abnormality determination-permitting means for permitting said pressure-reducing means, said pressure change-detecting means, and said abnormality-determining means to perform their operations only when said operating condition-detecting means detects that said engine is a predetermined operating condition.

17. In an evaporative fuel-processing system for an internal combustion engine having a fuel tank and an intake passage, said evaporative fuel-processing system including said fuel tank, a canister for adsorbing evaporative fuel generated from said fuel tank, said canister having an air inlet port communicating with the atmosphere, a charging passage connecting between said fuel tank and said canister, a first control valve arranged in said charging passage, a purging passage connecting between said canister and said intake passage of said engine, a second control valve arranged in said purging passage, a third control valve arranged in said air inlet port for opening and closing said air inlet port, and system internal pressure-detecting means arranged in said system at a location upstream of said first control valve for detecting pressure within, said system, the improvement comprising:

pressure-reducing means for effecting negative pressurization of said system until said pressure detected by said system internal pressure-detecting means reaches a predetermined negative value by opening said first control valve and said second control valve, and at the same time closing said third control valve;

comparing means for comparing a first value of said pressure within said system detected by said system internal pressure-detecting means when said first control valve and said second control valve are closed with said third control valve being kept closed, and a second value of said pressure within said system detected by said system internal pressure-detecting means after detection of said first value of said pressure when said first control valve is opened with said second control valve and said third control valve being kept closed; and abnormality determining means for determining abnormality of said system based on results of comparison by said comparing means.

18. An evaporative fuel-processing system according to claim 17, wherein said system internal pressure-detecting means is arranged in said charging passage at a location upstream of said first control valve in the vicinity thereof.

19. An evaporative fuel-processing system according to claim 18, wherein said predetermined negative value of said pressure within said system is equal to a value of said pressure to be detected by said system internal pressure-detecting means when pressure prevalent within said canister is reduced to a desired level, but pressure prevalent within said fuel tank has not been substantially reduced yet.

20. An evaporative fuel-processing system according to claim 18, further including integrated purged amount-calculating means for calculating an integrated purged amount of evaporative fuel by integrating amounts of purged evaporative fuel detected after the start of said engine, and inhibiting means for inhibiting operations of said pressure-reducing means, said comparing means, and said abnormality determining means when said integrated purged amount of evaporative fuel is below a predetermined value.

* * * * *